US008184072B2

(12) United States Patent
Yoon et al.

(10) Patent No.: US 8,184,072 B2
(45) Date of Patent: May 22, 2012

(54) METHOD AND APPARATUS FOR DRIVING PLASMA DISPLAY PANEL

(75) Inventors: Sang Jin Yoon, Chilgok-gun (KR); Eung Chul Park, Kumi-shi (KR); Bong Koo Kang, Pohang-shi (KR); Jung Gwan Han, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 1247 days.

(21) Appl. No.: 11/976,212

(22) Filed: Oct. 22, 2007

(65) Prior Publication Data

US 2008/0048941 A1 Feb. 28, 2008

Related U.S. Application Data

(62) Division of application No. 10/428,828, filed on May 5, 2003, now Pat. No. 7,286,102.

(30) Foreign Application Priority Data

| | | |
|---|---|---|
| May 3, 2002 | (KR) | 10-2002-24455 |
| May 31, 2002 | (KR) | 10-2002-30606 |
| Apr. 2, 2003 | (KR) | 10-2003-20864 |
| Apr. 2, 2003 | (KR) | 10-2003-20865 |

(51) Int. Cl.
*G09G 3/28* (2006.01)

(52) U.S. Cl. ..... 345/60; 345/63; 345/68

(58) Field of Classification Search ..... 345/60, 345/63, 68

See application file for complete search history.

(56) References Cited

U.S. PATENT DOCUMENTS

| | | | | |
|---|---|---|---|---|
| 6,150,766 | A | 11/2000 | Shino et al. | |
| 6,160,530 | A | 12/2000 | Makino | |
| 6,236,165 | B1 | 5/2001 | Ishizuka | |
| 6,249,087 | B1 * | 6/2001 | Takayama et al. | 315/169.1 |
| 6,320,560 | B1 | 11/2001 | Sasaki et al. | |
| 6,492,776 | B2 * | 12/2002 | Rutherford | 315/169.1 |
| 6,696,794 | B2 | 2/2004 | Ishizuka | |
| 6,720,736 | B2 | 4/2004 | Lee et al. | |
| 6,756,950 | B1 * | 6/2004 | Tsai et al. | 345/60 |
| 6,914,584 | B2 | 7/2005 | Homma et al. | |
| 6,980,170 | B2 | 12/2005 | Geen | |
| 2002/0003514 | A1 | 1/2002 | Liu et al. | |
| 2002/0050794 | A1 | 5/2002 | Ishizuka | |
| 2002/0063663 | A1 | 5/2002 | Homma | |
| 2003/0006945 | A1 | 1/2003 | Lim et al. | |
| 2004/0212557 | A1 | 10/2004 | Koo et al. | |
| 2005/0253781 | A1 | 11/2005 | Kim et al. | |
| 2006/0145997 | A1 | 7/2006 | Tachibana et al. | |
| 2007/0182668 | A1 | 8/2007 | Kang | |
| 2007/0222706 | A1 | 9/2007 | Tachibana et al. | |

FOREIGN PATENT DOCUMENTS

| | | |
|---|---|---|
| EP | 0680067 A2 | 11/1995 |
| EP | 1172794 A2 | 1/2002 |
| EP | 1 596 412 | 11/2005 |
| JP | 03-219528 | 9/1991 |
| JP | 08212930 | 8/1996 |
| JP | 10301529 | 11/1998 |

(Continued)

*Primary Examiner* — Nitin Patel
*Assistant Examiner* — Leonid Shapiro
(74) *Attorney, Agent, or Firm* — McKenna Long & Aldridge LLP

(57) ABSTRACT

The present invention relates to a method and apparatus for driving a plasma display panel that can be driven at a low voltage and prevent undesired discharge from being generated under high temperature environment.

19 Claims, 58 Drawing Sheets

FOREIGN PATENT DOCUMENTS

| | | | |
|---|---|---|---|
| JP | 10-333636 | | 12/1998 |
| JP | 11-085099 | | 3/1999 |
| JP | 11-143425 | | 5/1999 |
| JP | 2000122602 | A | 4/2000 |
| JP | 2002-214822 | | 8/2000 |
| JP | 2001-013910 | | 1/2001 |
| JP | 2001013911 | | 1/2001 |
| JP | 2001093424 | A | 4/2001 |
| JP | 2001-135238 | | 5/2001 |
| JP | 2001-184023 | | 7/2001 |
| JP | 2002-14650 | | 1/2002 |
| JP | 2002-072957 | | 3/2002 |
| JP | 2002082648 | | 3/2002 |
| JP | 2003-295817 | | 10/2003 |
| KR | 20010079354 | | 8/2001 |
| TW | 514855 | | 8/1990 |
| TW | 470990 | | 12/1999 |

* cited by examiner

METHOD AND APPARATUS FOR DRIVING PLASMA DISPLAY PANEL

This application is a divisional of U.S. patent application Ser. No. 10/428,828, filed May 5, 2003, now allowed now U.S. Pat. No. 7,286,102, and pending U.S. patent application Ser. No. 11/902,197, filed Sep. 19, 2007, which claims priority to Korean Patent Application Nos. 10-2002-24455; 10-2002-30606, 10-2003-20864, and 10-2003-20865, filed May 3, 2002, May 31, 2002, and Apr. 2, 2003 respectively, all of which are incorporated by reference for all purposed as of fully set forth herein.

BACKGROUND OF THE INVENTION

1. Field of the Invention

The present invention relates to a plasma display panel PDP, and more particularly to a method and apparatus for driving a plasma display panel that can be driven at a low voltage and which prevents undesired discharge under a high temperature environment. Further, the present invention relates to a method and apparatus for driving a plasma display panel that is adaptive for stabilizing address operation and sustain operation.

2. Description of the Related Art

A plasma display panel displays a picture by using ultraviolet rays to cause phosphorus to emit light, with the ultraviolet rays being generated when producing discharge in an inert mixed gas such as He+Xe, Ne+Xe, He+Xe+Ne. Such a PDP is not only easily made into a thin film and a large-scale unit, but also has improved picture quality owing to recent technology development.

Referring to FIG. 1, discharge cells of a three-electrode AC surface discharge PDP in the related art includes scan electrodes Y1 to Yn, sustain electrodes Z, and address electrodes X1 to Xm crossing the scan electrodes Y1 to Yn and the sustain electrodes Z.

Cells 1 are formed displaying any one of red, green and blue at each intersection of the scan electrodes Y1 to Yn, the sustain electrodes Z and the address electrodes X1 to Xm. The scan electrodes Y1 to Yn and the sustain electrodes Z are formed on an upper substrate (not shown), and a dielectric layer and a MgO passivation layer (not shown) are deposited on the upper substrate. The address electrodes X1 to Xm are formed on a lower substrate (not shown), with barrier ribs for preventing optical, electrical crosstalk being formed between horizontally adjacent cells on the lower substrate. Phosphorus is deposited on the surface of the barrier ribs and the lower substrate and the phosphorus is excited by vacuum ultraviolet rays to emit visible light. Inert mixed gas such as He+Xe, Ne+Xe, He+Xe+Ne is injected into a discharge space between the upper substrate and the lower substrate.

In order to realize the gray levels of a picture, the PDP is driven on a time-division basis where one frame is divided into several sub-fields, each of which has a different light-emission weight. Each sub-field is divided again into an initialization period (reset period) for initializing a full screen, an address period for selecting scan lines and cells in the scan lines, and a sustain period for realizing gray levels in accordance with the number of discharge. For instance, when a picture with 256 gray levels is to be displayed, a frame period (16.67 ms) corresponding to 1/60 second is divided into eight sub-fields SF1 to SF8 as shown in FIG. 2. Each of the eight sub-fields SF1 to SF8 is divided into the initialization period, the address period and the sustain period, as described above. The initialization period and the address period of each sub-field are the same for each sub-field, while the sustain period increases at the rate of $2^n$ (n=0, 1, 2, 3, 4, 5, 6, 7) in each sub-field.

FIG. 3 illustrates a driving waveform of a PDP, which is applied to two sub-fields.

Referring to FIG. 3, the PDP is driven by being divided into an initialization period to initialize a full screen, an address period to select cells and a sustain period to sustain discharges of the selected cells.

In the initialization period, rising ramp waveforms, Ramp-up, are simultaneously applied to all scan electrodes Y for a setup period SU. At the same time, 0V is applied to the sustain electrodes Z and the address electrodes X. Each rising ramp waveform, Ramp-up, causes a dark discharge to occur between the scan electrodes Y and the address electrodes X, and between the scan electrodes Y and the sustain electrodes Z within the cells of the full screen, with occurrence of the dark discharge generating almost no light. The setup discharge causes positive (+) wall charges to be accumulated on the address electrodes X and the sustain electrodes Z, and negative (−) wall charges to be accumulated on the scan electrodes Y. Herein, the amount of the negative (−) wall charges accumulated on the scan electrodes Y is the same as the total amount of the positive (+) wall charges accumulated on the address electrodes X and the sustain electrodes Z.

Each falling ramp waveform, Ramp-dn, is simultaneously applied to each scan electrode Y for a set-down period SD after application of each rising ramp waveform, Ramp-up. Herein, the falling ramp waveform, Ramp-dn, begins to fall from a positive voltage lower than a peak voltage of each rising ramp waveform, Ramp-up, to a ground voltage GND or a specific negative voltage level. At the same time, each sustain electrode Z is supplied with a positive sustain voltage Vs, and each address electrode X is supplied with 0V. When the falling ramp waveform, Ramp-dn, is applied, the dark discharge occurs between the scan electrode Y and the sustain electrode Z. Further, between the scan electrode Y and the address electrode Z, no discharge occurs while the falling ramp waveform, Ramp-dn, drops, but the dark discharge occurs at the lower limit of the falling ramp waveform, Ramp-dn. The discharge occurring for such a set-down period SD serves to eliminate excessive wall charges unnecessary for the address discharge out of the wall charges generated for the setup period SU. When observing the change of wall charges in the setup period SU and the set-down period SD, there is almost no change in the wall charges of the address electrode X and there is a decrease in the negative (−) wall charges of the scan electrode Y. On the other hand, the polarity of the wall charges of the sustain electrode Z is positive during the setup period, but is inverted to negative during the set-down period SD because the negative wall charges are accumulated on the sustain electrode Z as much as the negative wall charges of the scan electrode Y are decreased.

In the address period, negative scan pulses SCAN are sequentially applied to the scan electrodes Y and, at the same time, positive data pulses DATA synchronized with the scan pulses SCAN are applied to the address electrodes X. The wall voltage generated during the initialization period is added to the voltage difference between the scan pulses SCAN and the data pulses DATA, so as to generate address discharges within the cells to which the data pulses DATA are applied. Wall charges are formed with as much discharge as can be generated when the sustain voltages Vs are applied to the cells selected by the address discharges.

A positive DC voltage Zdc is applied to each sustain electrode Z for the set-down period and the address period, so as to reduce the voltage difference between the scan electrode Y and the sustain electrode Z, thereby preventing undesired discharge from occurring.

In the sustain period, sustain pulses SUS are alternately applied to the scan electrodes Y and the sustain electrodes Z. In the cells selected by the address discharges, sustain discharges, i.e., display discharges, occur between the scan electrodes Y and the sustain electrodes Z whenever each sustain pulse SUS is applied as the wall voltage within the cell is added to the sustain pulse SUS.

After the completion of the sustain discharge, a ramp waveform, RAMP-ERS, with narrow pulse width and low voltage level is applied to the sustain electrode Z, thereby erasing the wall charges remaining behind within the cells of the full screen.

In the related art PDP, It is not possible to prevent the voltage level of the voltages Vd, Vscan applied from the outside upon the address discharge from increasing because of the small amount of remaining wall charges on the scan electrode Y after being decreased by the discharge during the set-down period SD. Further, in the related art PDP, increase in the voltage of the sustain pulse SUS, i.e., the sustain voltage Vs, applied from the outside during the sustain period also cannot be avoided because of the small amount of wall charges accumulated on the sustain electrode Z upon the discharge during the set-down period SD. Furthermore, the related art PDP has a problem in that undesired discharges frequently occur upon the address discharge because the wall charges within the cells are decreased and their operational conditions are changed in the high temperature environment.

Further, the related art PDP has a problem in that the address operation and the sustain operation is unstable because the undesired discharge may be generated in accordance with the initial state of the off cell upon the address discharge or the sustain discharge.

SUMMARY OF THE INVENTION

Accordingly, it is an object of the present invention to provide a method and apparatus for driving a plasma display panel that can be driven at a low voltage and which prevent undesired discharge under a high temperature environment.

It is another object of the present invention to provide a method and apparatus for driving a plasma display panel that is adaptive for stabilizing address operation and sustain operation.

In order to achieve these and other objects of the invention, a method for driving a plasma display panel according to an aspect of the present invention includes a first step of applying an initialization signal to the first and second electrodes to initialize cells, the initialization signal has at least one rising part where a voltage rises and at least one sustain part where the voltage is sustained; a second step of applying a scan signal to any one of the first and second electrodes, and data to the third electrode to select the cell; and a third step of alternately applying sustain signals to the first and second electrodes to carry out a display for the selected cell.

The method further includes a fourth step of erasing charge within the cell.

In the method, a last sustain signal among the sustain signals is applied to a sustain electrode to which the scan signal is not applied between the first and second electrodes.

The fourth step is to apply a pre-erase signal to any one of the first and second electrodes between the second step and the third step to eliminate the charge remaining within off-cells excluding the cell selected at the second step.

In the method, a voltage of any one of the first and second electrodes is decreased gradually between the second step and the third step.

The fourth step is to apply a post-erase signal for eliminating a charge within the cell, to at least any one of the first and second electrodes subsequently to the third step.

In the method, the initialization signal is a ramp waveform, the voltage level of which increases with a rising slope.

In the method, the initialization signal rises in a curve.

In the method, the initialization signal rises in a sinusoid.

In the method, the pre-erase signal is a ramp waveform, the voltage level of which increases with a rising slope.

In the method, the plasma display panel is driven on the basis of time-division, dividing one frame period into a selective writing sub-field to select an on-cell and a selective erasing sub-field to select an off-cell; and the initialization signal is allocated in the selective writing sub-field.

A method for driving a plasma display panel according to another aspect of the present invention includes a first step of selecting an on-cell among the cells; a second step of applying a pre-erase signal to the first and second electrodes to eliminate a charge remaining within an off-cell except for the on-cell; and a third step of alternately applying sustain signals to the first and second electrodes to display a picture.

In the method, the pre-erase signal has a voltage level that is changed linearly.

In the method, the pre-erase signal has a voltage level that is changed step by step.

In the method, the pre-erase signal has a voltage level with a falling slope for the voltage to decrease.

In the method, the pre-erase signal decreases down to a negative voltage.

The method further includes a fourth step of applying a post-erase signal to at least any one of the first and second electrodes subsequently to the third step to eliminate a charge remaining within on-cells.

In the method, a last sustain signal among the sustain signals is applied to an electrode to which a scan signal is not applied between the first and second electrodes.

A method for driving a plasma display panel according to still another aspect of the present invention includes a first step of forming a charge on the first and second electrodes symmetrically; a second step of selecting the cell in use of the charge symmetrically formed on the first and second electrodes; and a third step of alternately applying sustain signals to the first and second electrodes to carry out a display for the selected cell.

In the first step, a positive wall charge is uniformly formed on each of the first and second electrodes.

In the first step, an identical waveform is simultaneously applied to each of the first and second electrodes to symmetrically form the charge on the first and second electrode.

In the method, the waveform includes at least one rising part where a voltage rises and at least one sustain part where the voltage is sustained.

In the method, the waveform includes a setup waveform having a voltage which rises; and a set-down wave form having a voltage which falls.

A method for driving a plasma display panel according to still another aspect of the present invention includes a first step of applying a first initialization signal having a voltage which rises, to the first and second electrodes and applying a second initialization signal having a voltage which falls, to at least any one of the first and second electrodes to initialize cells; a second step of applying a scan signal to any one of the first and second electrodes, and data to the third electrode to select the cell; and a third step of alternately applying sustain signals to the first and second electrodes to carry out a display for the selected cell.

The method further includes a fourth step of erasing charge within the cell.

In the method, a last sustain signal among the sustain signals is applied to an electrode to which the scan signal is not applied between the first and second electrodes.

The method further includes the fourth step is to apply a pre-erase signal to any one of the first and second electrodes between the second step and the third step to eliminate the charge remaining within off-cells excluding the cell selected at the second step.

The method further includes the fourth step is to apply a post-erase signal for eliminating a charge within the cell, to at least any one of the first and second electrodes subsequently to the third step.

In the method, at least any one of the first and second initialization signals is a ramp waveform, the voltage level of which increases with a rising slope.

In the method, at least any one of the first and second initialization signals is a curved waveform.

In the method, at least any one of the first and second initialization signals is a sinusoid.

In the method, the second initialization signal is applied to the first and second electrodes subsequently to the first initialization signal.

In the method, the first and second initialization signals have different start voltages.

In the method, the second initialization signal applied to the second electrode is different from the second initialization signal applied to the first electrode in any one of slope, start voltage and end voltage.

In the method, the slope of the second initialization signal applied to the second electrode is lower than that of the second initialization signal applied to the first electrode.

In the method, the start voltage of the second initialization signal applied to the second electrode is higher than that of the second initialization signal applied to the first electrode.

In the method, the end voltage of the second initialization signal applied to the second electrode is higher than that of the second initialization signal applied to the first electrode.

In the method, the first initialization signal applied to the second electrode is different from the first initialization signal applied to the first electrode in any one of slope, start voltage and end voltage.

In the method, the second initialization signal is applied only to the first electrode.

In the method, the third electrode is supplied with a positive DC voltage while the second initialization signal is applied to at least any one of the first and second electrodes.

The method further includes a sixth step of applying a positive DC voltage to the third electrode while the sustain signals are applied to the first and second electrodes.

In the method, the third electrode is supplied with a positive DC voltage while the post-erase signal is applied to at least any one of the first and second electrodes.

In the method, the plasma display panel is driven on the basis of time-division, dividing one frame period into a selective writing sub-field to select an on-cell and a selective erasing sub-field to select an off-cell; and the first and second initialization signals are allocated in the selective writing sub-field.

A driving apparatus for a plasma display panel according to still another aspect of the present invention includes a first driver applying an initialization signal to the first electrode, the initialization signal has at least one rising part where a voltage rises and at least one sustain part where the voltage is sustained; a second driver applying the initialization signal to the second electrode; and a third driver applying data to the third electrode, and wherein the first and second drivers alternately apply sustain signals to the first and second electrodes to carry out a display for the selected cell.

The a sustain signal among the sustain signals is applied to an electrode to which a scan signal is not applied between the first and second electrodes.

Herein, any one of the first and second drivers applies a waveform, having a voltage which falls, to at least one of the first and second electrodes between an address period for which a cell is selected and a sustain period for which a display is carried out.

Herein, any one of the first and second drivers applies a pre-erase signal to any one of the first and second electrodes between the address period and the sustain period to eliminate a charge remaining within off-cells except for the selected cell.

Herein, the first and second drivers apply a post-erase signal to any one of the first and second electrodes after the sustain period to eliminate a charge within the cell.

Herein, the initialization signal is a ramp waveform, the voltage level of which increases with a rising slope.

Herein, the initialization signal rises in a curve.

Herein, the initialization signal rises in a sinusoid.

Herein, the pre-erase signal is a ramp waveform having a voltage level which increases with a rising slope.

Herein, the plasma display panel is driven on the basis of time-division, dividing one frame period into a selective writing sub-field to select an on-cell and a selective erasing sub-field to select an off-cell; and the initialization signal is allocated in the selective writing sub-field.

A driving apparatus for a plasma display panel according to still another aspect of the present invention includes a first driver selecting an on-cell from the cells; a second driver applying a pre-erase signal to the first and second electrodes to eliminate a charge remaining within off-cells except for the on-cell; and a third driver alternately applying sustain signals to the first and second electrodes to display a picture.

Herein, the pre-erase signal has a voltage level that is changed linearly.

Herein, the pre-erase signal has a voltage level that is changed step by step.

Herein, the first driver applies a scan pulse falling from a reference bias voltage to any one of the first and second electrodes, and applies data synchronized with the scan pulse to the third electrode.

Herein, the pre-erase signal falls from the reference bias voltage to a voltage that is between 0V and the scan voltage.

Herein, the pre-erase signal falls down to a voltage lower than a voltage of the scan pulse.

The driving apparatus further includes a fourth driver applying an initialization signal, having a voltage which rises, to any one of the first and second electrodes before the cell is selected, so as to initialize cells of a full screen.

Herein, the initialization signal is simultaneously applied to the first and second electrodes.

The driving apparatus further includes a fifth driver applying a post-erase signal for eliminating a charge remaining within the on-cells, to at least any one of the first and second electrodes after displaying the picture.

A driving apparatus for a plasma display panel according to still another aspect of the present invention includes a first driver applying a first initialization signal, having a voltage which rises, to the first and second electrodes, a second driver applying a scan signal to any one of the first and second electrodes, and data to the third electrode to select a cell; and a third driver alternately applying sustain signals to the first and second electrodes to carry out a display with respect to the selected cell.

Herein, the third driver applies a last sustain signal among the sustain signals to an electrode to which the scan signal is not applied between the first and second electrodes.

The driving apparatus further includes a fourth driver applying a pre-erase signal to any one of the first and second electrodes to eliminate a charge remaining within off-cells excluding the selected cell.

The driving apparatus further includes a fifth driver applying a post-erase signal for eliminating a charge within the cell, to at least any one of the first and second electrodes subsequently to the sustain signal.

Herein, at least any one of the first and second initialization signals is a ramp waveform, the voltage level of which increases with a rising slope.

Herein, at least any one of the first and second initialization signals is a curved waveform.

Herein, at least any one of the first and second initialization signals is a sinusoid.

Herein, the second initialization signal is applied to the first and second electrodes subsequently to the first initialization signal.

Herein, the first and second initialization signals have different start voltages.

Herein, the second initialization signal applied to the second electrode is different from the second initialization signal applied to the first electrode in any one of slope, start voltage and end voltage.

Herein, the slope of the second initialization signal applied to the second electrode is lower than that of the second initialization signal applied to the first electrode.

Herein, the start voltage of the second initialization signal applied to the second electrode is higher than that of the second initialization signal applied to the first electrode.

Herein, the end voltage of the second initialization signal applied to the second electrode is higher than that of the second initialization signal applied to the first electrode.

Herein, the first initialization signal applied to the second electrode is different from the first initialization signal applied to the first electrode in any one of slope, start voltage and end voltage.

Herein, the second initialization signal is applied only to the first electrode.

The driving apparatus further includes a sixth driver applying a positive DC voltage to the third electrode while the second initialization signal is applied to at least any one of the first and second electrodes.

The driving apparatus further includes a seventh driver applying a positive DC voltage to the third electrode while the sustain signal is applied to the first and second electrodes.

The driving apparatus further includes an eighth driver applying a positive DC voltage to the third electrode while the post-erase signal is applied to at least any one of the first and second electrodes.

Herein, the plasma display panel is driven on the basis of time-division, dividing one frame period into a selective writing sub-field to select an on-cell and a selective erasing sub-field to select an off-cell; and the first and second initialization signals are allocated in the selective writing sub-field.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

With reference to FIGS. 4 to 37, embodiments of the present invention will be explained as follows.

Figure 4:
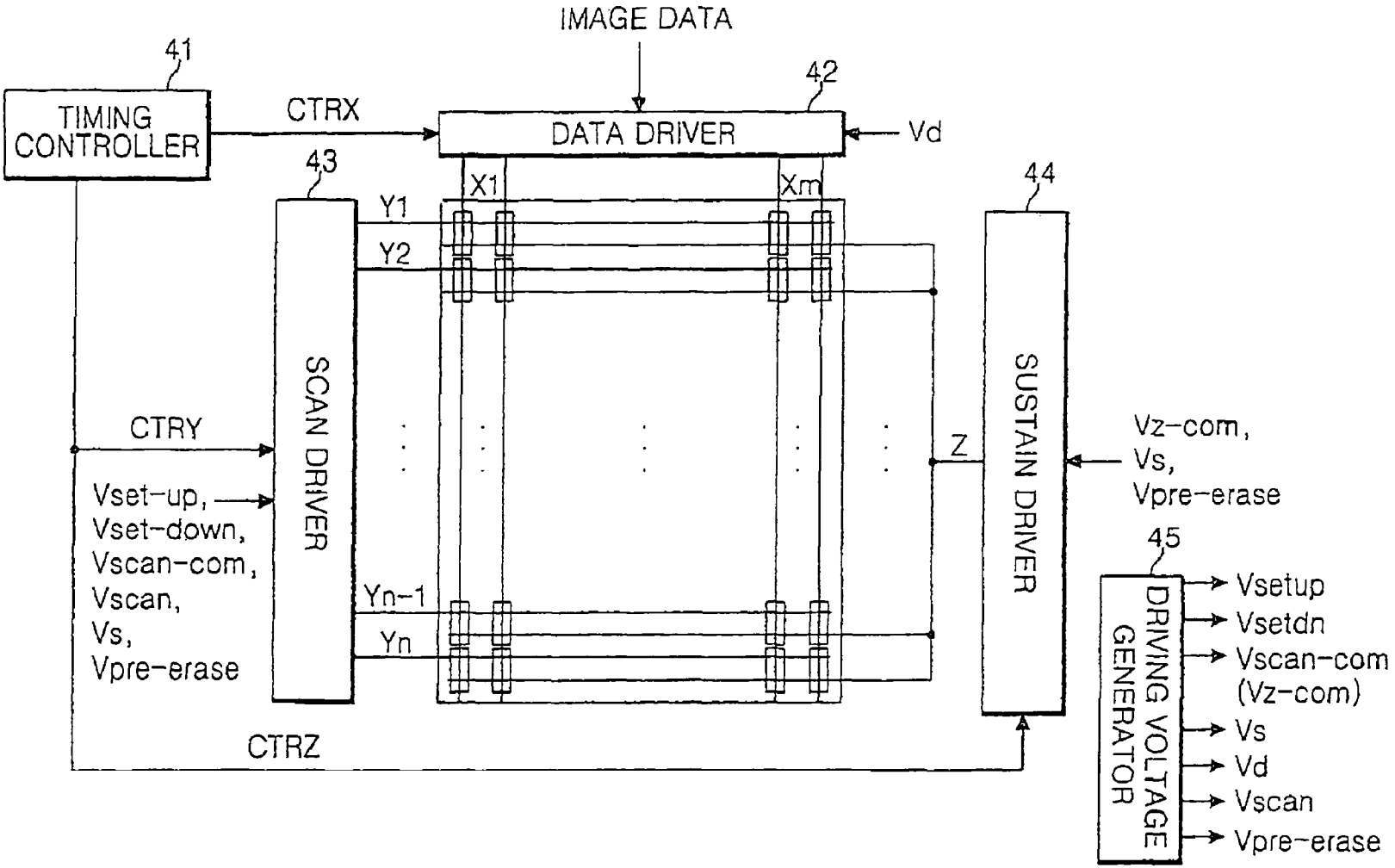
FIG. 4 is a block diagram briefly representing a driving apparatus for a plasma display panel according to an embodiment of the present invention.

Referring to FIG. 4, the driving apparatus of a PDP according to an embodiment of the present invention includes a data driver 42 applying data to address electrodes X1 to Xm, a scan driver 43 driving scan electrodes Y1 to Yn, a sustain driver 44 driving sustain electrodes Z that are a common electrode, a timing controller 41 controlling each of the drivers 42, 43 and 44, and a driving voltage generator 45 supplying a driving voltage to each of the drivers 42, 43 and 44.

The data driver 42 is supplied with data that are mapped to each sub-field by a sub-field mapping unit after conversely gamma-corrected and error-diffused by a reverse gamma correction circuit and error diffusion circuit (not shown), respectively. The data driver 42 takes samples of and latches the data in response to timing control signals CTRX, and then the address electrodes X1 to Xm are supplied with the data.

On the other hand, the data driver 42 can apply positive data voltages Vd or another positive data voltages to the address electrodes X1 to Xm during a sustain period or, during the sustain period and the period when a pre-erase signal is generated from the scan driver 43 and the sustain driver 44.

The scan driver 43 simultaneously applies initialization waveforms to the scan electrodes Y1 to Yn under control of the timing controller 41, wherein the initialization waveforms are for initializing a full screen. Then, the scan driver 43 sequentially applies scan pulses to the scan electrodes Y1 to Yn during an address period in order to select scan lines. Further, the scan driver 43, after completion of the address period, simultaneously applies the pre-erase signals to the scan electrodes Y1 to Yn for eliminating unnecessary wall charges that remain behind within off-cells where address discharge is not generated. The scan driver 43 then simultaneously applies sustain pulses to the scan electrodes Y1 to Yn, with the sustain pulses causing sustain discharge, i.e., display discharge, to be generated in on-cells for the sustain period. The scan driver 43 simultaneously applies post-erase signals to the scan electrodes Y1 to Yn for eliminating the wall charges within the on-cells, which are generated by the sustain discharge, after completion of the sustain period.

The sustain driver 44 works simultaneously with the scan driver 43 under control of the timing controller 41 and simultaneously applies the initialization waveform for initializing the full screen to the sustain electrodes Z, and then applies the pre-erase signals to the sustain electrodes Z. The pre-erase signals are used to eliminate the unnecessary wall charges remaining within the off-cells, after completion of the address period. The sustain driver 44 and the scan driver 43 operate in turn for the sustain period to supply sustain pulses to the sustain electrodes Z.

The timing controller 41 receives vertical/horizontal synchronization signals, generates timing control signals CTRX, CTRY and CTRZ necessary for each driver, and applies the timing control signals CTRX, CTRY and CTRZ to the corresponding drivers 42, 43 and 44 for control thereof. The timing control signals CTRX, applied to the data driver 42 include sampling clock for sampling data, latch control signals, and switch control signals that control the on/off time of an energy recovery circuit and a driving switch device. The timing control signals CTRY applied to the scan driver 43 from the timing controller 41 include switch control signals that control the on/off time of the energy recovery circuit and the driving switch device within the scan driver 43. The timing control signals CTRZ applied to the sustain driver 44 from the timing controller 41 include switch control signals that control the on/off time of the energy recovery circuit and the driving switch device within the sustain driver 44.

The driving voltage generator 45 generates positive setup voltages Vsetup, positive bias voltages Vscan-com, Vz-com applied as a common voltage for the address period, negative scan voltages Vscan for selecting scan lines, and positive sustain voltages Vs and pre-erase voltages Vpre-erase; the driving voltage generator 45 applies the generated voltages to the scan driver 43. In the event that setup waveforms and set-down waveforms are continuously generated from the scan driver 43, the driving voltage generator 45 applies to the scan driver 43 set-down voltages, Vset-dn, that are selected as any one of 0V, a ground voltage GND and a negative voltage. Setup voltages Vsetup are set to be higher than the sustain voltage Vs. Scan bias voltages Vscan-com are normally selected within a range of substantially 80~130V, and the scan voltages Vscan are normally selected within a range of −70~−180V. The sustain voltages Vs are selected within a range of 180~200V. The pre-erase voltages Vpre-erase are applied to the scan driver 43 and the sustain driver 44 when pre-erase signals are separately applied between the address period and the sustain period. The pre-erase voltages Vpre-erase vary in accordance with the level of voltages applied to the address electrodes X1 to Xm while the pre-erase signals are applied. This is because pre-erase discharges are generated when potential differences between the scan electrodes Y1 to Yn or the sustain electrodes Z supplied with the pre-erase voltages Vpre-erase and the address electrodes X1 to Xm opposite thereto are higher than a firing voltage that can cause a discharge. Accordingly, the pre-erase voltage Vpre-erase has a lower voltage level as a voltage applied to the address electrodes X1 to Xm while the pre-erase signal being applied is positive and the level of the voltage gets higher, but the pre-erase voltage is selected between 0V and the set-down voltage, Vset-dn, in consideration of the voltages applied to the address electrodes X1 to Xm.

Further, the driving voltage generator 45 generates positive data voltages Vd, applies the generated data voltages Vd to the data driver 42, and applies to the sustain driver 44 the bias voltages Vz-com set to be identical to the scan bias voltages Vscan-com. The data voltages Vd are selected between 50~80V. Such voltage conditions may vary in accordance with the composition of discharge gas or the structure of discharge cells.

On the other hand, the initial waveform generated simultaneously in each of the scan driver 43 and the sustain driver 44 may consist of a waveform where the voltage increases little by little or step by step, and a waveform where the voltage decreases little by little or step by step over time. Further, the initial waveform generated simultaneously in each of the scan driver 43 and the sustain driver 44 may only consist of a waveform where the voltage increases little by little or step by step overtime. Herein, it is desirable that the initialization waveform only includes the waveform where the voltage increases. If all cells are initialized only with the waveform in which the voltage increases in such a way, a sufficient negative wall charge is accumulated on the scan electrodes Y1 to Yn and the sustain electrodes Z that are formed within all cells, allowing their driving voltages to be commensurately reduced. In other words, if all cells are initialized only with the waveform where the voltage increases in such a way, a sufficient negative wall charge is formed on the scan electrodes Y to reduce the external driving voltages Vscan, Vd required for addressing, and the negative wall charges formed on the scan electrodes Y and the sustain electrodes Z are sustained until the address period ends, such that a low voltage is required for a sustain discharge. Further, if all cells are initialized only with the waveforms where the voltages increase, the initialization period is shortened.

Figure 5:
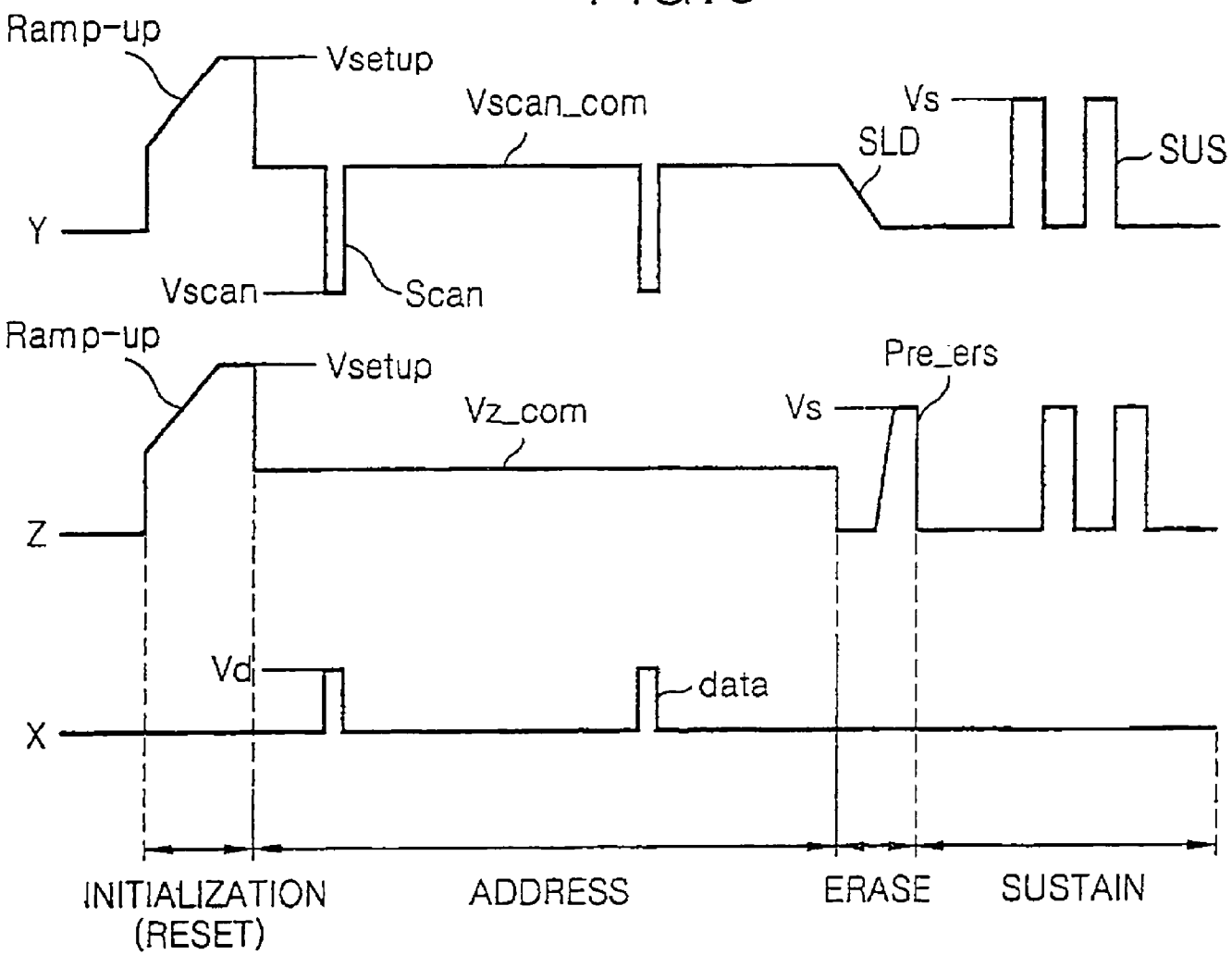
FIG. 5 is a waveform diagram for explaining a driving method of a PDP according to the first embodiment of the present invention.
Figure 6:
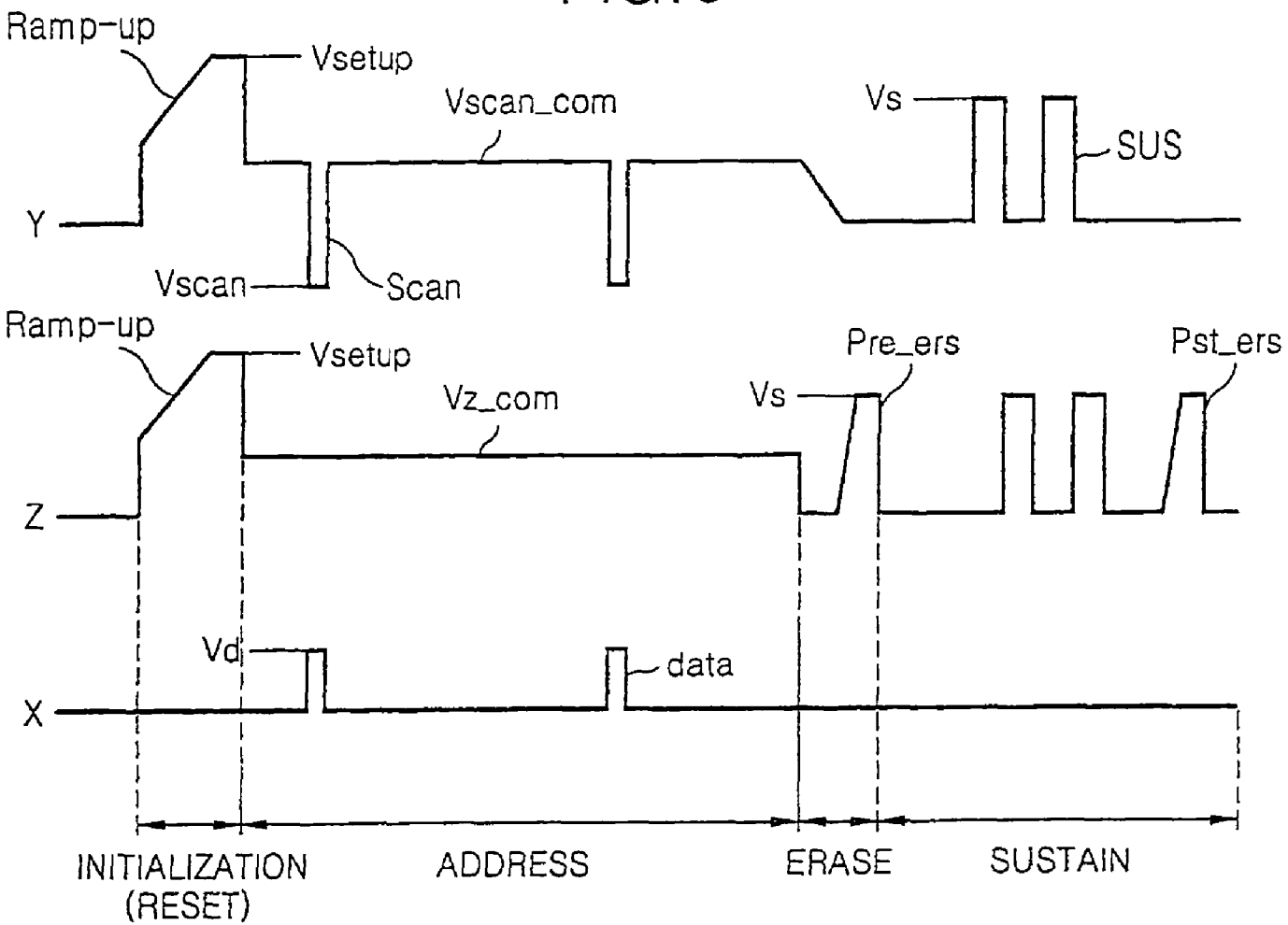
FIG. 6 is a waveform diagram representing a waveform where a post-erasure signal is added to the waveforms of FIG. 5.
Figure 7:
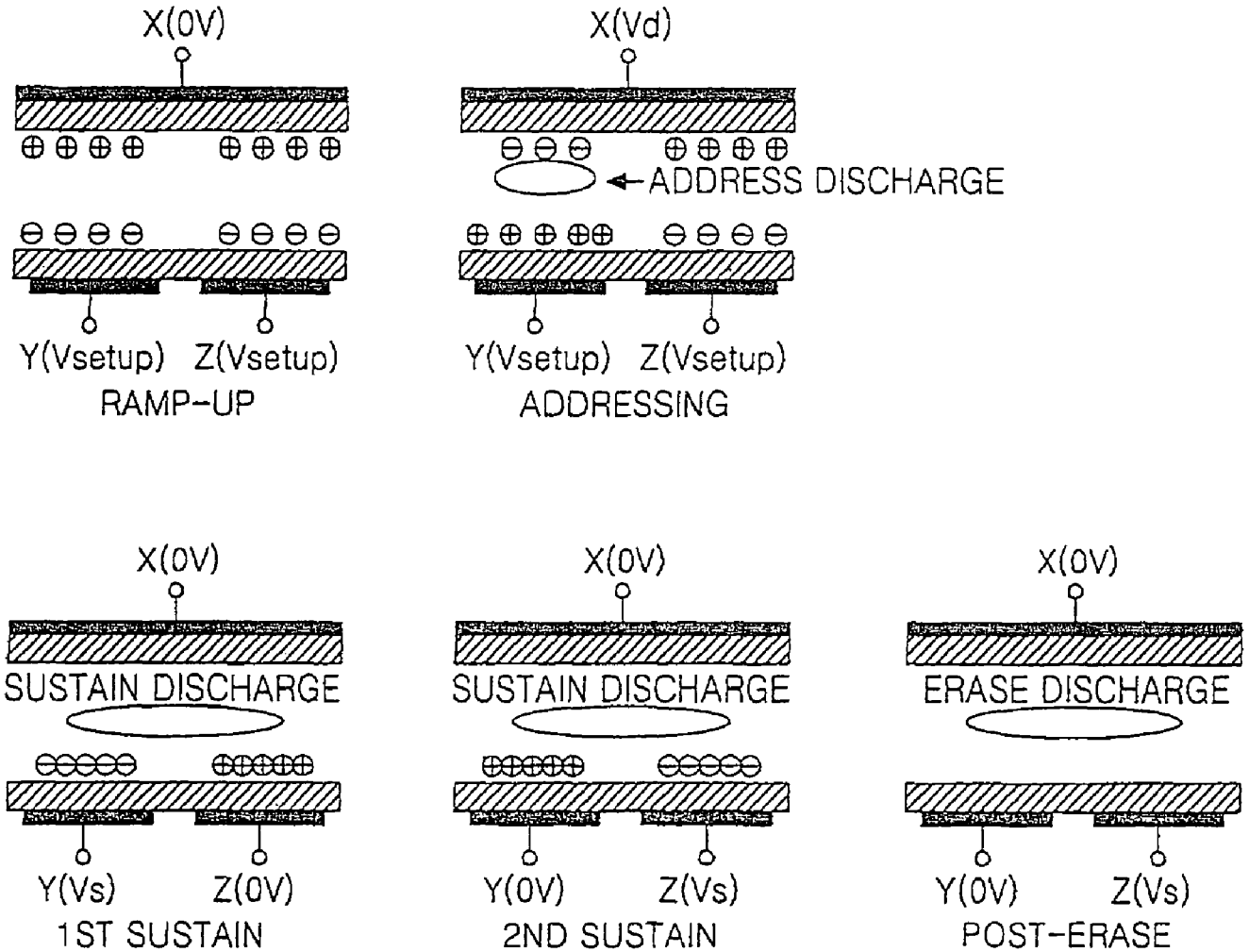
FIG. 7 illustrates a change of wall charge distribution with the lapse of time with in an on-cell in the event of the application of the waveform diagram of FIG. 6.
Figure 8A:
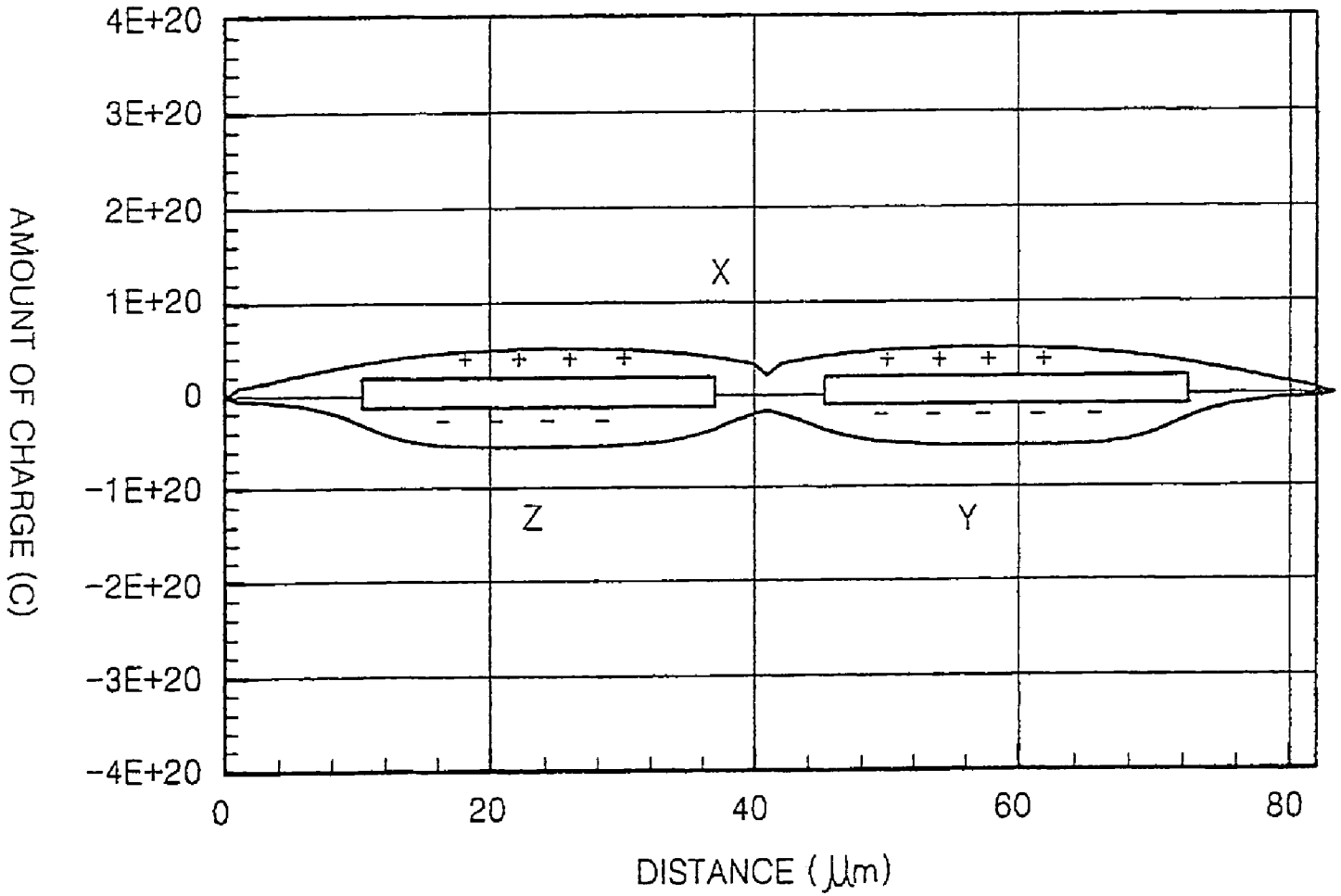
FIGS. 8A to 8D are simulation results particularly representing a change of wall charge distribution for an initialization period.
Figure 8B:
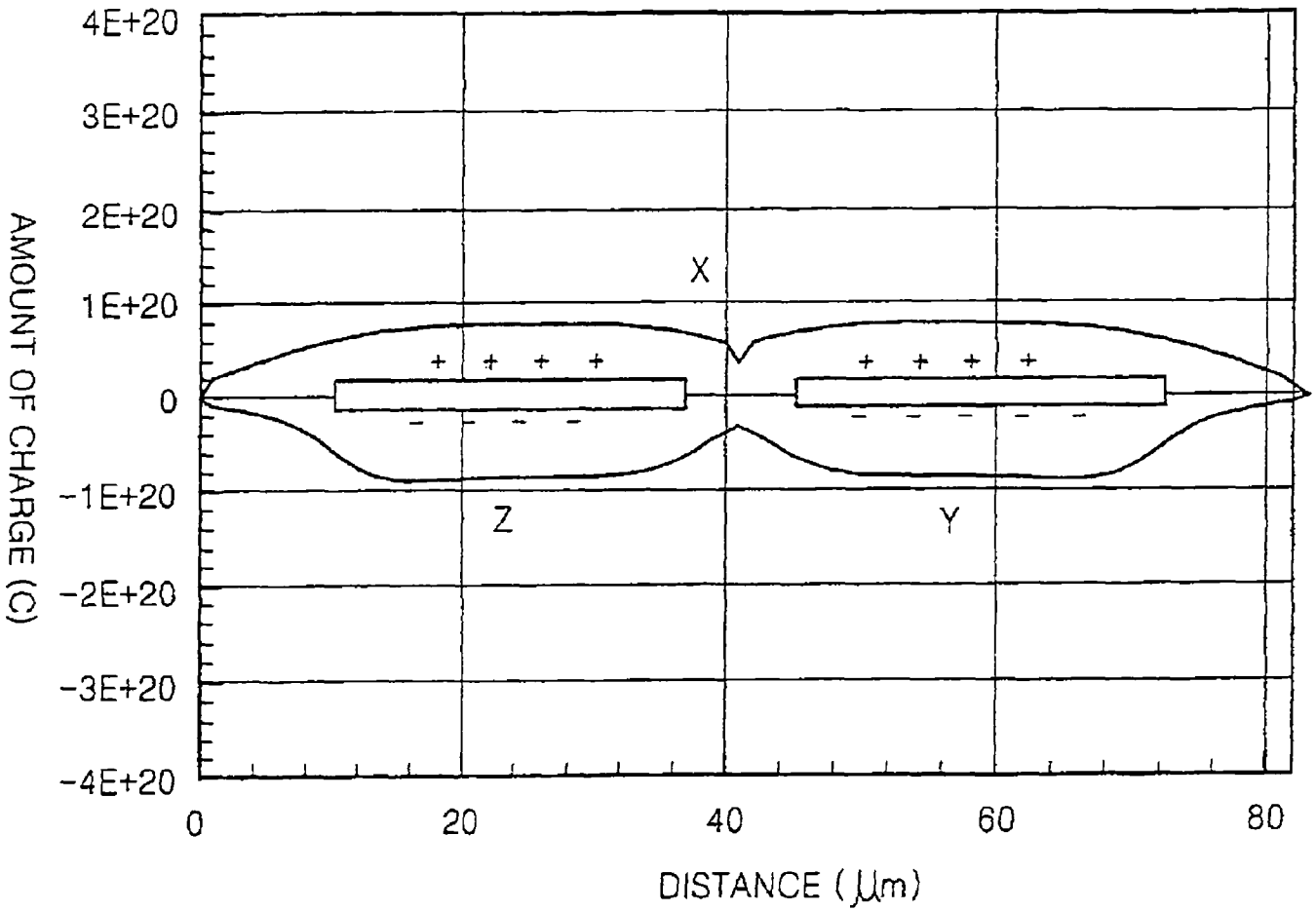
Figure 8C:
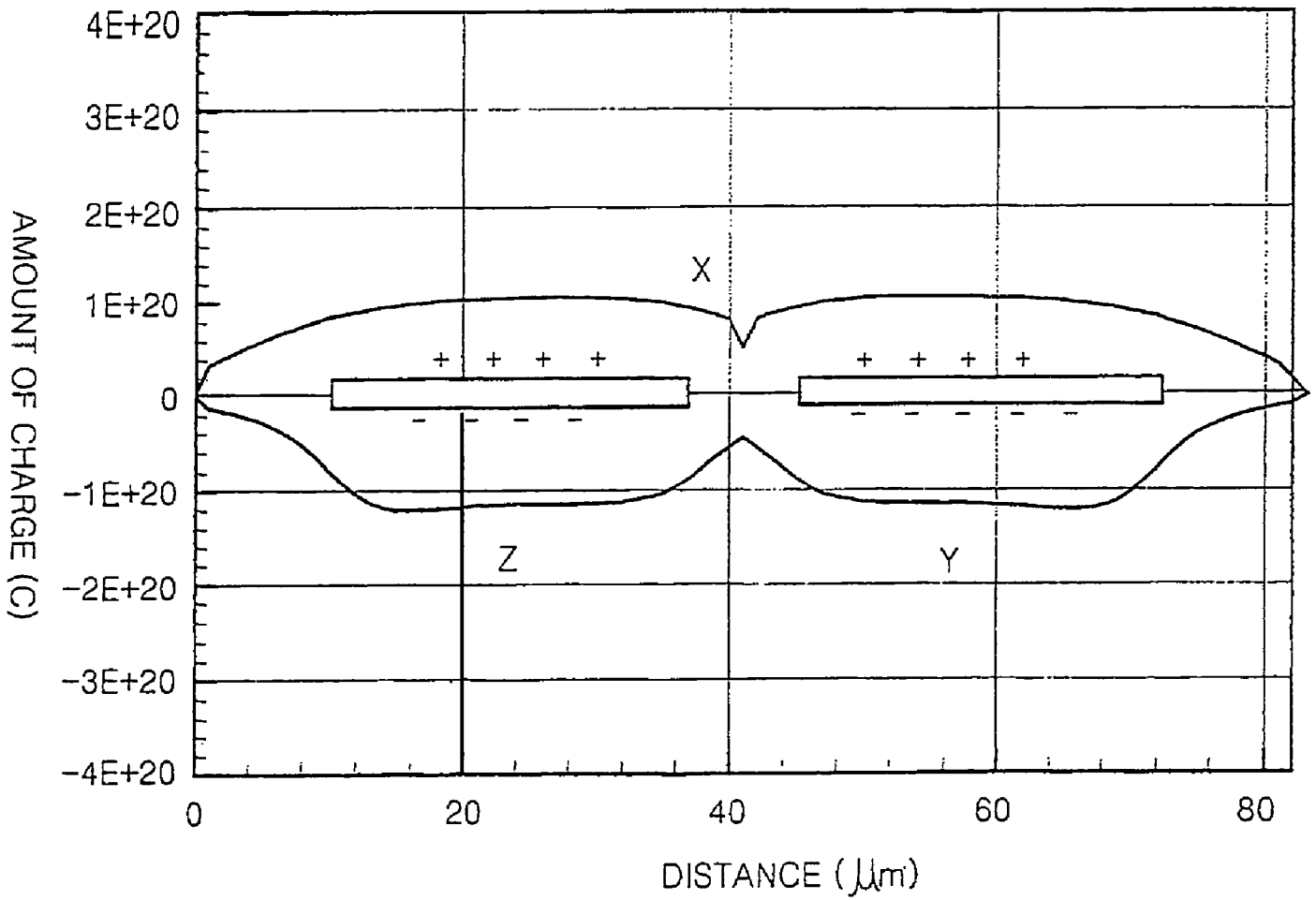
Figure 8D:
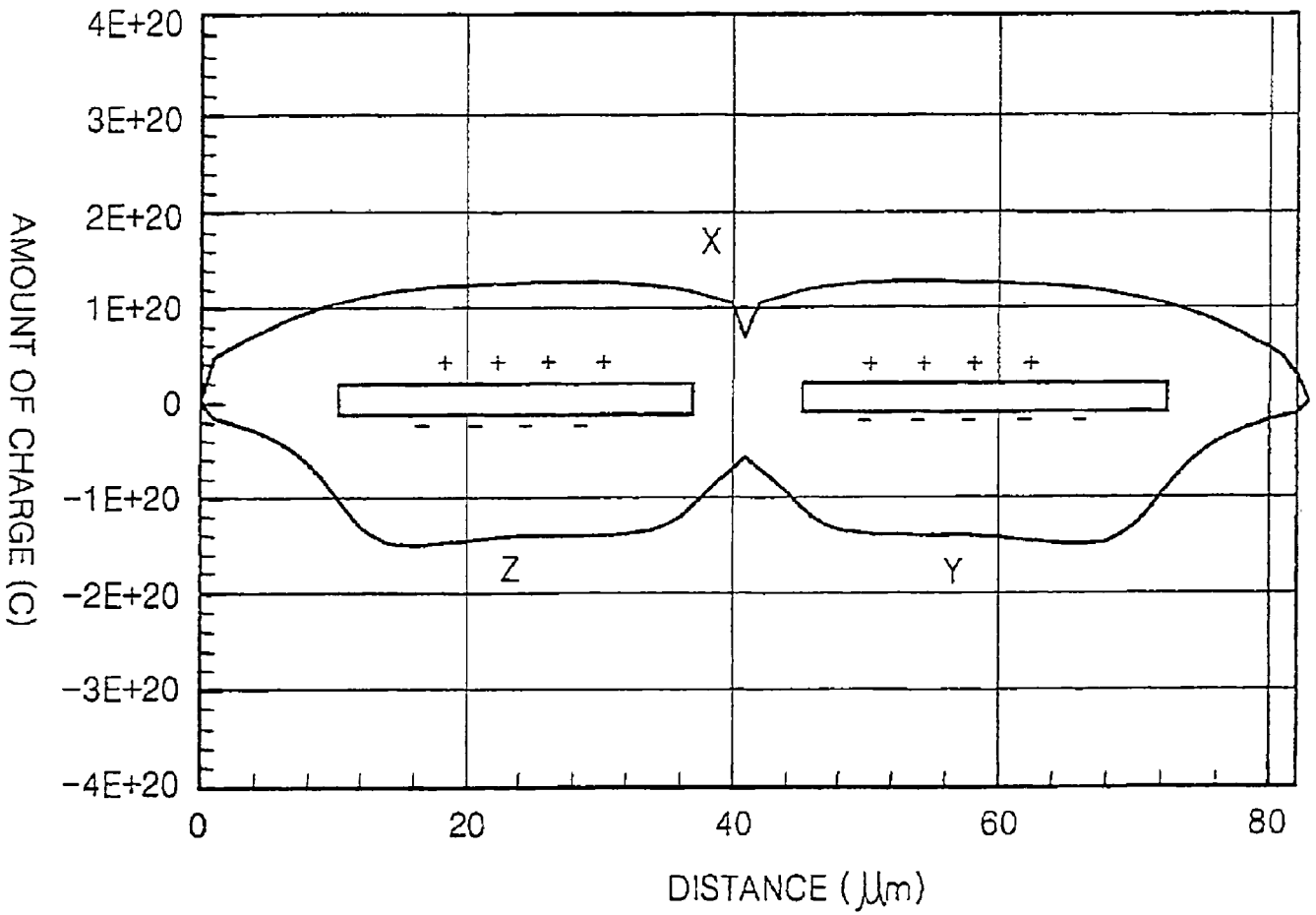

FIGS. 5 and 6 are waveform diagrams explaining a method for driving a PDP according to the first embodiment of the present invention. FIG. 7 illustrates a change of wall charge distribution with the lapse of time within an on-cell in the event of the application of the waveform diagram of FIG. 6. FIGS. 8A to 8D are simulation results particularly representing a change of wall charge distribution for an initialization period. In FIGS. 8A to 8D, the axis of ordinates represents the amount of charge (C), and the horizontal axis represents distance (μm).

Referring to FIG. 5 to 8, in the driving method for the PDP according to the first embodiment of the present invention, one frame period is time-divided into a plurality of sub-fields to drive the PDP. Each sub-field includes an initialization period for which only rising ramp waveforms are applied to the scan electrodes Y and the sustain electrodes Z to initialize the cells of a full screen, an address period for which cells are selected, a pre-erase period for which wall charges unnecessary for sustaining are eliminated, and a sustain period through which discharges of the selected cells are sustained.

In the initialization period (reset period), all the scan electrodes Y and sustain electrodes Z are simultaneously supplied with the rising ramp waveforms, Ramp-up. The rising ramp waveforms, Ramp-up, include a rising part where a voltage is substantially rising from the sustain voltage Vs to the setup voltage Vsetup and a sustaining part where the voltage is sustained for a specific period. The address electrodes X are supplied with 0 V or a ground voltage GND while applying the rising ramp waveform, Ramp-up. By simultaneously applying the rising ramp waveforms to the scan electrodes Y and the sustain electrodes Z like this, dark discharges occur within the cells of the full screen, with the dark discharges generating almost no light. As a result, as shown in FIGS. 7 and 8, the negative (−) wall charges are accumulated in each of the scan electrode Y and the sustain electrode Z, and the positive (+) wall charges are accumulated on the address electrode X. The amount of charge and the distribution characteristic of wall charges on the scan electrode Y and the sustain electrode Z, as shown in FIG. 8, increase symmetrically. Because the same voltage is simultaneously applied to the scan electrode Y and the sustain electrode Z, a potential difference between the scan electrode Y and the address electrode X and a potential difference between the sustain electrode Z and the address electrode X are the same as an opposite firing voltage between the scan electrode Y and the address electrode X, which is required for the address discharge. As can be seen in FIGS. 7 and 8, there is no potential difference between the scan electrode Y and the sustain electrode Z. The same amount of wall charge is in each of the scan electrode Y and the sustain electrode Z as a result of the discharge caused by the rising ramp waveform, Ramp-up, even though the previous condition of the initialization period, i.e., initial condition, is different.

On the other hand, before the address discharge starts, there is no potential difference between the scan electrode Y and the sustain electrode Z and the value of the wall charge formed in each of two electrodes is sustained the same; thus there occurs no undesired discharge, which is generated by a wall charge change under a high temperature environment before the start of the address discharge, even though the PDP is used under a high temperature environment of 50° C. and above.

The address period starts when the positive scan bias voltages Vscan-com are simultaneously applied to the scan electrodes Y, and the sustain electrodes Z are simultaneously supplied with the bias voltages Vz-com, which are substantially the same as the scan bias voltage Vscan-com. Because the same voltages Vscan-com, Vz-scan are simultaneously applied to the scan electrode Y and the sustain electrode Z, there is no potential difference between the scan electrode Y and the sustain electrode Z. Subsequently, scan pulses SCAN falling down to the negative scan voltage Vscan are sequentially applied to the scan electrodes Y and, at the same time, data pulses DATA synchronized with the scan pulse SCAN and rising up to the positive data voltage Vd are applied to the address electrodes X. The voltage difference between the scan pulse SCAN and the data pulse DATA is added to the wall voltage generated during the initialization period to generate the address discharge within an on-cell to which the data pulse DATA is applied. Wall charges are formed within the selected on-cells by the address discharge, so as to be able to generate discharges when the sustain voltage Vs is applied.

A voltage in the scan electrode Y gradually falls down to 0V or a ground voltage GND at the end of the address period. Excessive wall charges on the scan electrode Y, which are unnecessary for the sustain discharge, are eliminated by a voltage SLD that decreases at a designated slope.

In the pre-erase period, the sustain electrodes Z are simultaneously supplied with pre-erase waveforms pre-ers that rise from 0V or the ground voltage GND substantially to the sustain voltage Vs at a designated slope. The pre-erase waveform Pre-ers has a narrow pulse width and has its voltage level set to be substantially the sustain voltage Vs. Due to the pre-erase waveform, weak dark discharges occur between the sustain electrode Z and the scan electrode Y or between the sustain electrode Z and the address electrode X within off-cells that are not selected by the address discharge. As a result, since the pre-erase discharge is generated, the wall charges remaining within the off-cells from the initialization period are eliminated. Accordingly, the wall charges remaining within the off-cells radically prevent the undesired discharges that can be generated by sustain pulses SUS applied during the sustain period.

The pre-erase waveform Pre-ers can be applied only to the sustain electrode Z or the scan electrode Y, or may be applied to both the scan electrode Y and the sustain electrode Z.

In the sustain period, the sustain pulses SUS are alternately applied to the scan electrodes Y and the sustain electrodes Z. In the on-cell selected by the address discharge, the wall voltage within the cell is added to the sustain pulse SUS to generate the sustain discharge, i.e., display discharge, between the scan electrode Y and the sustain electrode Z whenever each sustain pulse SUS is applied.

In a post-erase period that is allocated after completion of the sustain discharge, a square waveform with narrow pulse width or a post-erase signal Pst-ers of a ramp wave type, as shown in FIG. 6, can be applied to at least one of the scan electrode Y and the sustain electrode Z in order to eliminate the wall charges generated by the sustain discharge. On the other hand, the post-erase signal Pst-ers and a post-erase period can be omitted.

Figure 1:
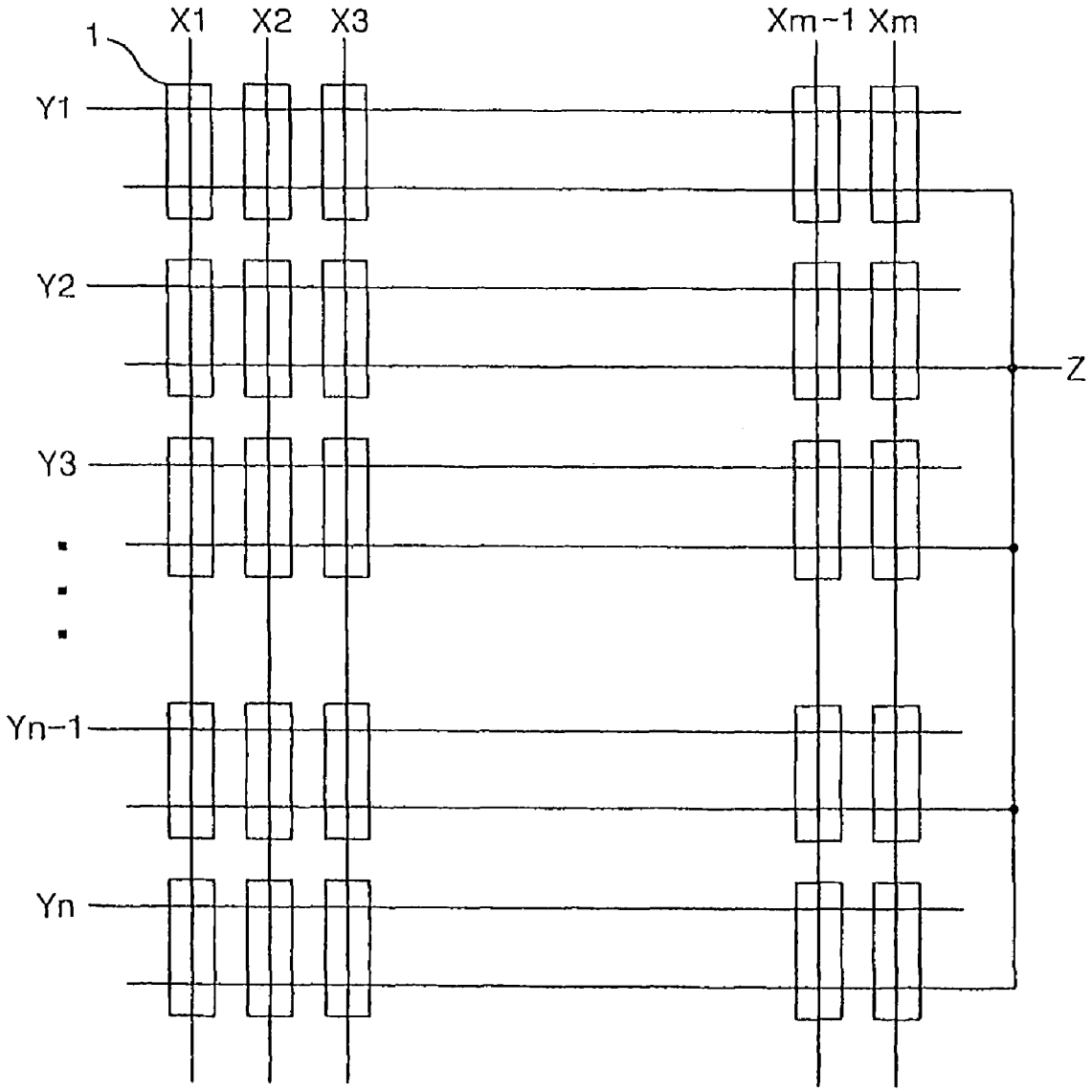
FIG. 1 RELATED ART
FIG. 1 is an arrangement plan of electrodes of a three-electrode AC surface discharge plasma display panel in the related art.
Figure 2:
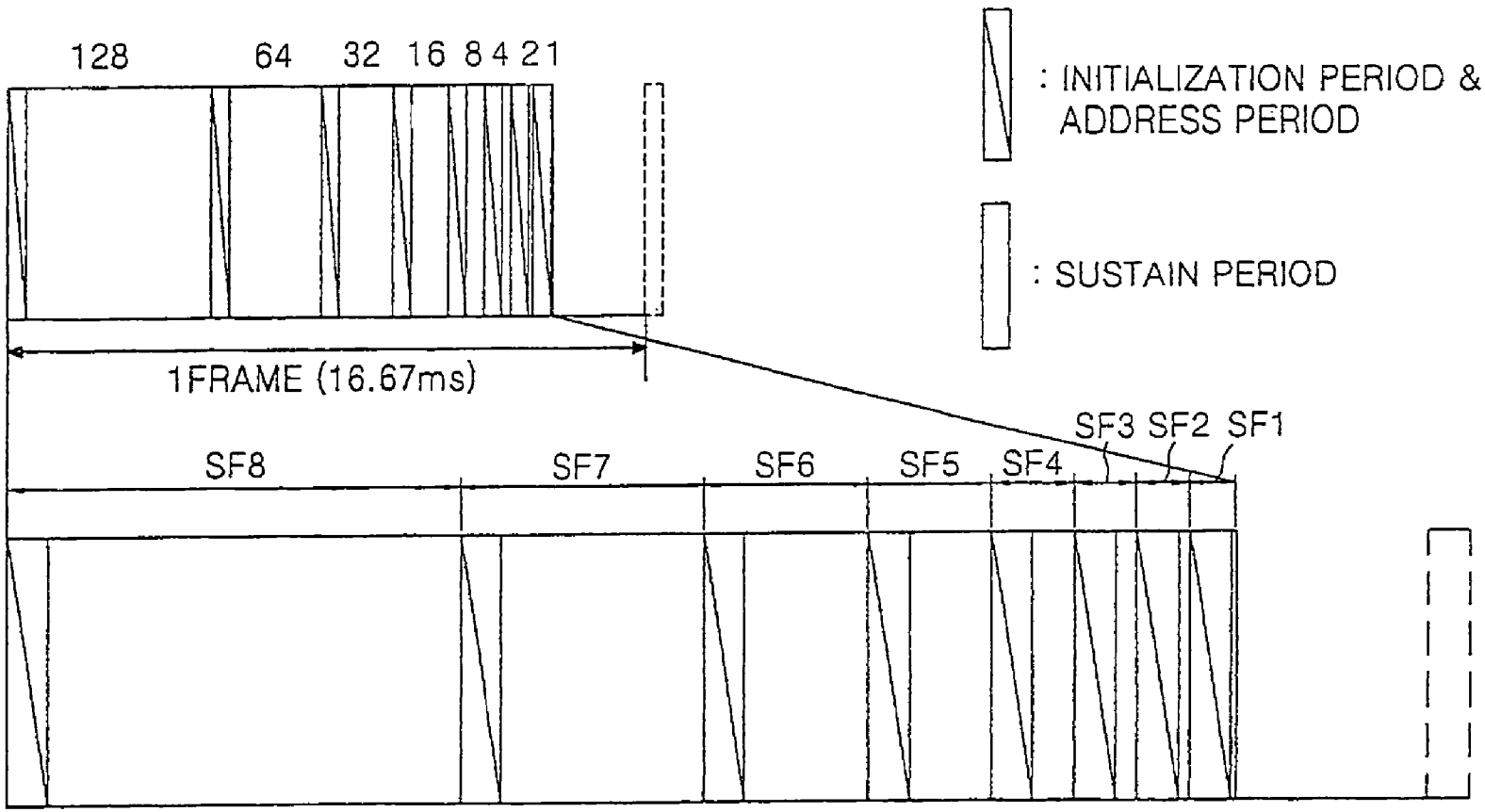
FIG. 2 RELATED ART
FIG. 2 is a diagram representing a frame configuration of 8-bit default code for realizing 256 gray levels.
Figure 3:
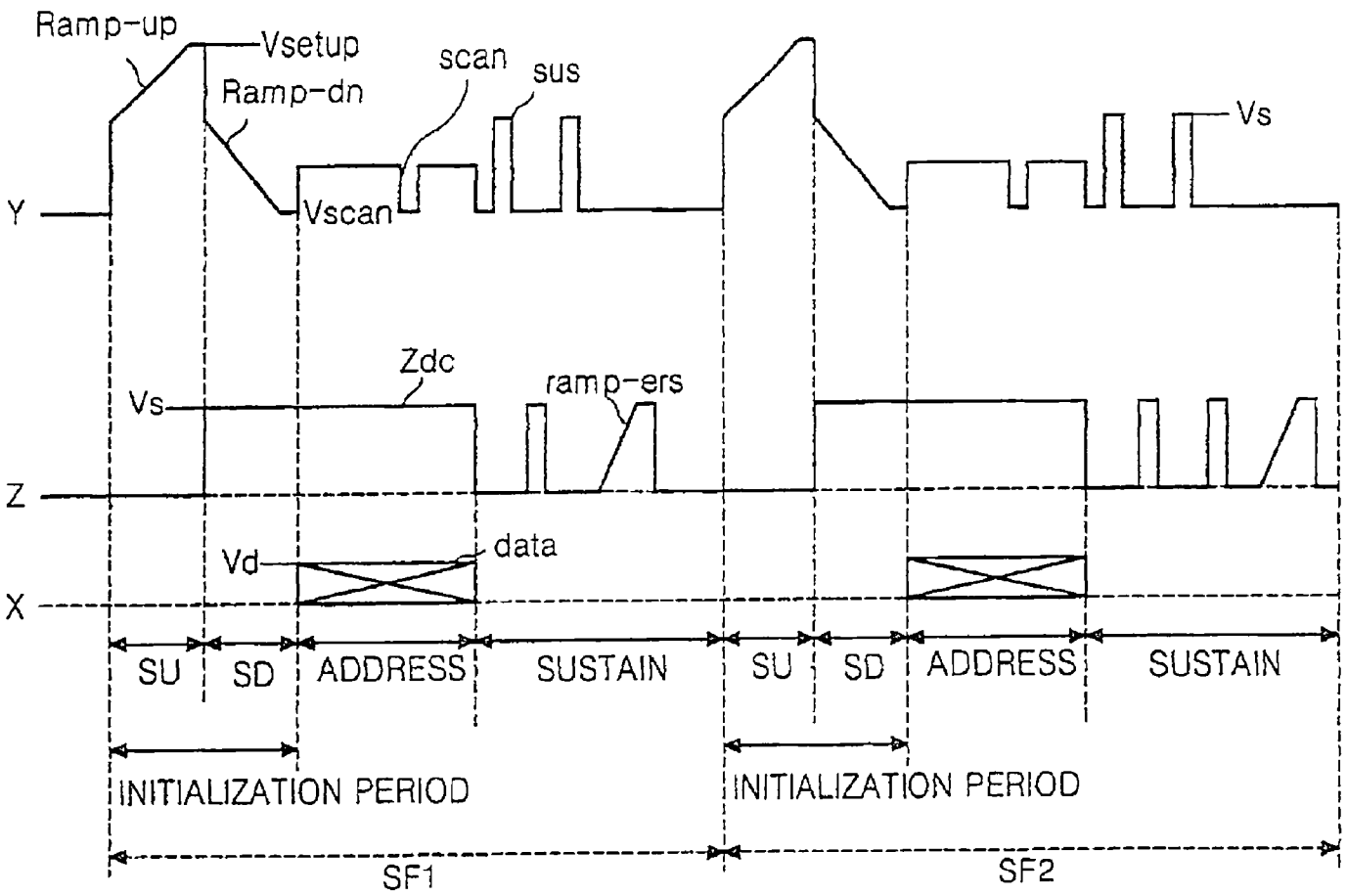
FIG. 3 RELATED ART
FIG. 3 is a waveform diagram representing driving waveforms that drive a PDP of the related art.

As a result, a method and apparatus for driving a PDP according to the first embodiment of the present invention can reduce the time needed for initialization because the set-down period in FIG. 3 is omitted and the PDP is initialized only with the setup discharge; and the present invention can also drastically reduce the external driving voltages Vscan, Vd needed for addressing because a sufficient negative wall charge is formed on the scan electrodes Y. Further, the method and apparatus for driving the PDP according to the first embodiment of the present invention can reduce the external driving voltage Vs needed for the sustain discharge because the negative wall charges formed on the scan electrodes Y and the sustain electrodes Z are sustained until the address period ends. Furthermore, the method and apparatus for driving the PDP according to the first embodiment of the present invention can prevent undesired discharge in the sustain period by having the pre-erase waveforms Pre-ers applied to the sustain electrodes Z before the start of the sustain discharge to eliminate the unnecessary wall charges accumulated within the off-cells. The pulse width of the pre-erase waveform Pre-ers is 10~20 μs, and the voltage thereof is substantially the sustain voltage Vs. The pulse width and voltage of the pre-erase waveform Pre-ers can be adjusted in accordance with the wall voltages within the cell and the voltage applied to other electrodes. In the on-cell selected during the address period, because the positive wall charges are accumulated on the scan electrode Y and the negative wall charges are accumulated on the address electrode X by the address discharge, no discharge is generated even though a positive pre-erase waveform Pre-ers is applied to the sustain electrode Z.

On the other hand, it is suggested in Japanese Laid Open Gazette No. 2001-135238 that a PDP may have efficiency heightened more than that of the related art low density Xe panel by increasing the Xe component in the discharge gas sealed with the PDP. By the way, the Hi-Xe PDP has a problem in that the reliability of address operation and sustain operation decreases because the discharge is unstable. If the present invention is applied to such a high density Xe panel, the efficiency of the PDP can not only be increased but the stable address discharge can also be generated, by increasing the Xe component in the discharge gas, thus it is possible to stabilize the address operation and the sustain operation.

Figure 9:
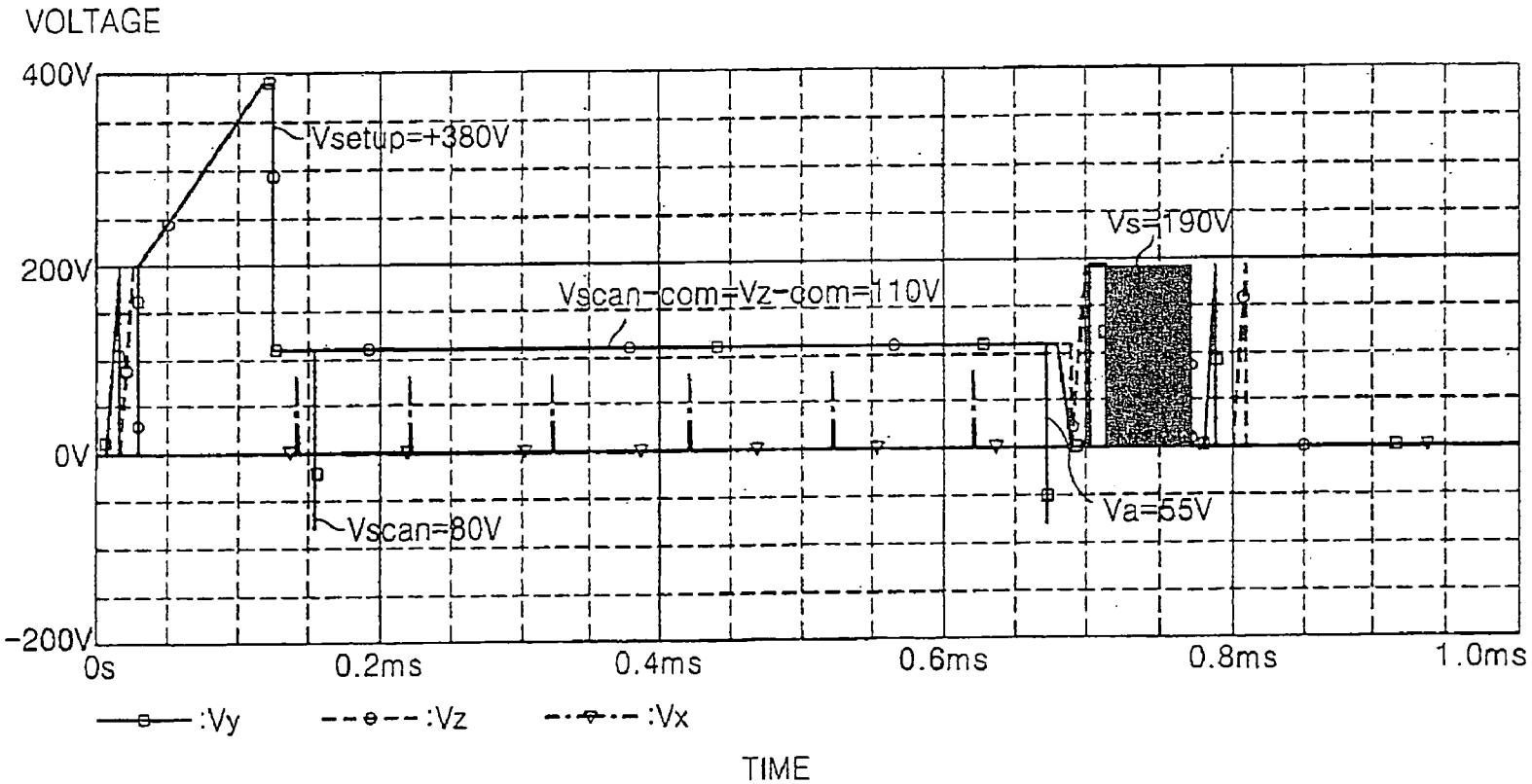
FIG. 9 is a simulation screen representing a driving waveform used in a simulation that demonstrates an effect with respect to a method and apparatus for driving a plasma display panel according to the first embodiment of the present invention.
Figure 10:
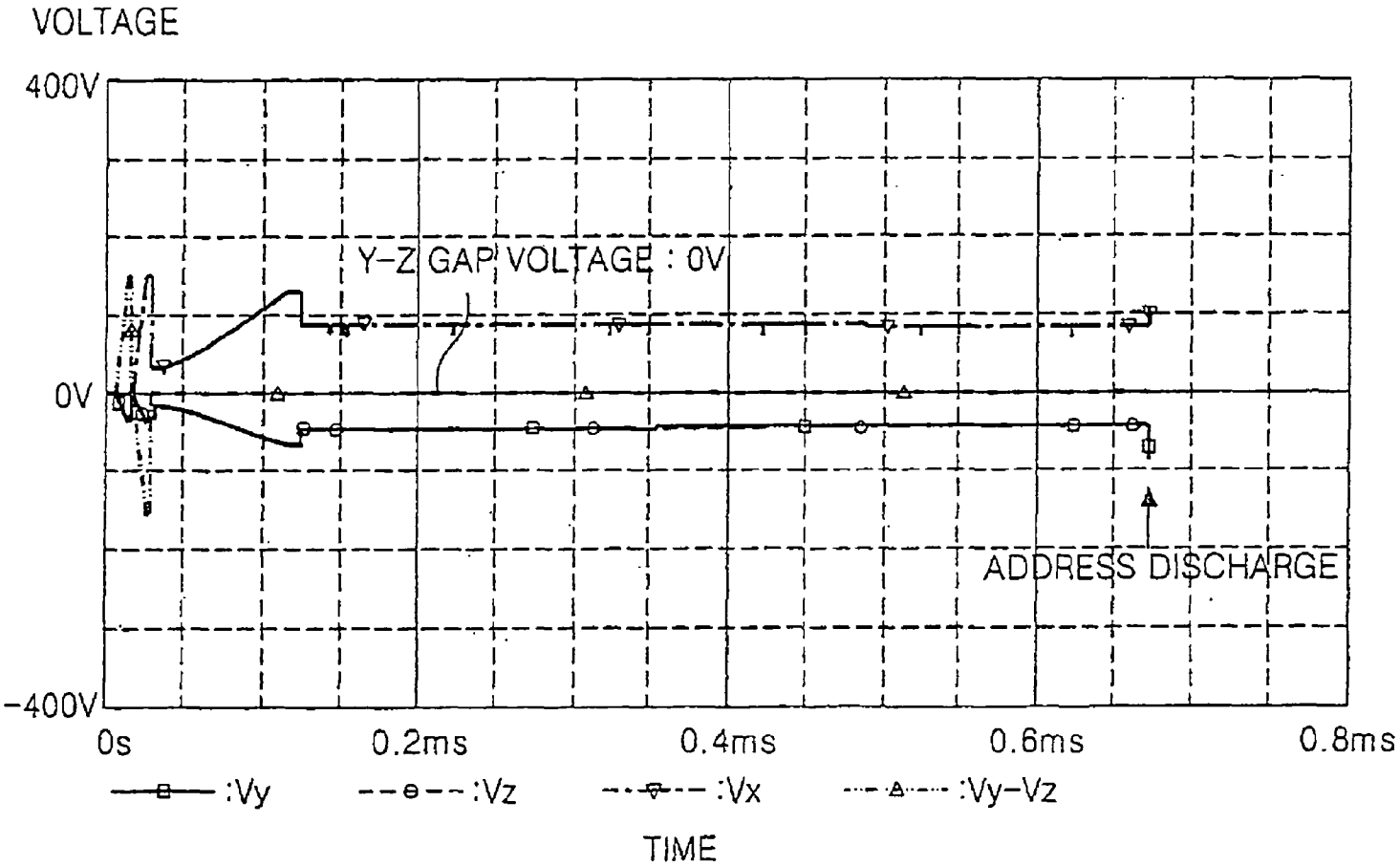
FIG. 10 is a simulation screen representing a potential difference between a scan electrode and a sustain electrode when applying the waveform of FIG. 9.

In order to prove the effect of the PDP according to the first embodiment of the present invention, a simulation was conducted in use of 'PSPICE' that is a widely used simulation tool; FIGS. 9 and 10 represent the simulation results. In this simulation, the rising ramp waveform, Ramp-up, was set to rise from 200V to 380V substantially for 0.2 ms. The rising ramp waveform Ramp-up is simultaneously applied to the scan electrode Y and the sustain electrode Z. The pulse width of the scan pulse SCAN applied to the scan electrode Y is 1.4 μs, and the pulse width of the sustain pulse SUS is 2 μs. The gaps between the sustain pulses SUS is 2 μs. The rising time and the falling time of each of the scan pulse SCAN and the sustain pulse SUS are set to be 200 ns. The voltage level of the scan voltage Vscan is set at −80V, and the voltage level of the scan bias voltage Vscan-com, Vz-scan is set at 110V. The voltage level of the data voltage Vd is set at 55V, and the voltage level of the sustain voltage Vs is set at 190V.

As can be seen in FIG. 10, the voltage difference between the scan electrode Y and the sustain electrode Z is sustained at 0V before the address discharge starts.

Figure 11:
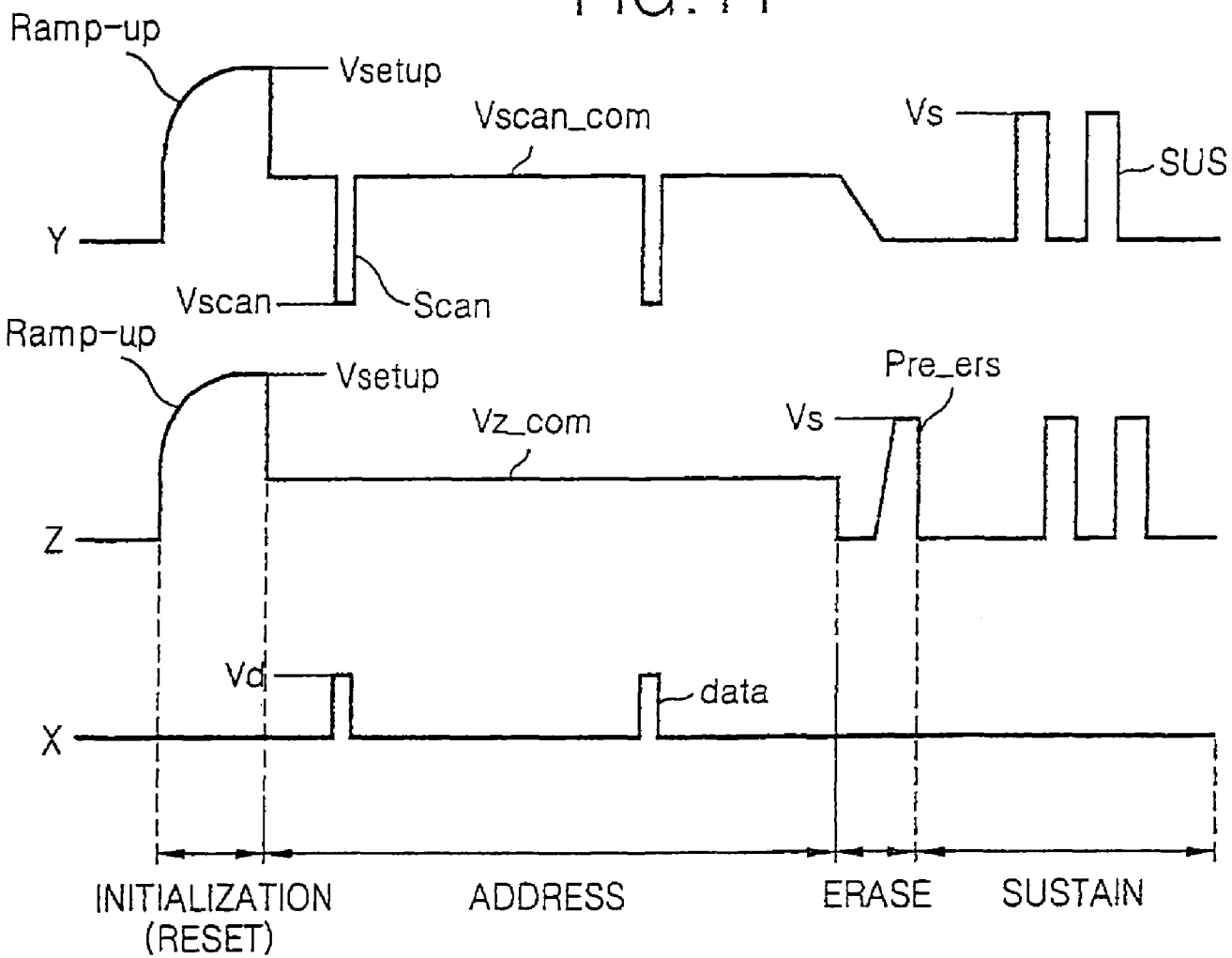
FIG. 11 is a waveform diagram representing waveforms, which are applied to a driving method for a PDP according to the second embodiment of the present invention.
Figure 12:
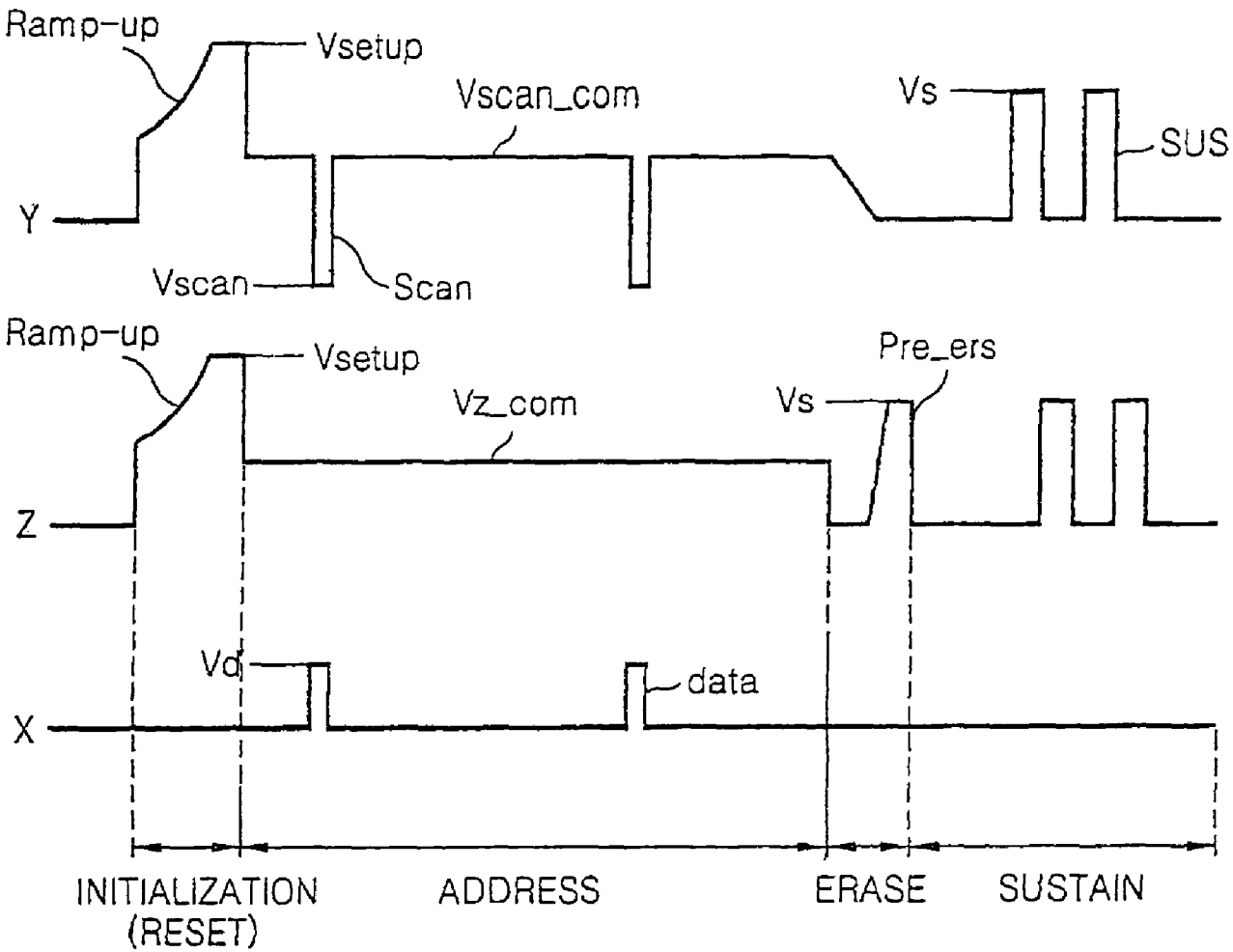
FIG. 12 is a waveform diagram representing waveforms, which are applied to a driving method for a PDP according to the third embodiment of the present invention.
Figure 13:
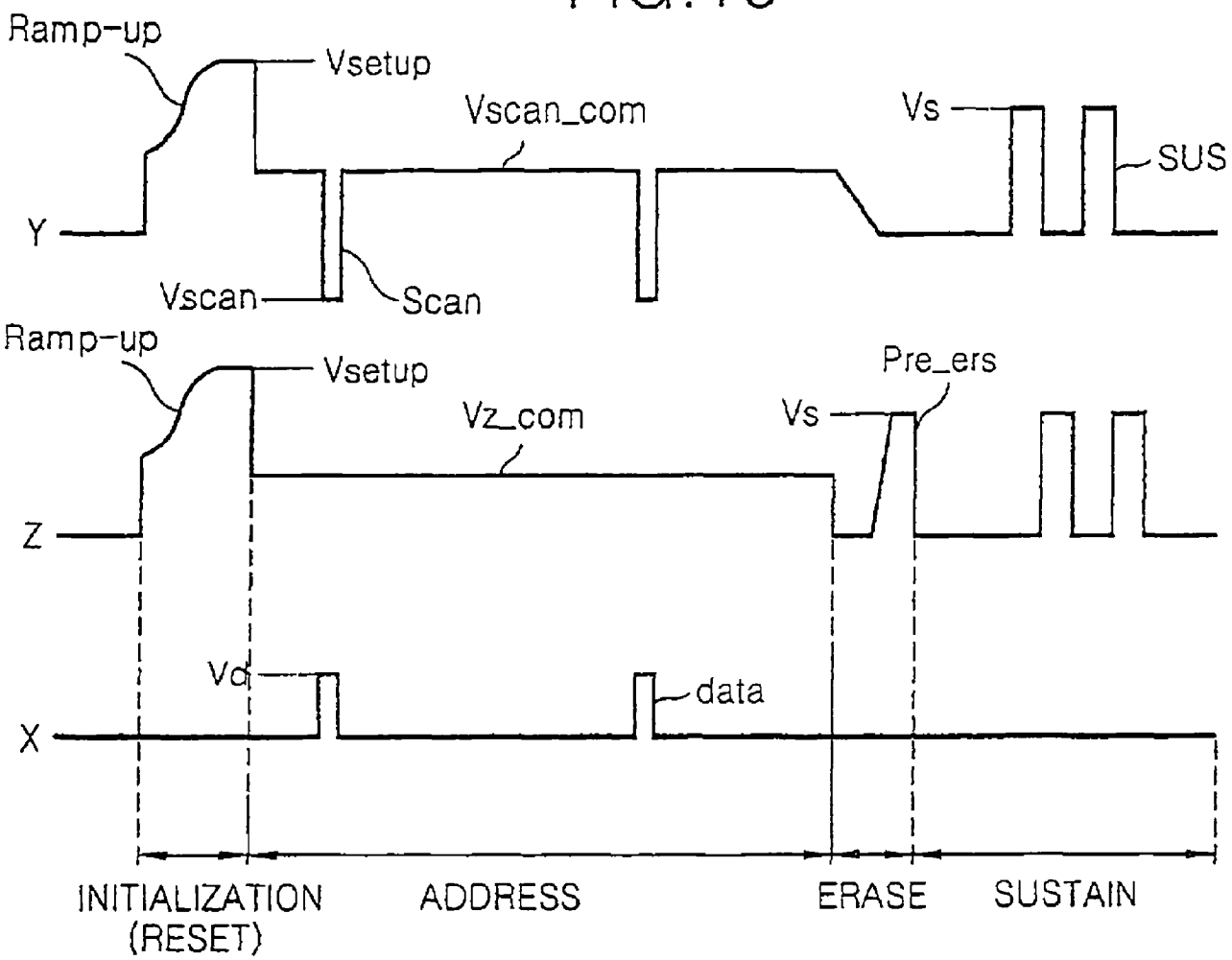
FIG. 13 is a waveform diagram representing waveforms, which are applied to a driving method for a PDP according to the fourth embodiment of the present invention.

The rising ramp waveform, Ramp-up, simultaneously applied to the scan electrode Y and the sustain electrode Z can have its rising section increase linearly, in an exponential function type, i.e., a gentle curve shape as in FIGS. 11 and 12, or in a sinusoid as in FIG. 13. The waveform of the exponential function type or the sinusoid can be realized by applying the circuit disclosed in Korean Patent Application Nos. 10-2001-0003005, 10-2001-0015755 and 10-2002-0002483 that were filed by the applicant of this application.

Figure 14:
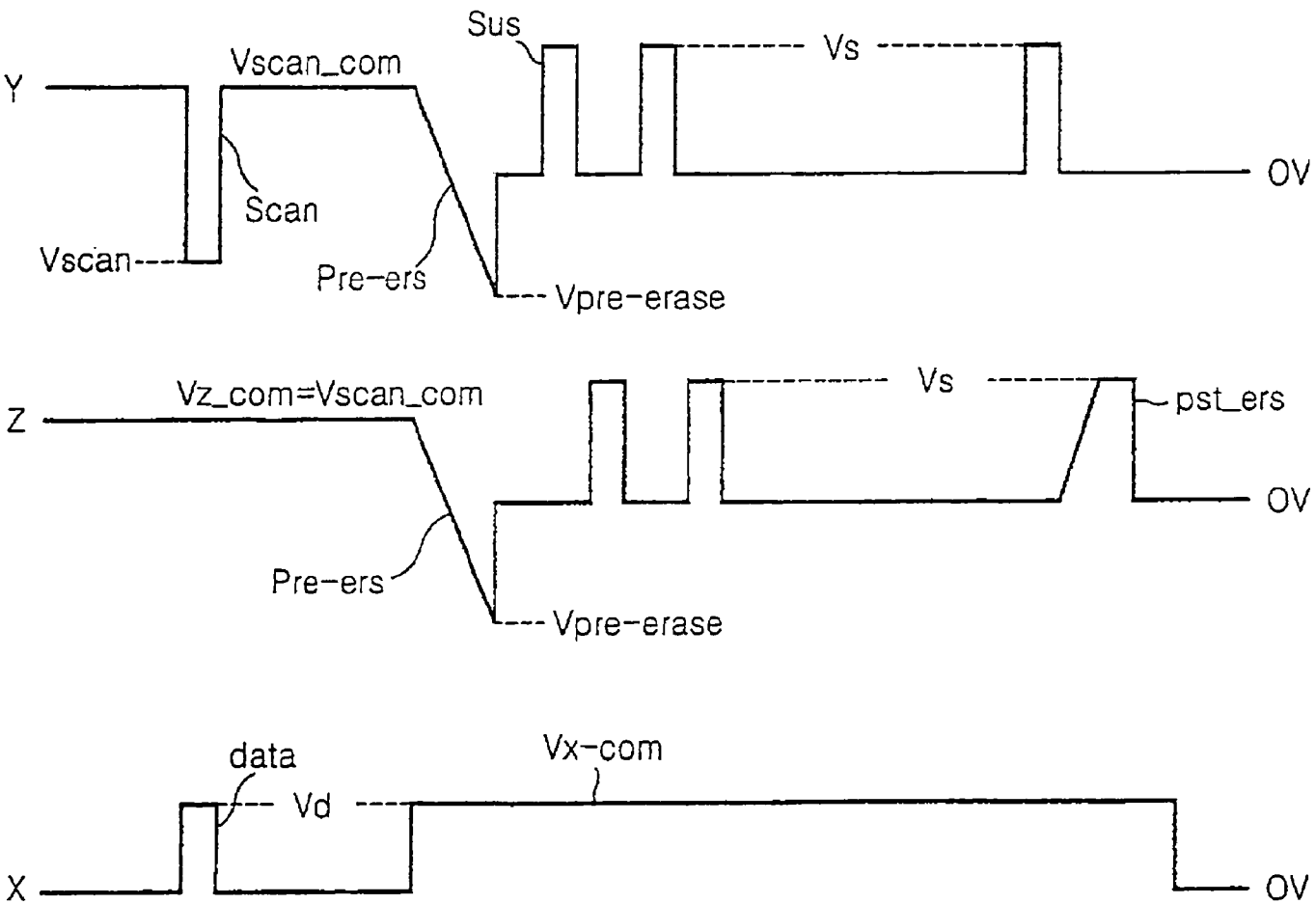
FIG. 14 is a waveform diagram representing waveforms, which are applied to a driving method for a PDP according to the fifth embodiment of the present invention.

FIG. 14 is a waveform explaining a driving method for a PDP according to the fifth embodiment of the present invention.

Referring to FIG. 14, in the driving method for the PDP according to this embodiment of the present invention, one frame period is time-divided into a plurality of sub-fields to drive the PDP, and the scan electrodes Y and the sustain electrodes Z are supplied with erase signals Pre-ers of a falling ramp waveform falling between the address period and the sustain period to eliminate the wall charges remaining within the off-cells.

In the initialization period (reset period), the cells of the full screen can be initialized by continuously applying the rising ramp waveforms and the falling ramp waveforms to the scan electrodes Y as in FIG. 3, or by applying only the rising ramp waveform to the scan electrodes Y and the sustain electrodes Z as in the present embodiment. Further details relating to this will be described later. Also, the initialization waveform can be applied to the initialization waveform explained in another embodiment described later.

The waveforms applied during the address period and the sustain period, and operations caused by them, are substantially the same as in the foregoing embodiments, thus repetitive explanation will be omitted.

The pre-erase period is allotted between the address period and the sustain period. In the pre-erase period, positive DC voltages Vx-com substantially equal to data voltages Vd are applied to the address electrode X and, at the same time, the scan electrode Y and the sustain electrode Z are supplied with the pre-erase ramp signal Pre-ers at a falling slope. The pre-erase ramp signal Pre-ers can vary in accordance with a discharge condition within the cell, but it is desirable to generate the pre-erase ramp signal Pre-ers within about 20 μs. The voltage level of the pre-erase ramp signal Pre-ers falls down below the scan voltage Vscan. On the other hand, the voltage difference between two electrodes needed for an erase discharge depends on the firing voltage between the address electrode X and the scan electrode Y, and the firing voltage between the address electrode X and the sustain electrode Z. Because of this, the pre-erase ramp signal Pre-ers can have its voltage level changed in accordance with the voltage in the address electrode X. The pre-erase ramp signal Pre-ers causes a dark discharge, where no light is generated, between the address electrode X and the scan electrode Y, and between the address electrode X and the sustain electrode Z. The dark discharge causes the wall charges remaining within the off-cells from the initialization period to be eliminated. As a result, the voltage between the electrodes X, Y and Z is kept below the firing voltage so as not to generate discharges in the off-cells because the wall voltage inside the off-cells is 0 (zero) or close thereto even when the sustain pulse SUS is applied to the scan electrode Y and the sustain electrode Z. On the other hand, no discharge occurs between the electrodes X, Y and Z in the on-cells because negative charges are charged on the address electrode X and positive charges are charged on the scan electrode Y even when the pre-erase ramp signal Pre-ers of negative voltage is applied to the scan electrode Y and the sustain electrode Z.

Figure 15:
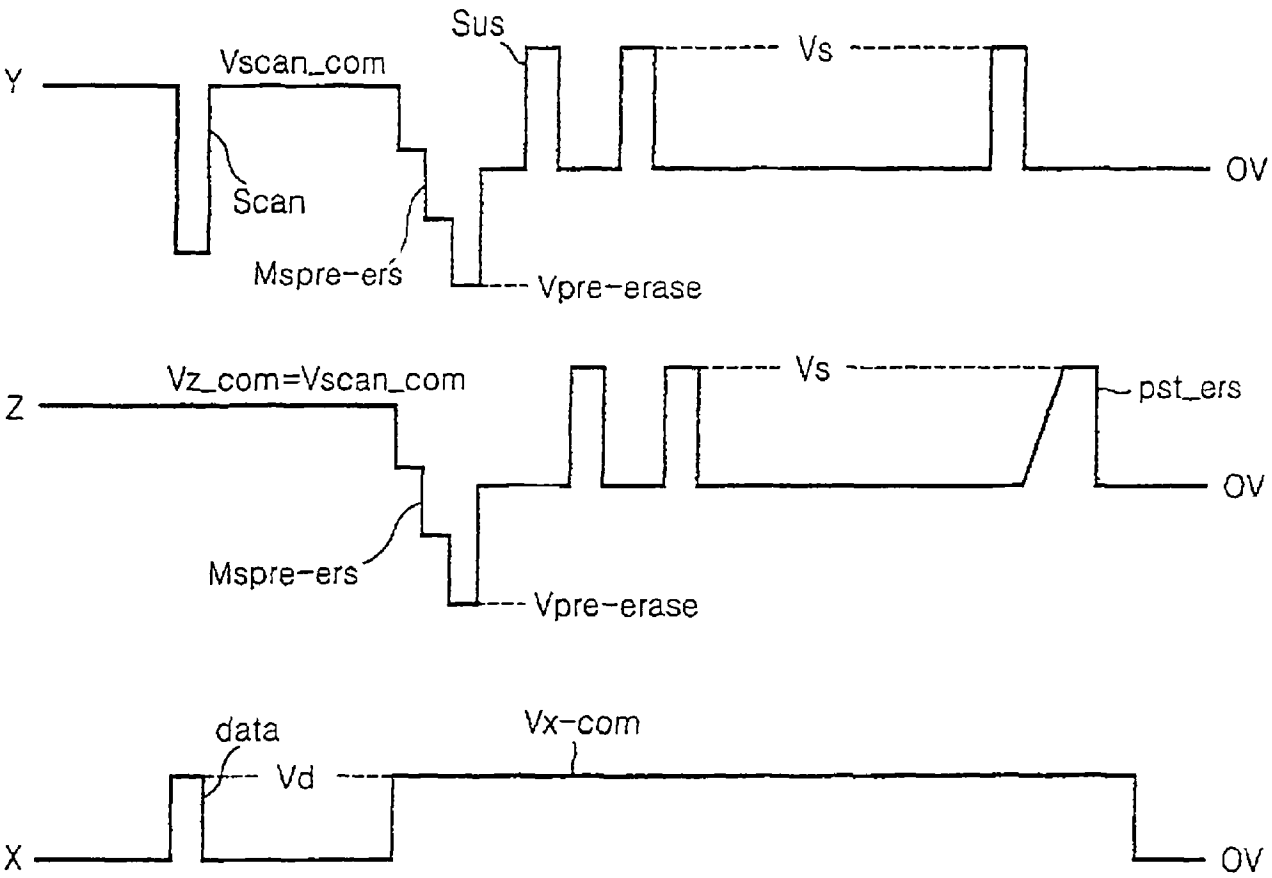
FIG. 15 is a waveform diagram representing waveforms, which are applied to a driving method for a PDP according to the sixth embodiment of the present invention.

On the other hand, the pre-erase ramp signal Pre-ers can be a multi-step waveform MSPre-ers as shown in FIG. 15, and can have its voltage level decreased step by step.

Figure 16:
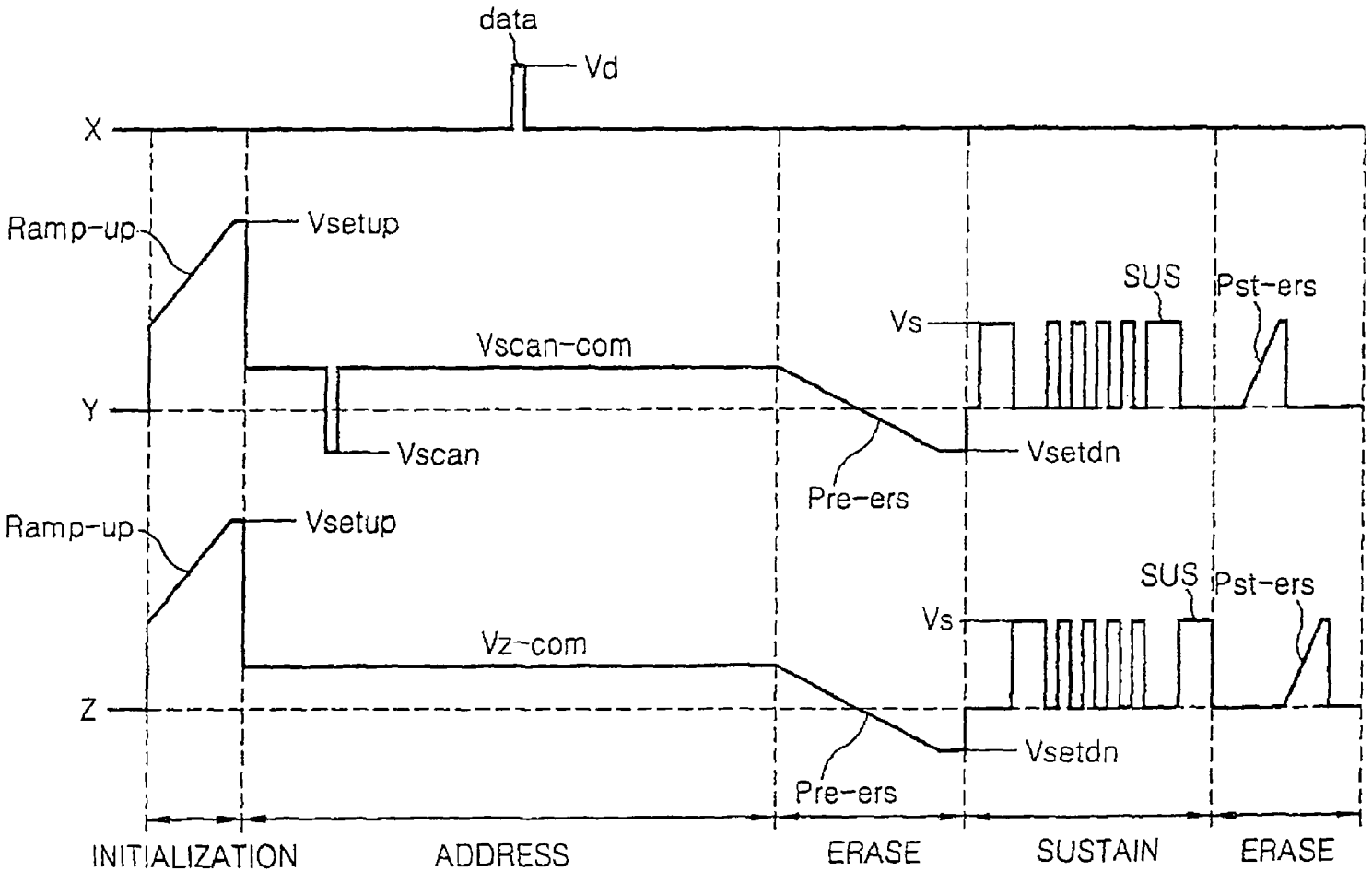
FIG. 16 is a waveform diagram representing waveforms, which are applied to a driving method for a PDP according to the seventh embodiment of the present invention.
Figure 17:
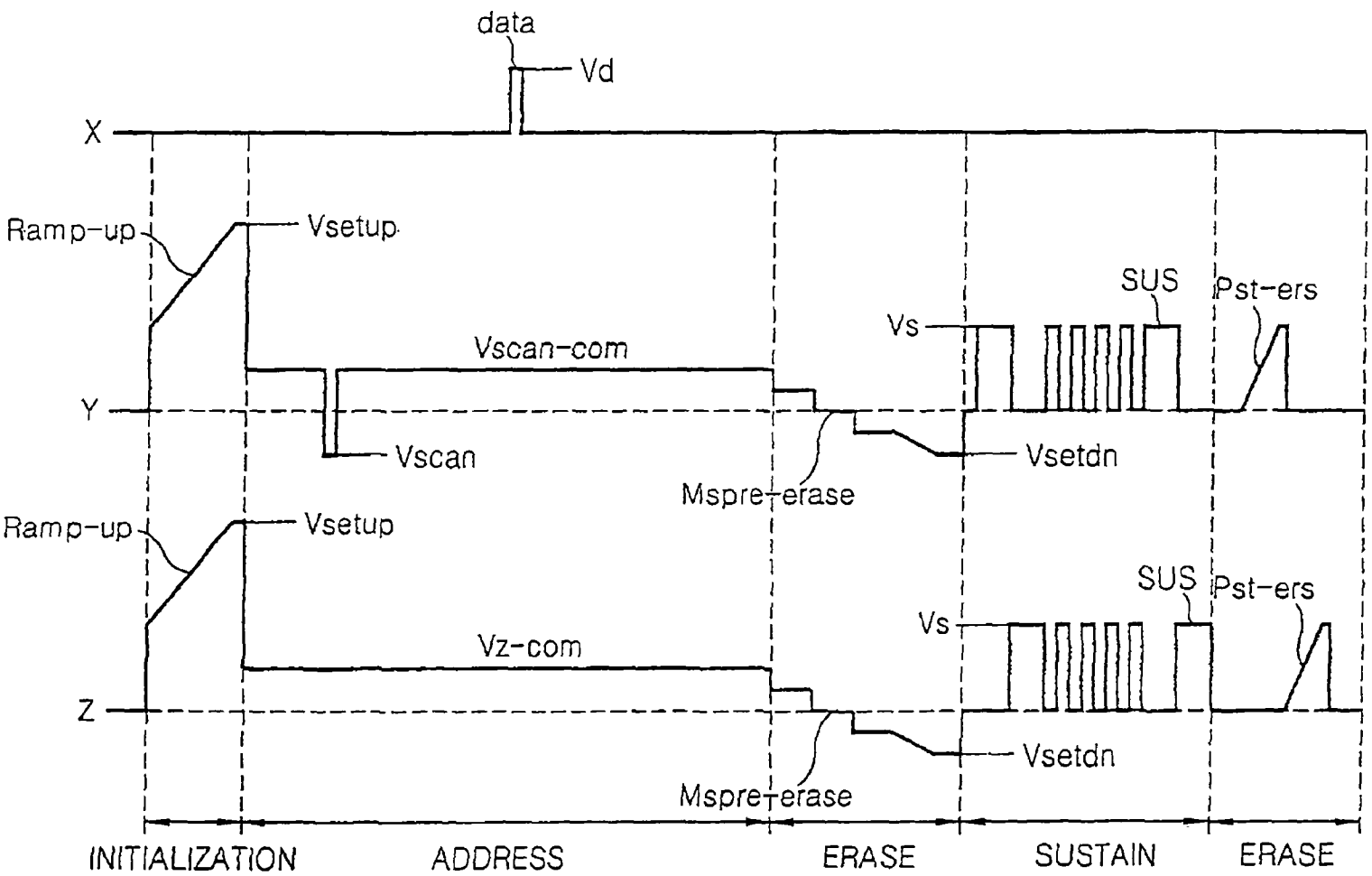
FIG. 17 is a waveform diagram representing waveforms, which are applied to a driving method for a PDP according to the eighth embodiment of the present invention.

FIG. 16 is a waveform diagram representing an embodiment where the initialization waveform shown in FIG. 5 is applied to the driving waveform shown in FIG. 14. FIG. 17 is a waveform diagram representing an embodiment where the initialization waveform shown in FIG. 5 is applied to the driving waveform shown in FIG. 15.

Referring to FIGS. 16 and 17, in the driving method for the PDP according to further embodiments of the present invention, the cells of the full screen are initialized in use of only the rising ramp waveform, Ramp-up, for the initialization period in each sub-field, and the remaining charges within the off-cells are eliminated in use of the pre-erase waveforms, Pre-ers and MSPre-ers, where their voltages decrease gradually or step by step for the pre-erase period which is allotted between the address period and the sustain period.

In the initialization period (reset period), all the scan electrodes Y and sustain electrodes Z are simultaneously supplied with the rising ramp waveforms, Ramp-up, that rise substantially from the sustain voltage Vs to the setup voltage Vsetup at a designated slope. At the same time, the address electrodes X are supplied with 0 V or a ground voltage GND. By simultaneously applying the rising ramp waveforms to the scan electrodes Y and the sustain electrodes Z like this, dark discharges occur within the cells of the full screen, with the dark discharges generating almost no light. As a result, the negative (−) wall charges are accumulated in each of the scan electrode Y and the sustain electrode Z, and the positive (+) wall charges are accumulated on the address electrode X. Because the same voltage is simultaneously applied to the scan electrode Y and the sustain electrode Z, a potential difference between the scan electrode Y and the address electrode X, and a potential difference between the sustain electrode Z and the address electrode X are the same as an opposite firing voltage between the scan electrode Y and the address electrode X, which is required for the address discharge. There is no potential difference between the scan electrode Y and the sustain electrode Z. The same amount of wall charge is in each of the scan electrode Y and the sustain electrode Z as a result of the discharge caused by the rising ramp waveform, Ramp-up, even though the previous condition of the initialization period, i.e., initial condition, is different.

On the other hand, before the address discharge starts, there is no potential difference between the scan electrode Y and the sustain electrode Z, and the wall charge formed in each of two electrodes Y, Z is equal; thus no undesired discharge occurs even though the PDP is used under a high temperature environment of 50° C. and above.

The address period starts when the positive scan bias voltages Vscan-com are simultaneously applied to the scan electrodes Y, and the sustain electrodes Z are simultaneously supplied with the bias voltages Vz-com, which are substantially the same as the scan bias voltage Vscan-com. Because the same voltages Vscan-com, Vz-scan are simultaneously applied to the scan electrode Y and the sustain electrode Z, there is no potential difference between the scan electrode Y and the sustain electrode Z. Subsequently, scan pulses SCAN falling down to the negative scan voltage Vscan are sequentially applied to the scan electrodes Y and, at the same time, data pulses DATA synchronized with the scan pulse SCAN and rising up to the positive data voltage Vd are applied to the address electrodes X. The voltage difference between the scan pulse SCAN and the data pulse DATA is added to the wall voltage generated during the initialization period to generate the address discharge within an on-cell to which the data pulse DATA is applied. Wall charges are formed within the selected on-cells by the address discharge, so as to be able to generate discharges when the sustain voltage Vs is applied.

In the pre-erase period, the pre-erase ramp signals, Pre-ers, MSPre-ers, having a falling slope are simultaneously applied to the scan electrodes Y and the sustain electrodes Z. The pre-erase ramp signals, Pre-ers, MSPre-ers, can have a different voltage level, slope or number of steps in accordance with the voltage in the address electrode X and the discharge condition within the cell. The pre-erase ramp signals, Pre-ers, MSPre-ers, cause dark discharge, where almost no light is generated, between the address electrode X and the scan electrode Z, and between the address electrode X and the sustain electrode Z. The dark discharge causes the wall charges remaining within the off-cells from the initialization period to be eliminated. As a result, no discharge is generated in the off-cells even when the sustain pulse SUS is applied to the scan electrode Y and the sustain electrode Z. On the other hand, no discharge occurs between the electrodes X, Y and Z in the on-cells even when the pre-erase ramp signal, Pre-ers, of negative voltage is applied to the scan electrode Y and the sustain electrode Z, because negative charges are charged on the address electrode X and positive charges are charged on the scan electrode Y.

In the sustain period, the sustain pulses SUS are alternately applied to the scan electrodes Y and the sustain electrodes Z. In the on-cell selected by the address discharge, the wall voltage within the cell is added to the sustain pulse SUS to generate the sustain discharge, i.e., display discharge, between the scan electrode Y and the sustain electrode Z whenever each sustain pulse SUS is applied.

On the other hand, the sustain pulse firstly applied to the scan electrode Y and the sustain electrode Z to generate the sustain discharge stably has its pulse width set to be wider than the normal sustain pulses thereafter. Further, the sustain pulse lastly applied to the scan electrode Y and the sustain electrode Z also has its pulse width set to be wider than the normal sustain pulses therebefore. Specifically, according to the experiment result, it is desirable to apply the last sustain pulse to the sustain electrode Z for each sub-field.

In a post-erase period that is allocated after completion of the sustain discharge, the post-erase signal, Pst-ers, of a ramp waveform is applied to at least one of the scan electrode Y and the sustain electrode Z in order to eliminate the wall charges generated by the sustain discharge. The post erase signal, Pst-ers, causes the erase discharge generated within the on-cell, thereby eliminating the remaining wall charges. On the other hand, the post-erase signal, Pst-ers, and the post-erase period can be omitted.

Figure 18:
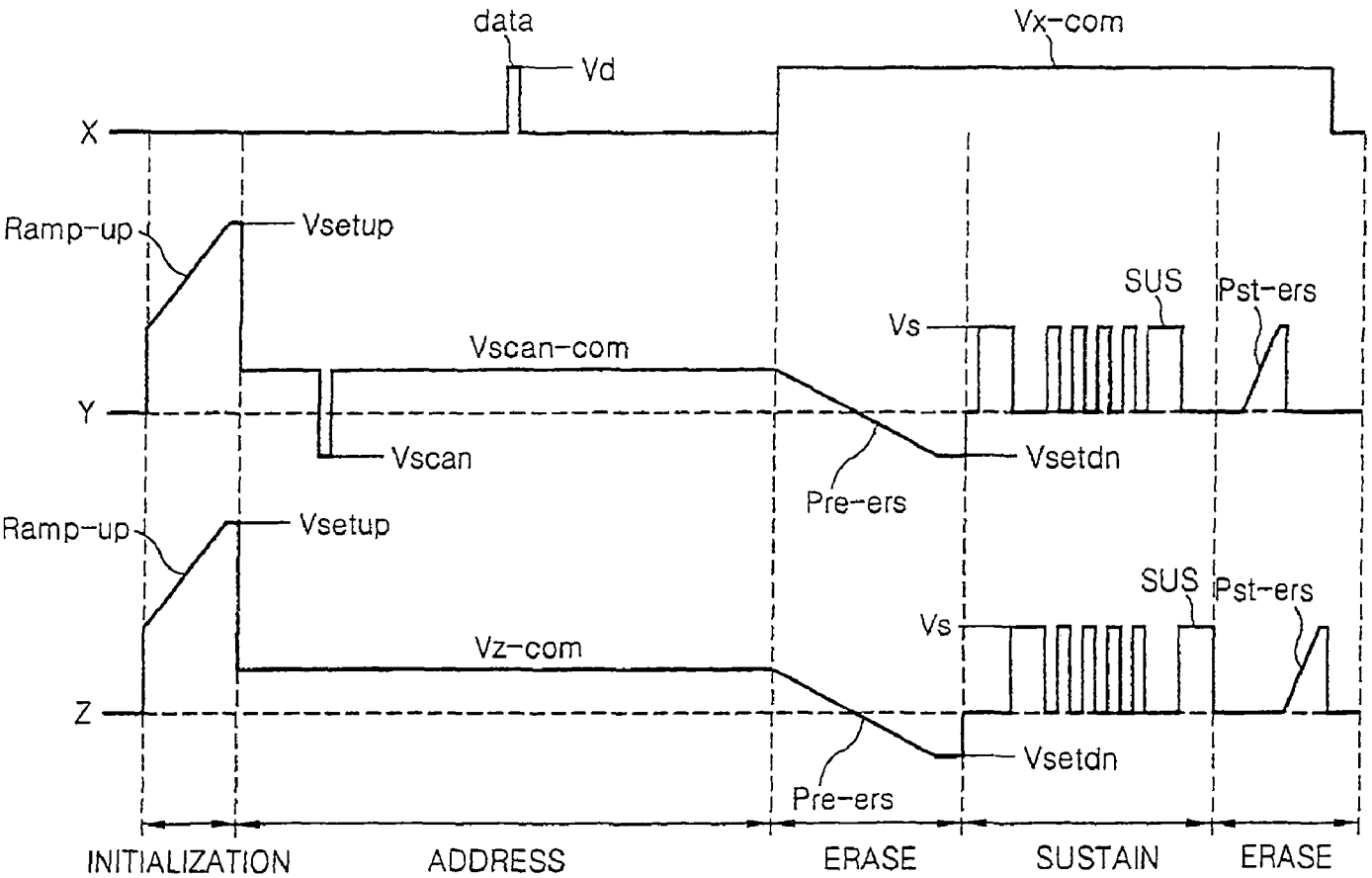
FIG. 18 is a waveform diagram representing waveforms, which are applied to a driving method for a PDP according to the ninth embodiment of the present invention.
Figure 19:
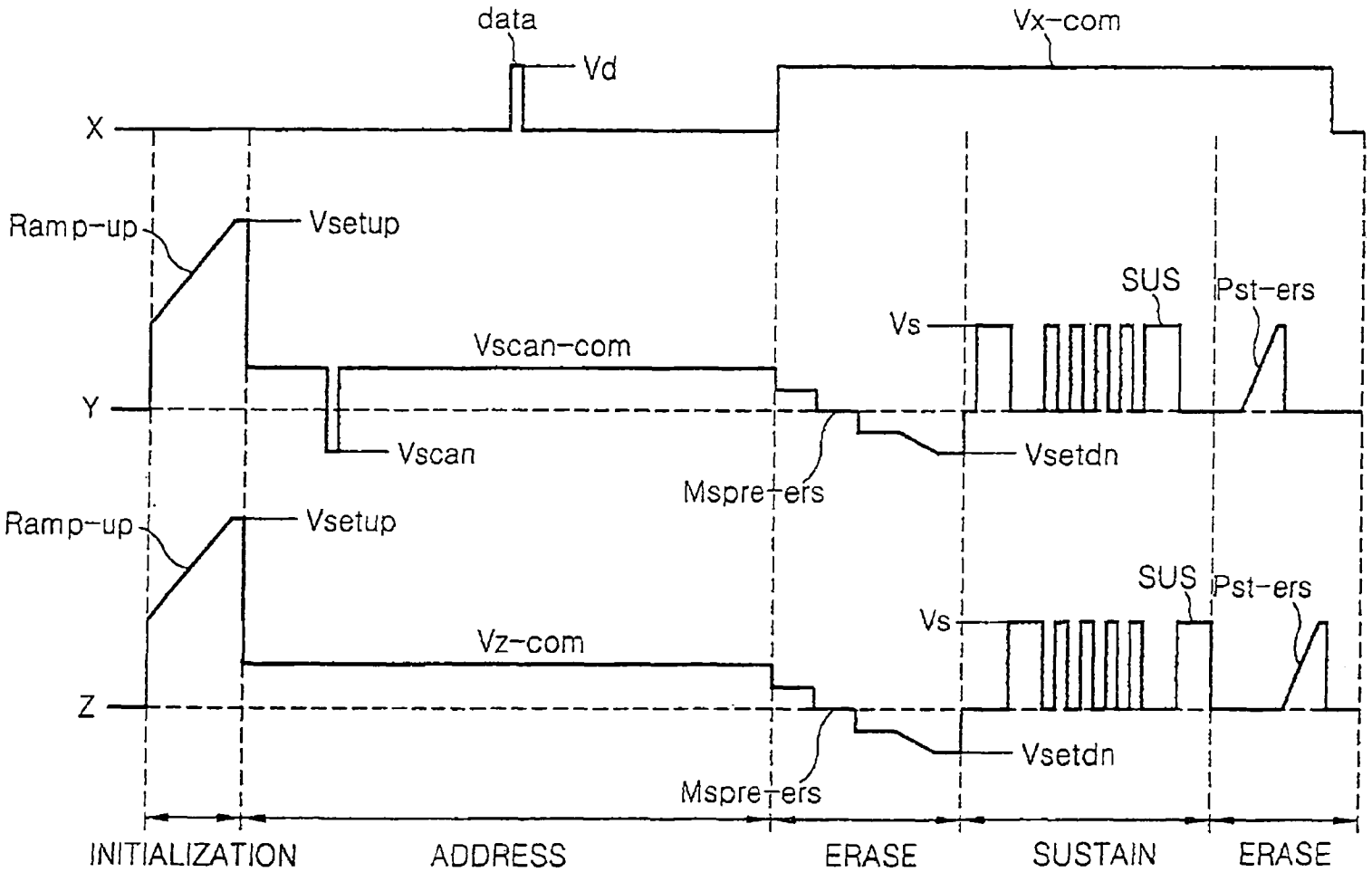
FIG. 19 is a waveform diagram representing waveforms, which are applied to a driving method for a PDP according to the tenth embodiment of the present invention.

On the other hand, in the pre-erase period and the sustain period, the address electrode X is supplied with the positive DC voltage Vx-com that is substantially the same as the data voltage Vd, as shown in FIGS. 18 and 19. If the positive DC voltage is applied to the address electrode X during the pre-erase period and the sustain period, the pre-erase discharge is generated more easily, the absolute value of the voltage of the pre-erase signal, Pre-ers, MSPre-ers, can be lowered more, and the sustain discharge is mostly generated between the scan electrode Y and the sustain electrode Z.

Figure 20:
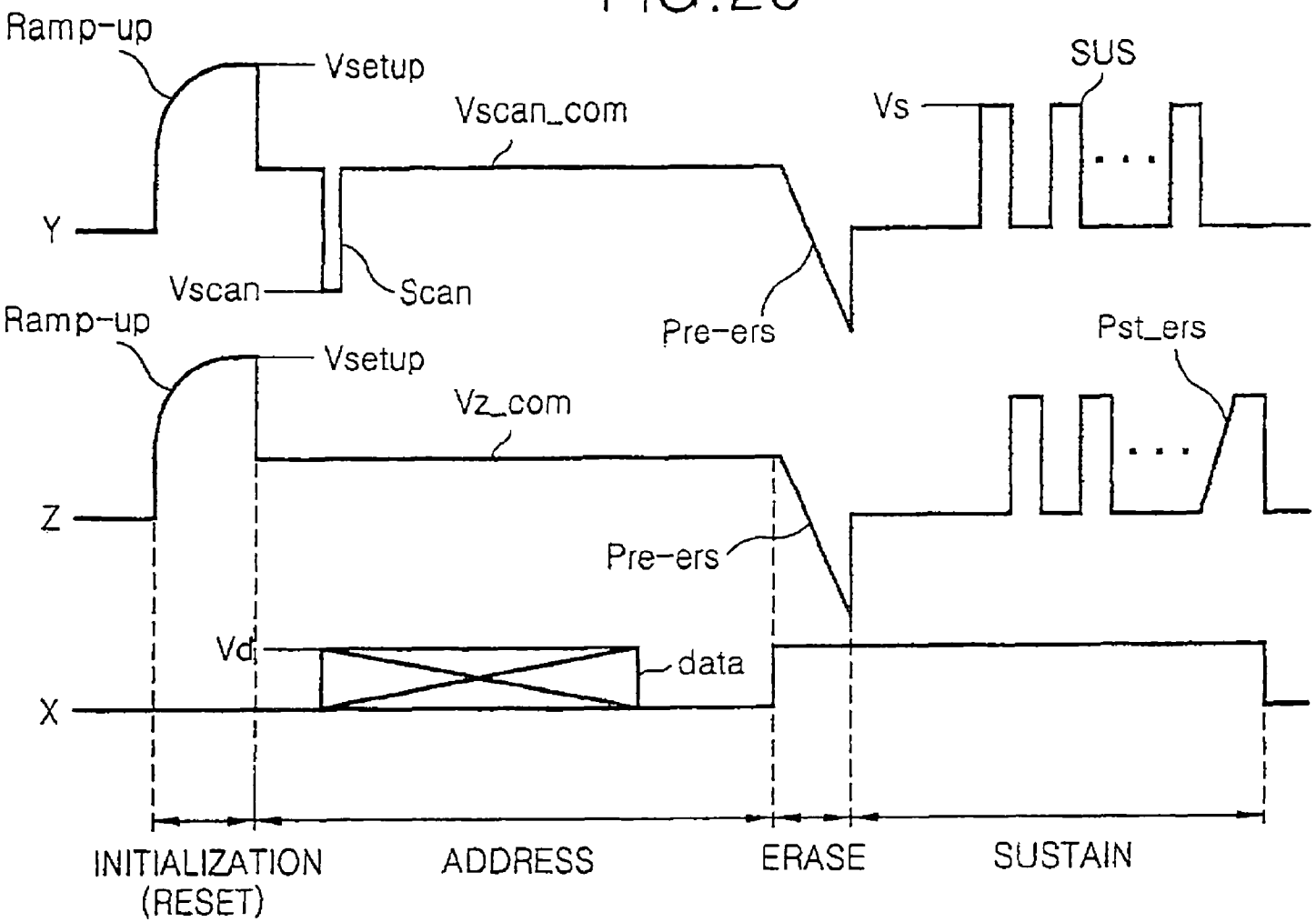
FIG. 20 is a waveform diagram representing waveforms, which are applied to a driving method for a PDP according to the eleventh embodiment of the present invention.
Figure 21:
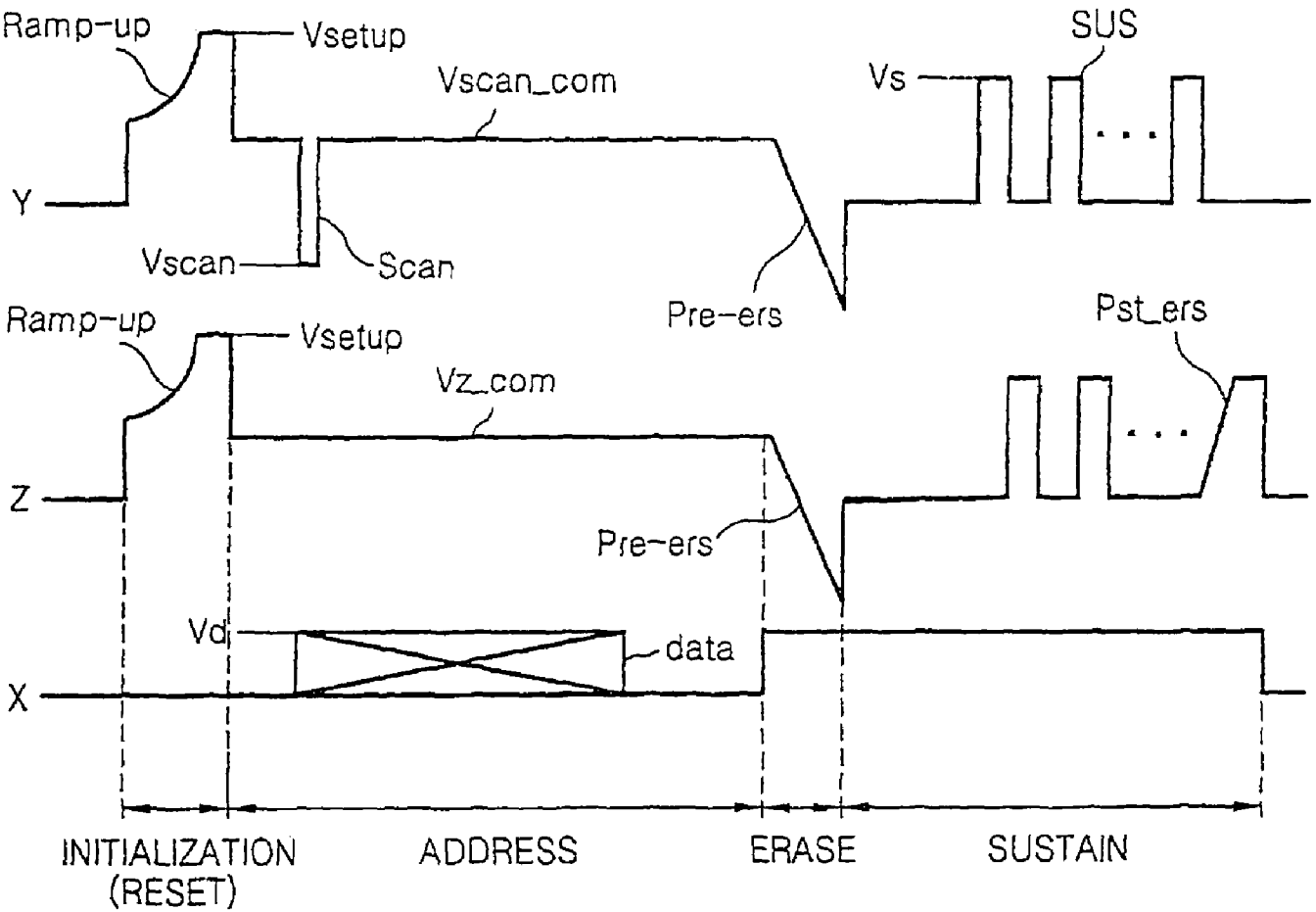
FIG. 21 is a waveform diagram representing waveforms, which are applied to a driving method for a PDP according to the twelfth embodiment of the present invention.
Figure 22:
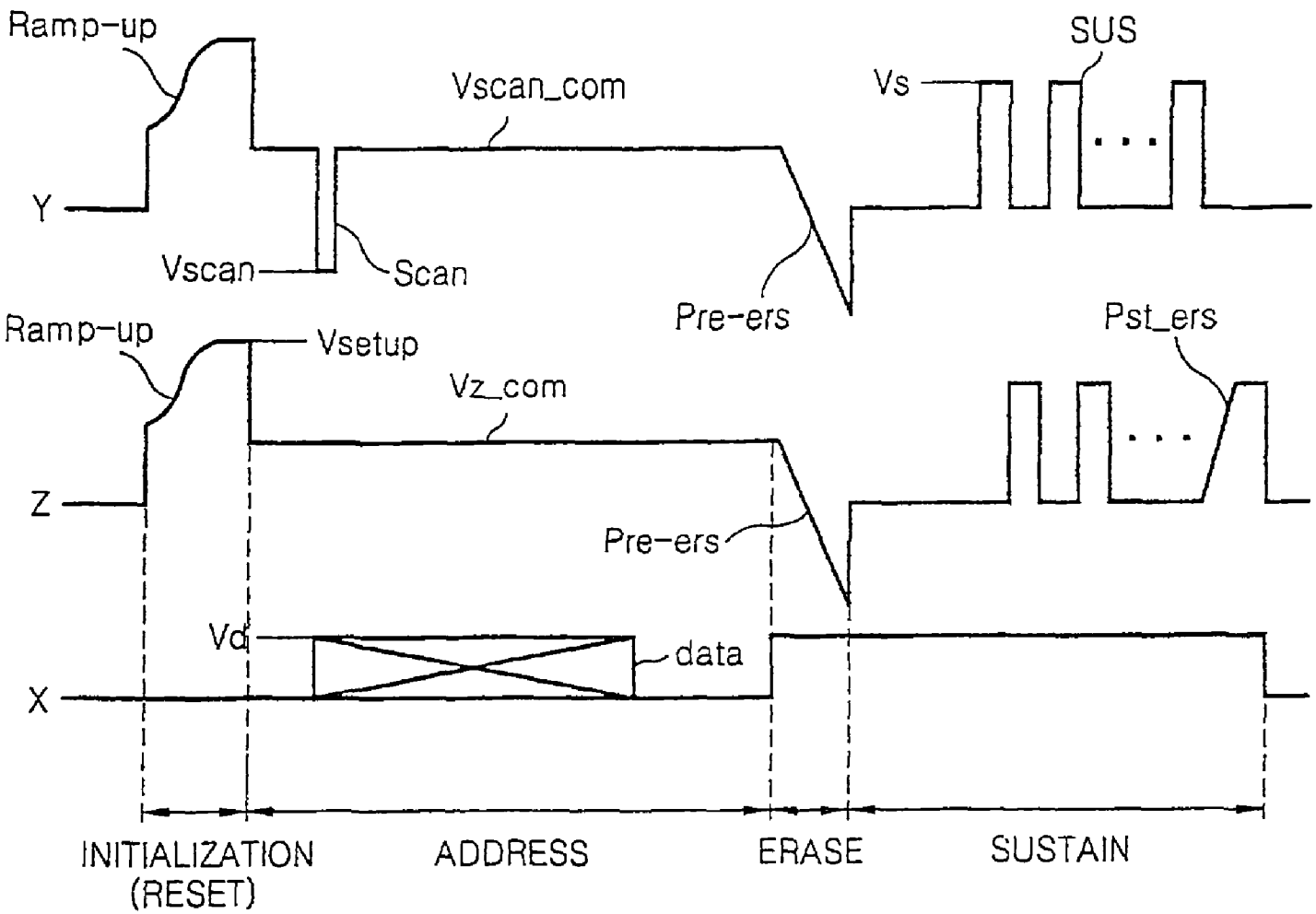
FIG. 22 is a waveform diagram representing waveforms, which are applied to a driving method for a PDP according to the thirteenth embodiment of the present invention.

The rising ramp waveform, Ramp-up, simultaneously applied to the scan electrode Y and the sustain electrode Z can have its rising section increase linearly, in an exponential function type, i.e., a gentle curve shape as in FIGS. 20 and 21, or in a sinusoid as in FIG. 22 in use of a resonance circuit.

Figure 23:
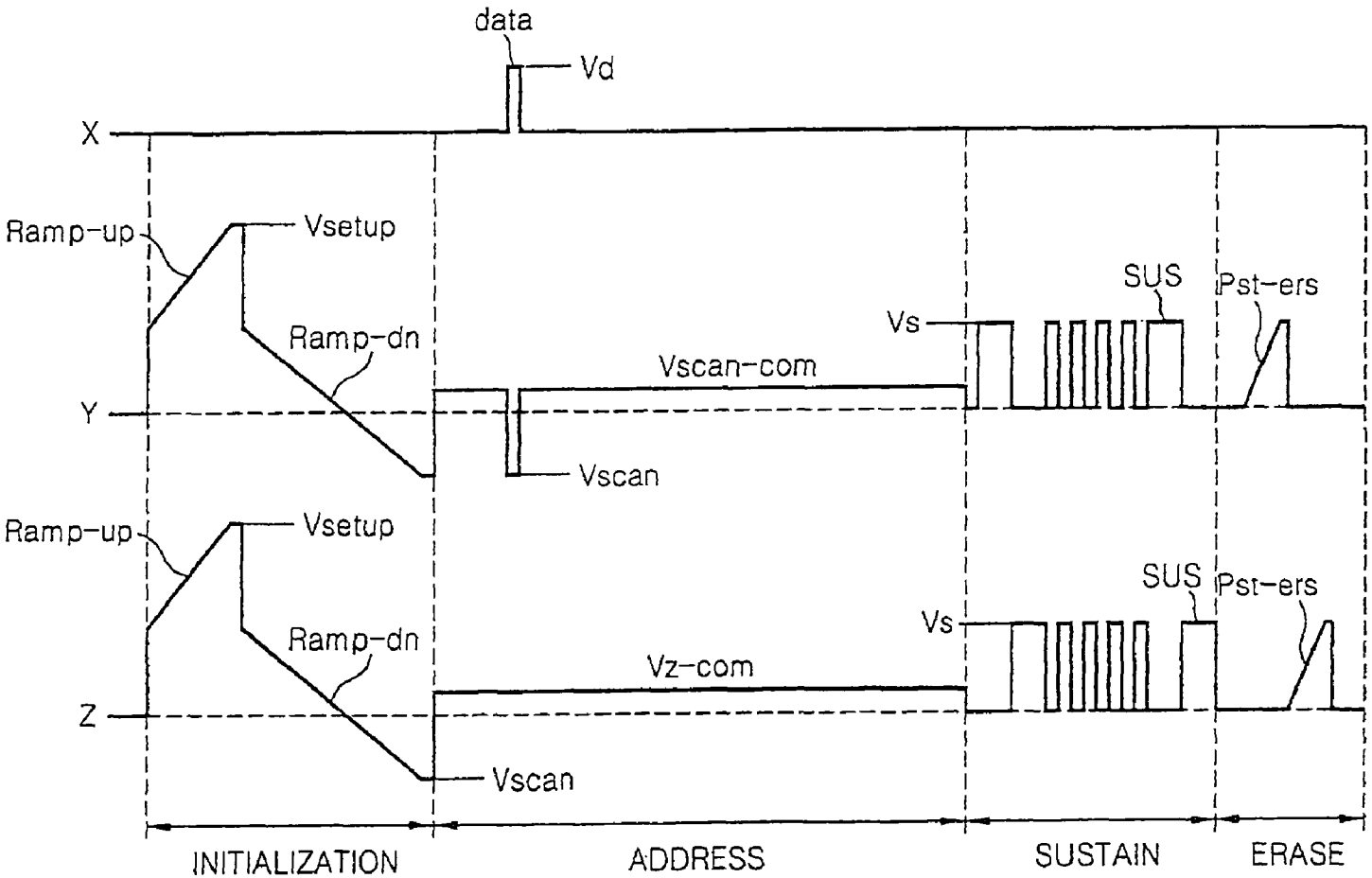
FIG. 23 is a waveform diagram explaining a driving method for a PDP according to the fourteenth embodiment of the present invention.
Figure 24:
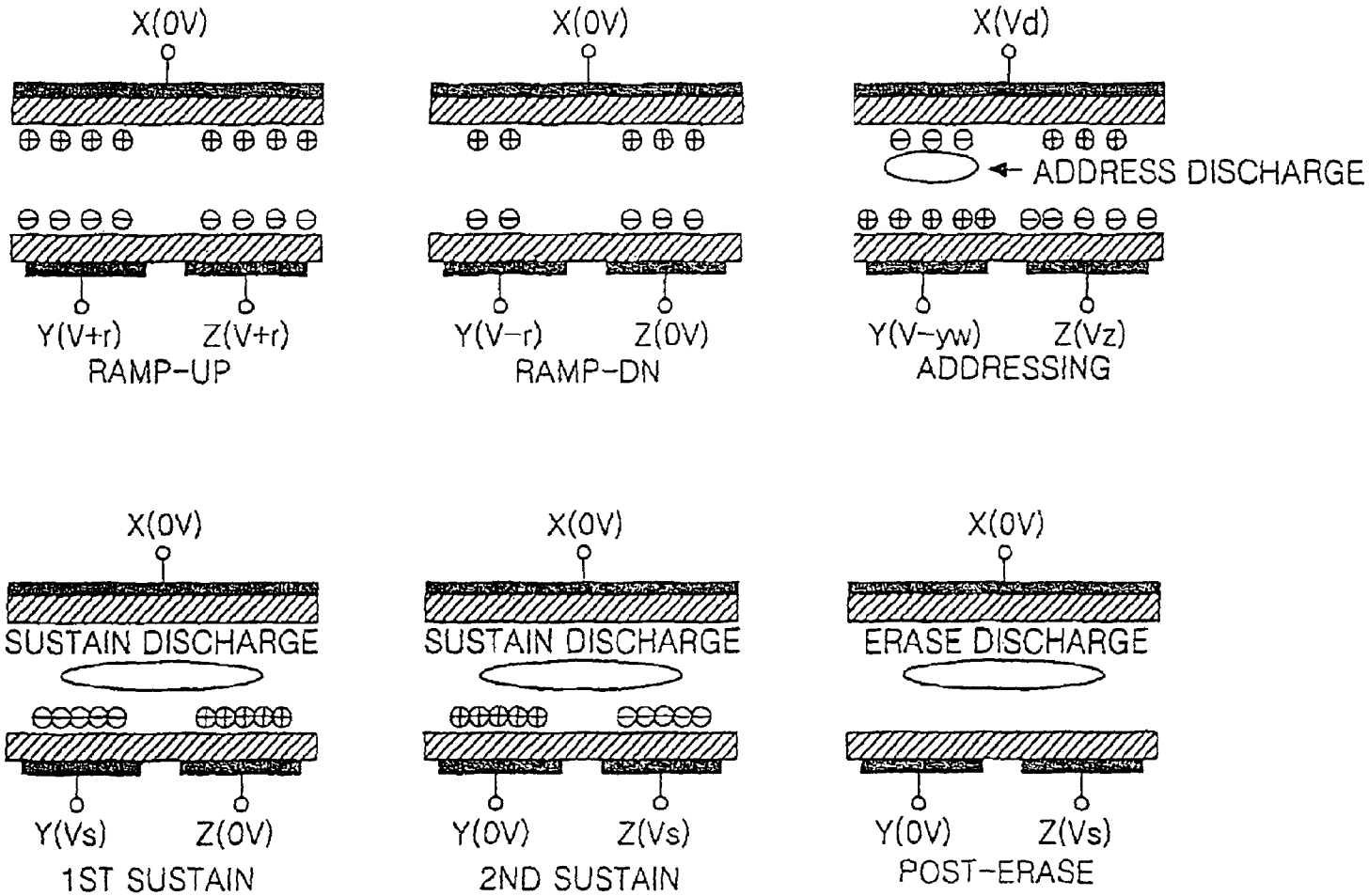
FIG. 24 illustrates a change of wall charge distribution with the lapse of time within an on-cell in the event of the application of the waveform diagram of FIG. 23.
Figure 25A:
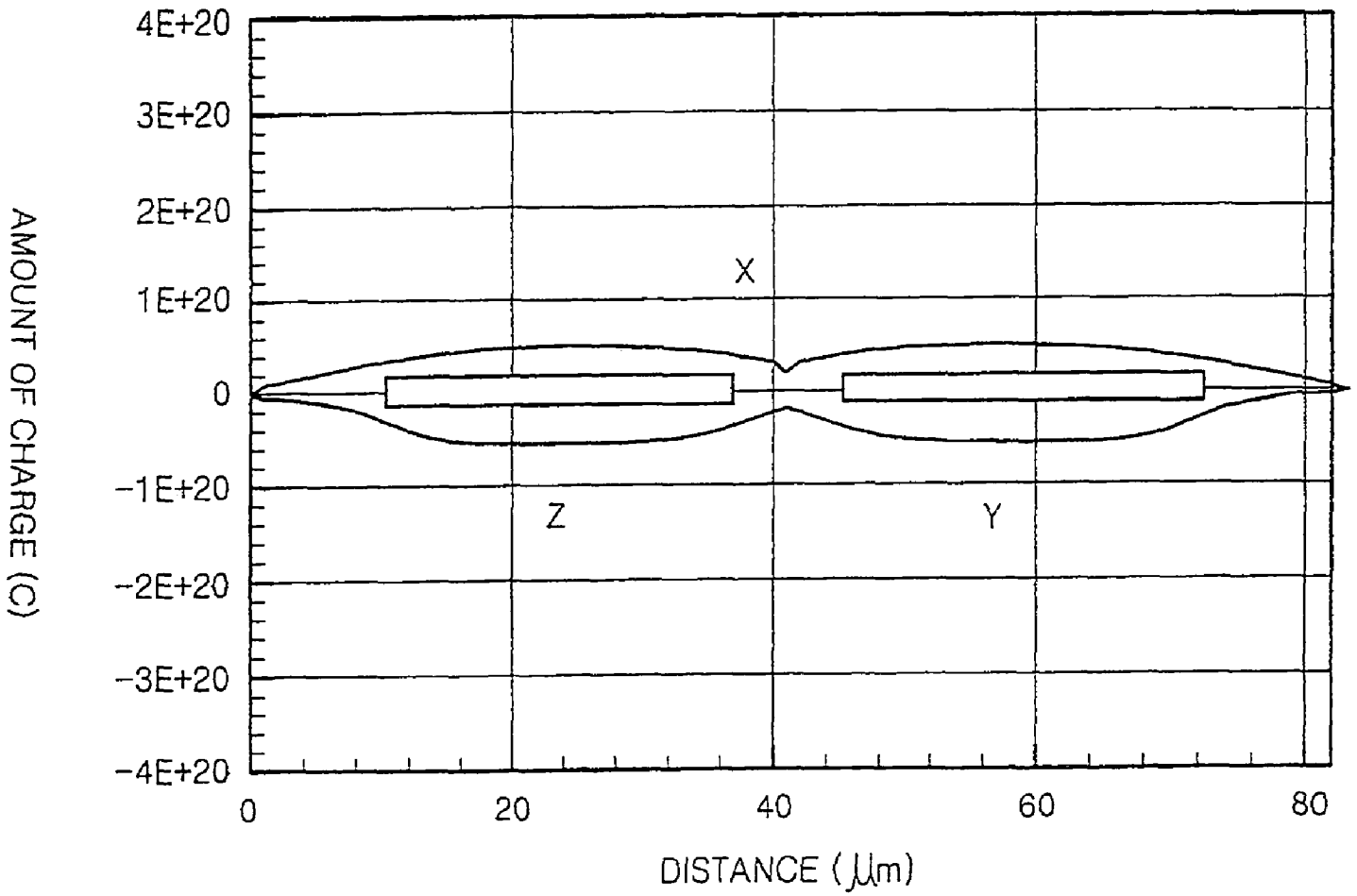
FIGS. 25A to 25P are simulation results particularly representing a change of wall charge distribution of a cell when the driving waveforms of FIG. 23 are applied to the cell.
Figure 25B:
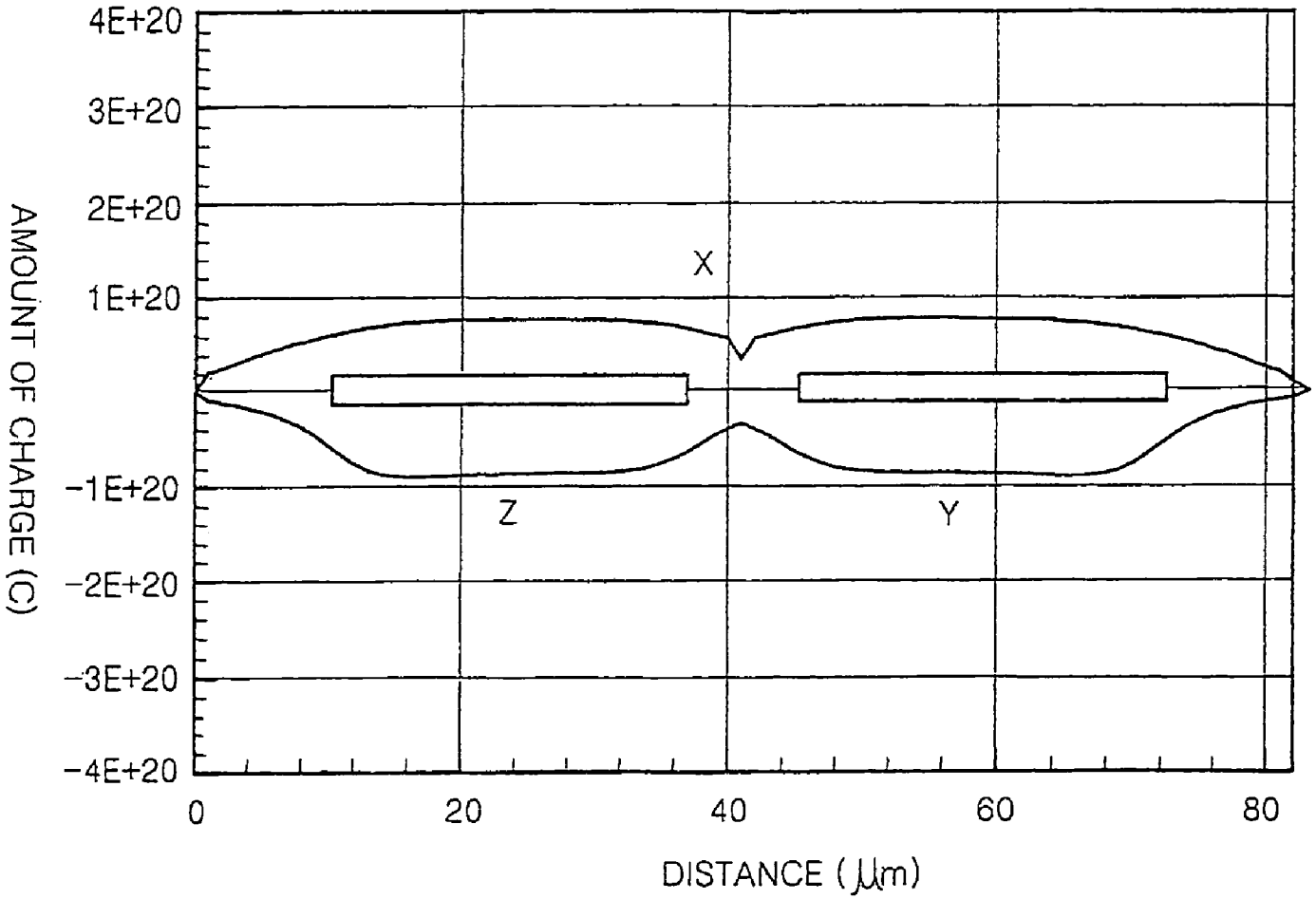
Figure 25C:
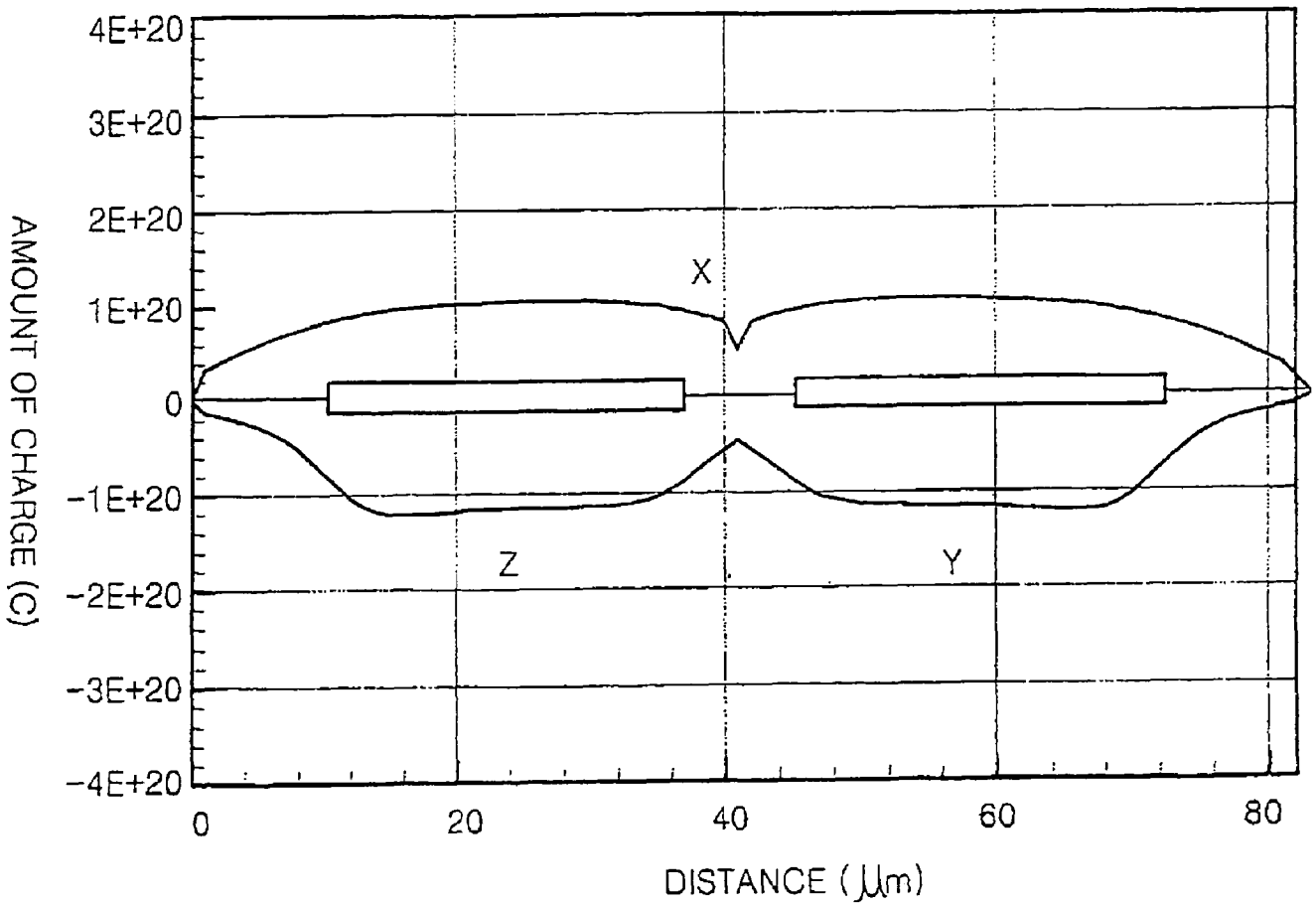
Figure 25D:
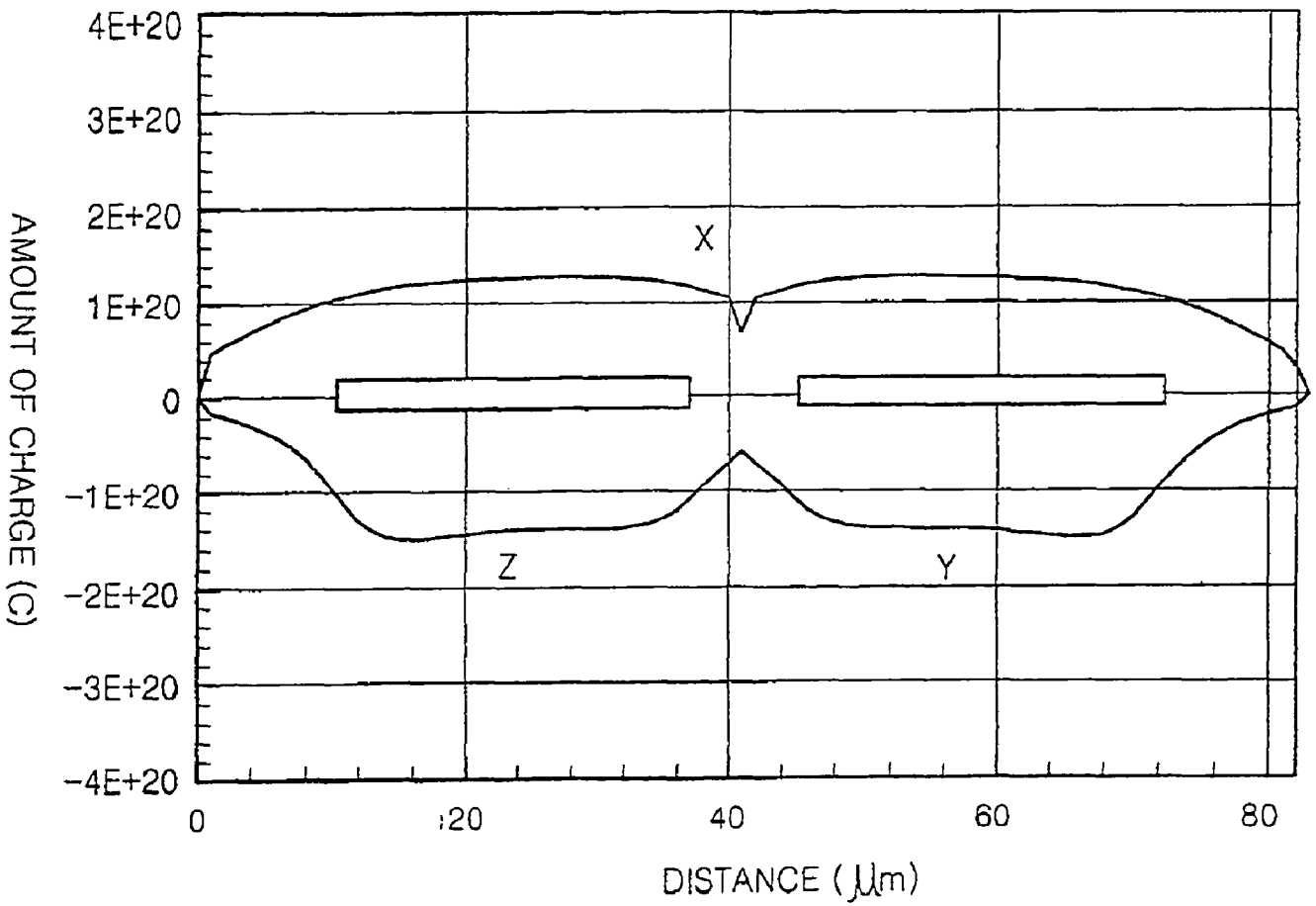
Figure 25E:
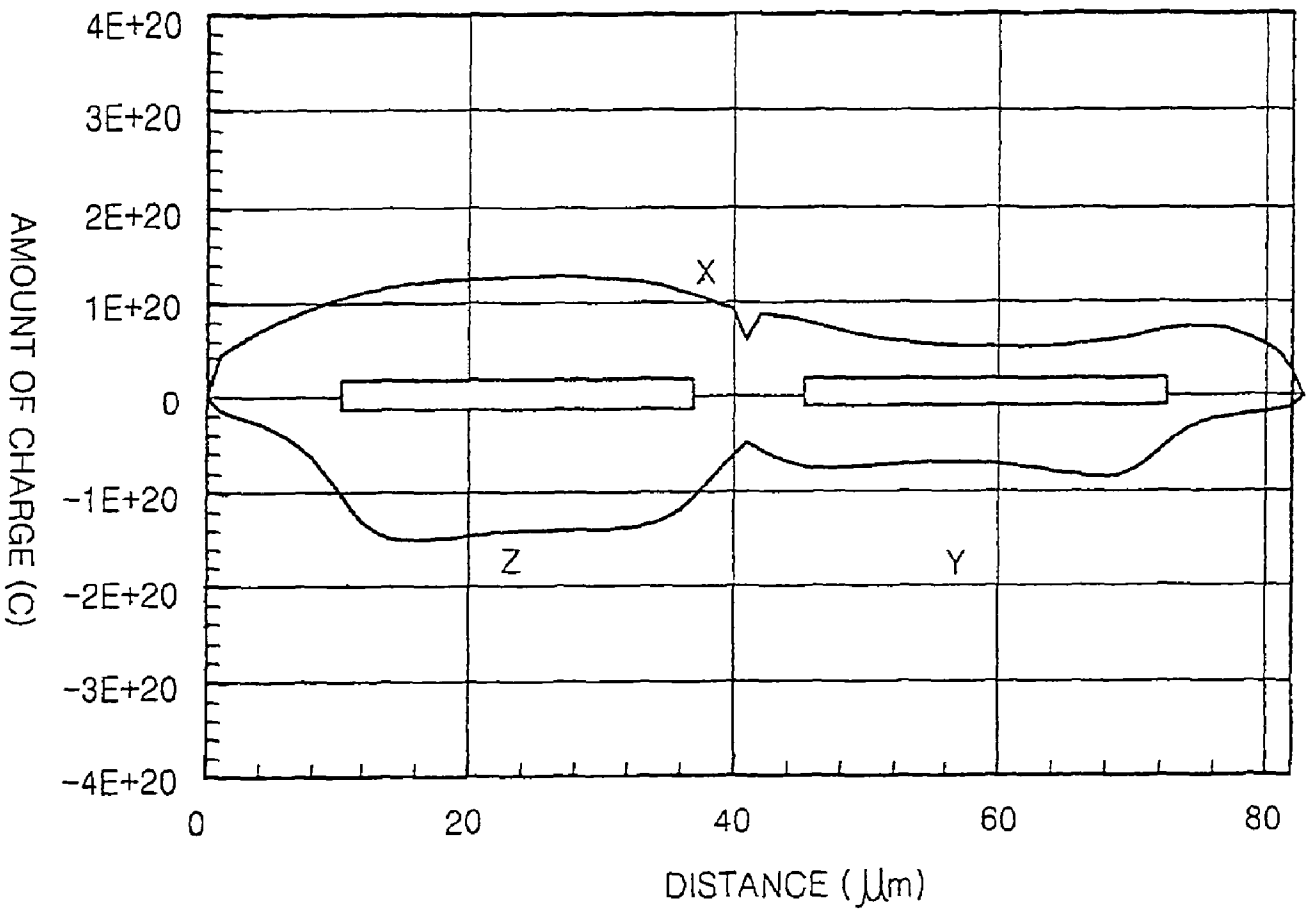
Figure 25F:
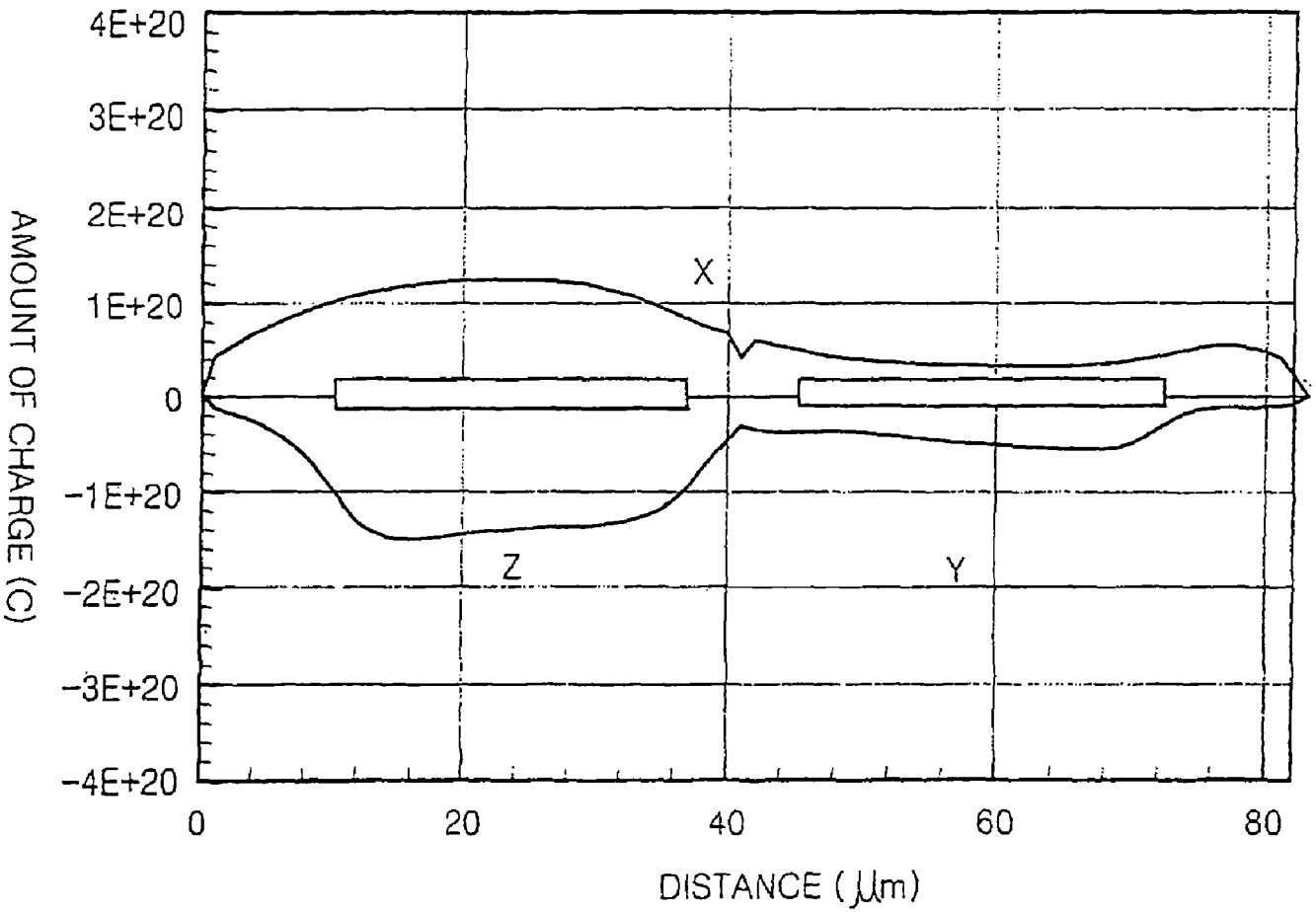
Figure 25G:
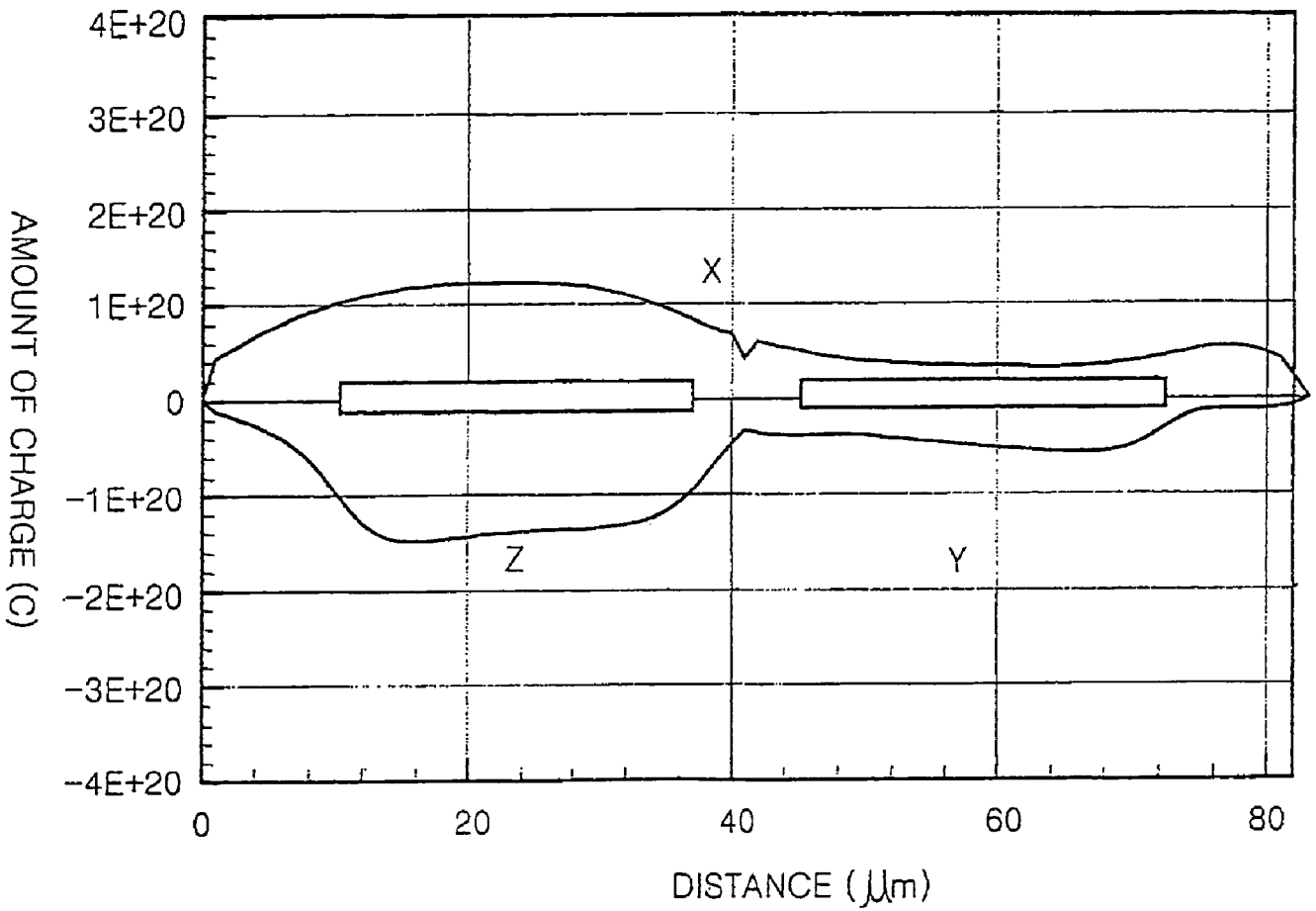
Figure 25H:
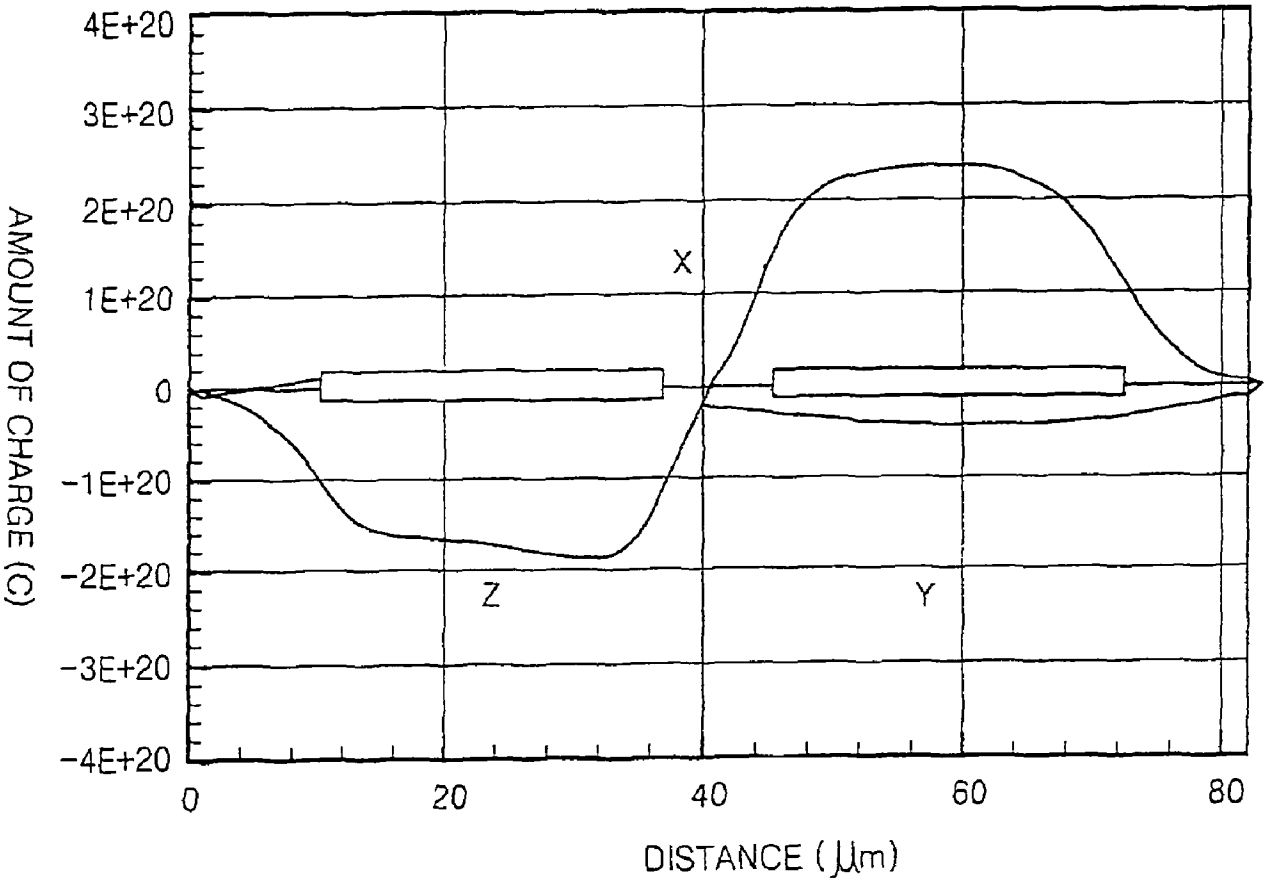
Figure 251:
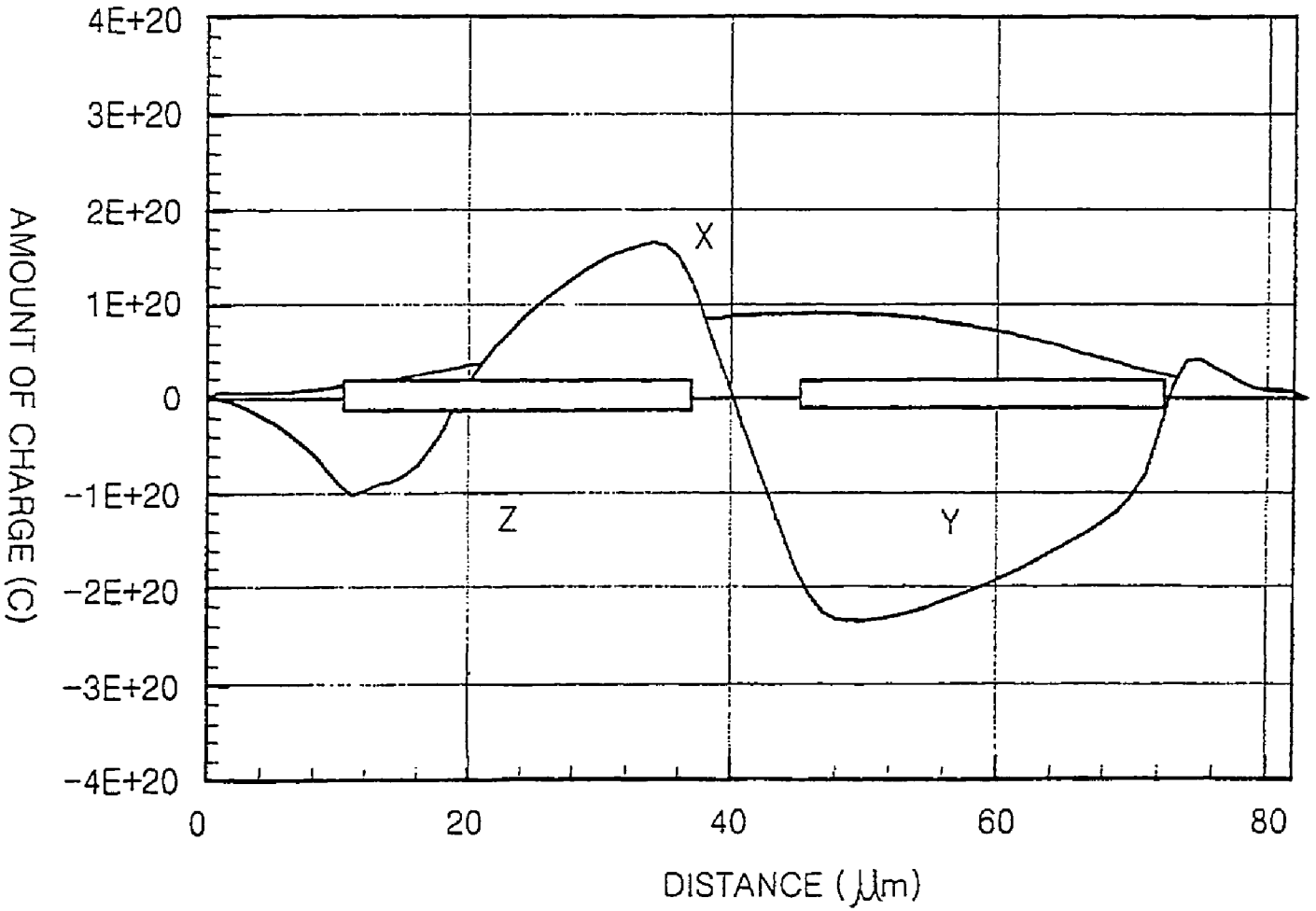
Figure 25J:
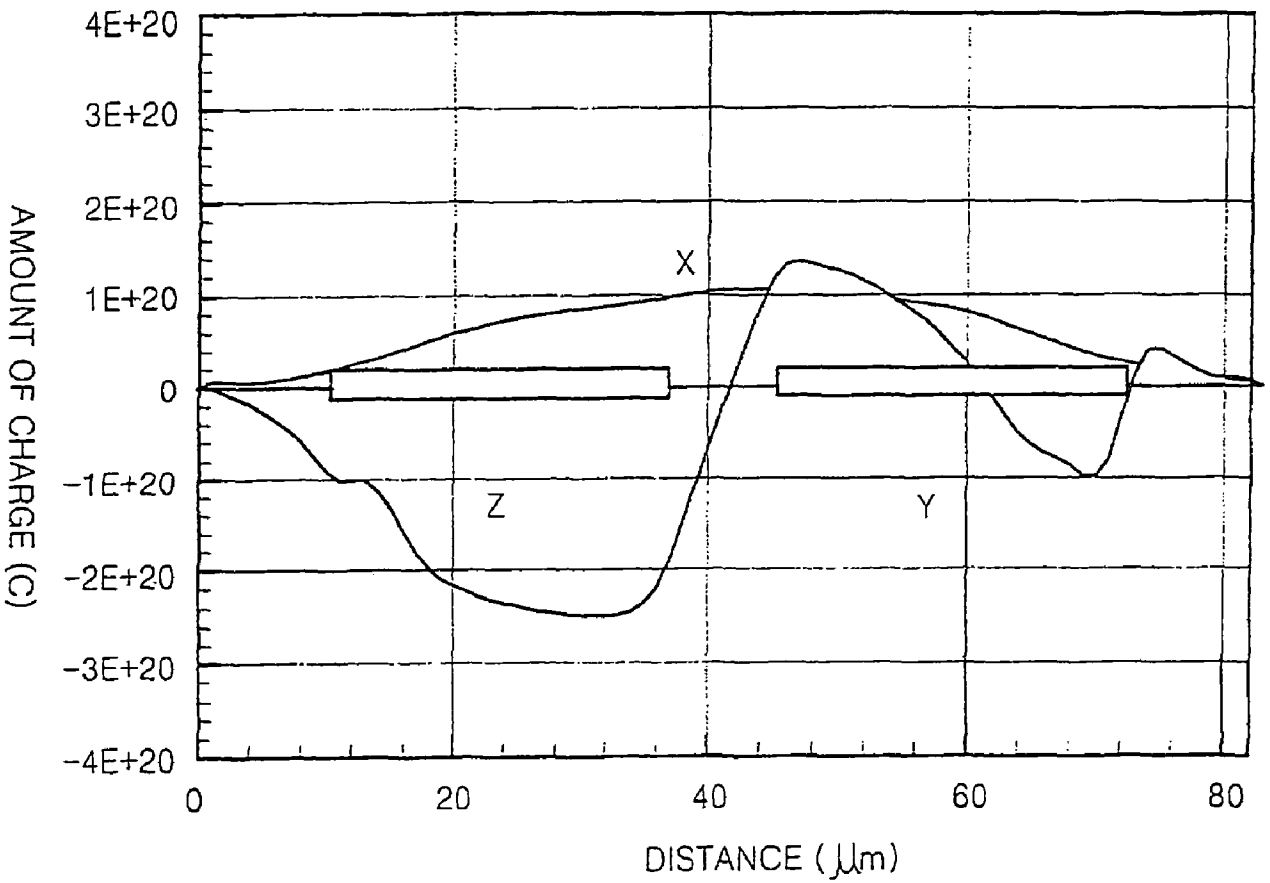
Figure 25K:
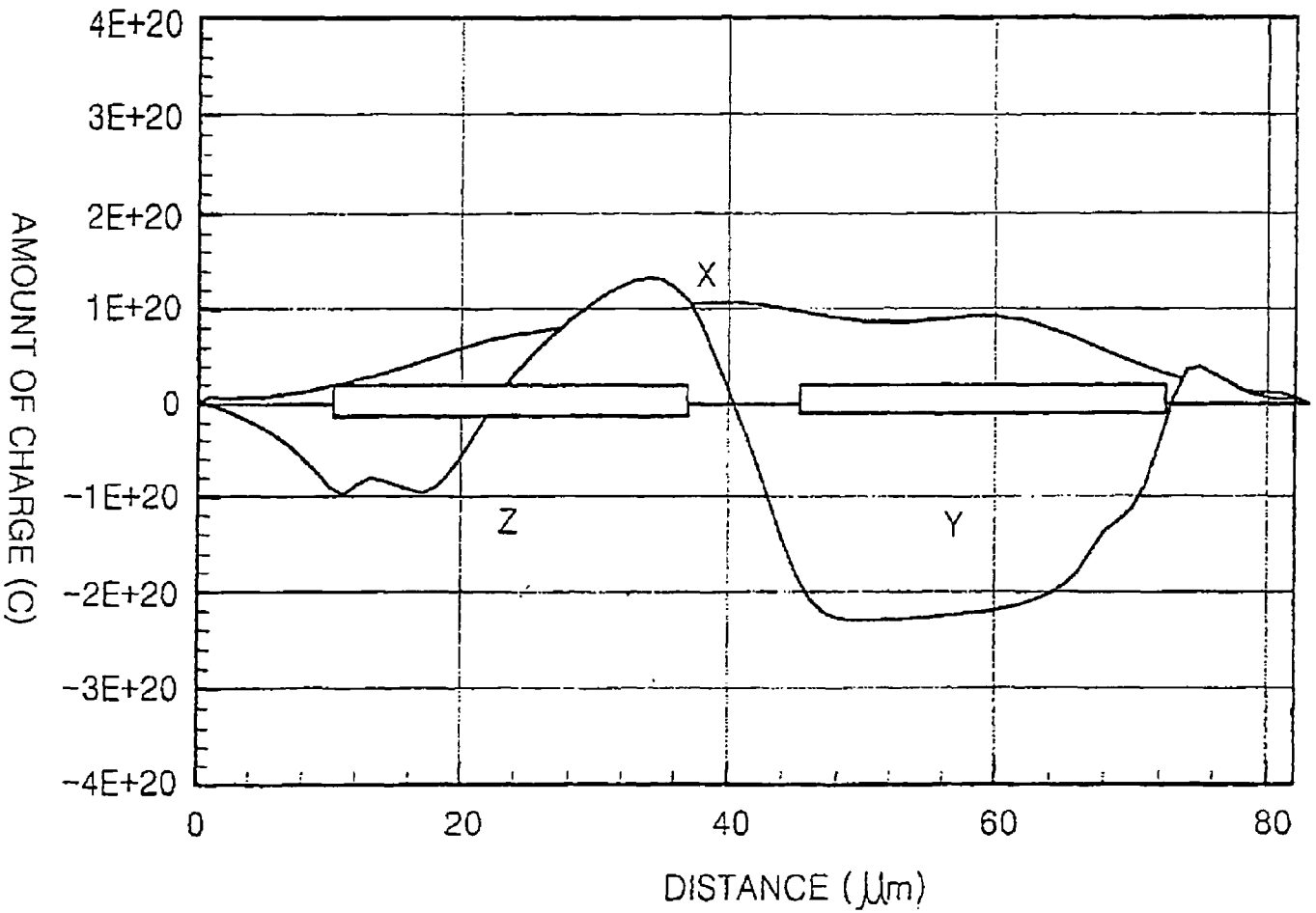
Figure 25L:
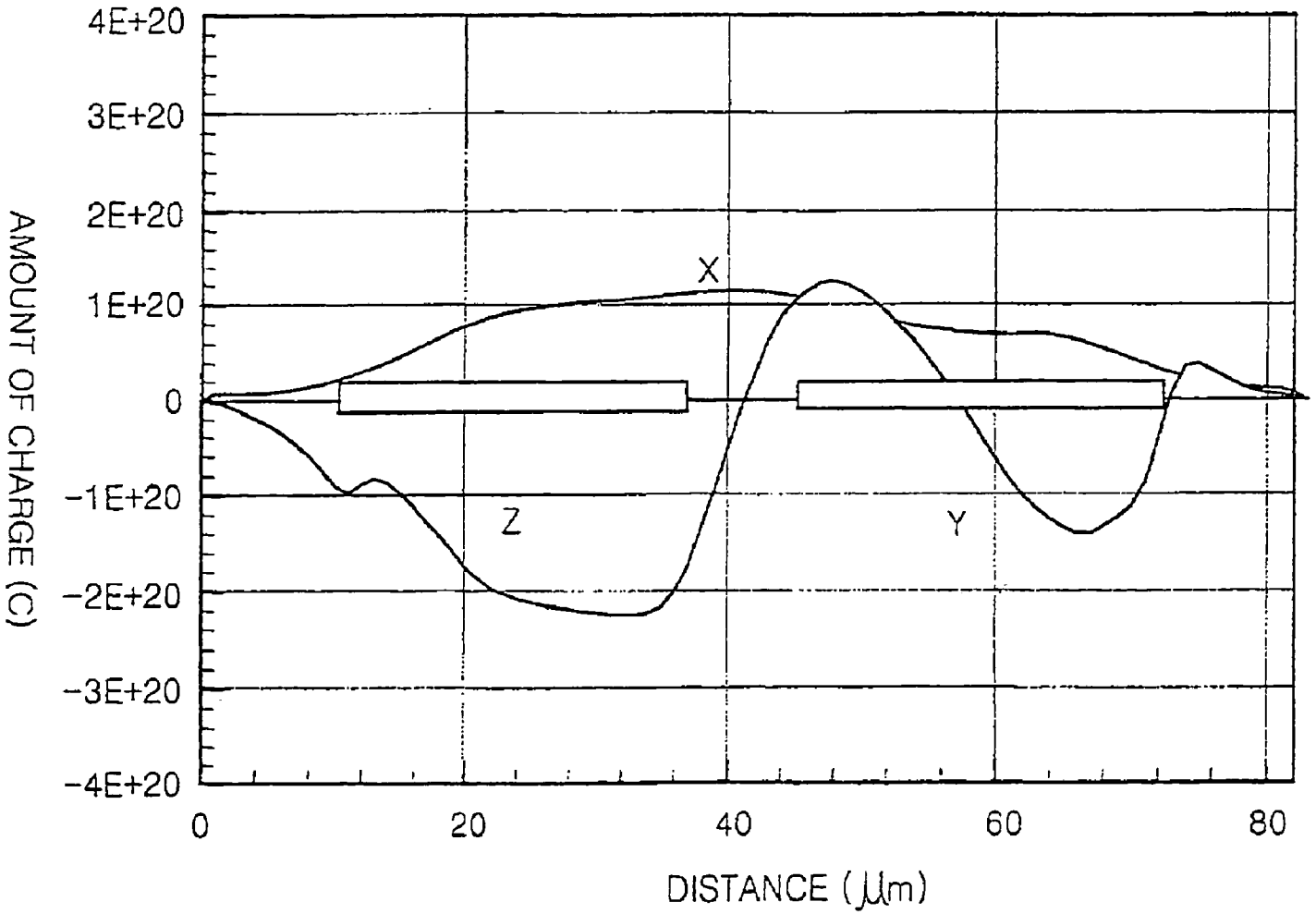
Figure 25M:
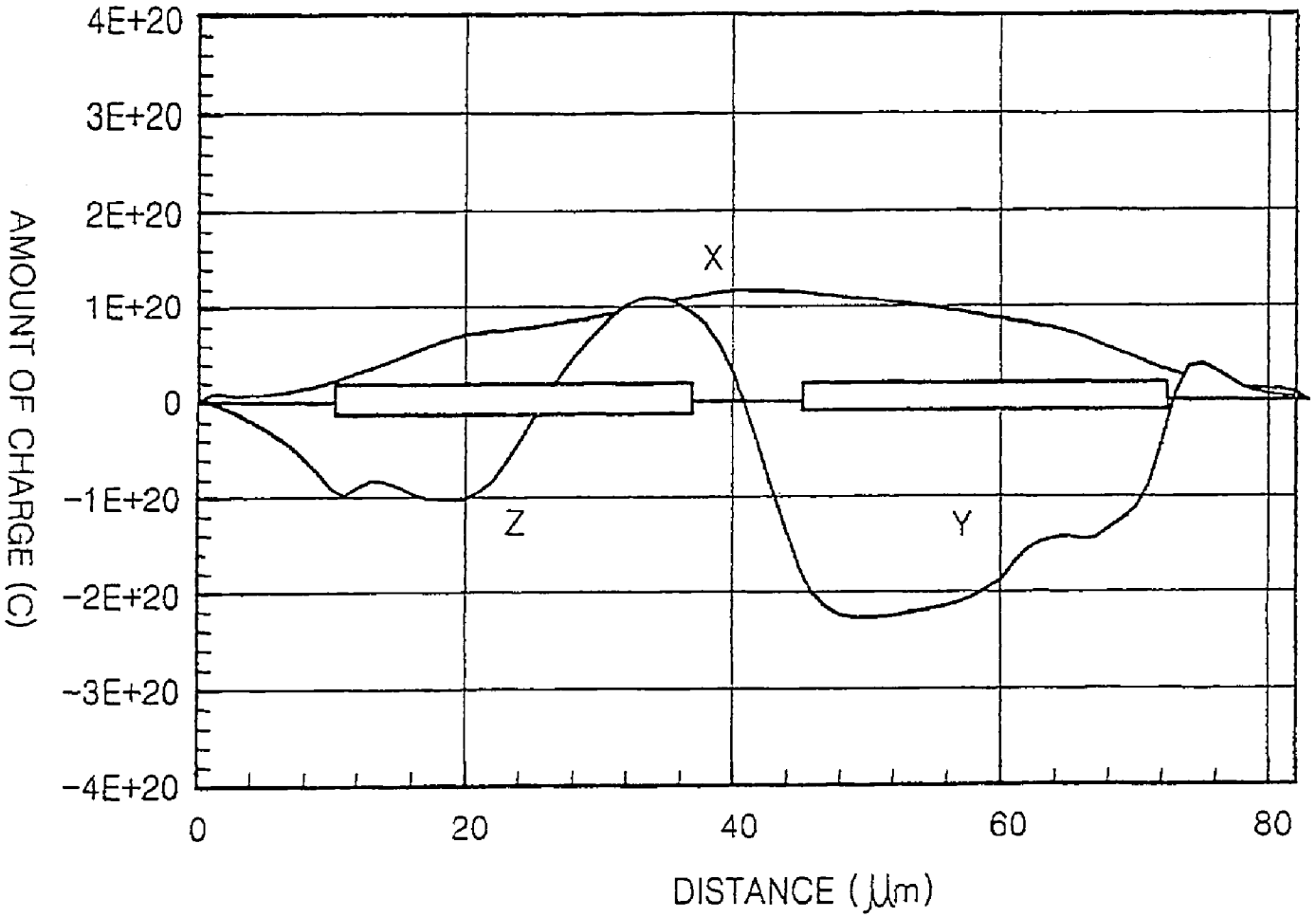
Figure 25N:
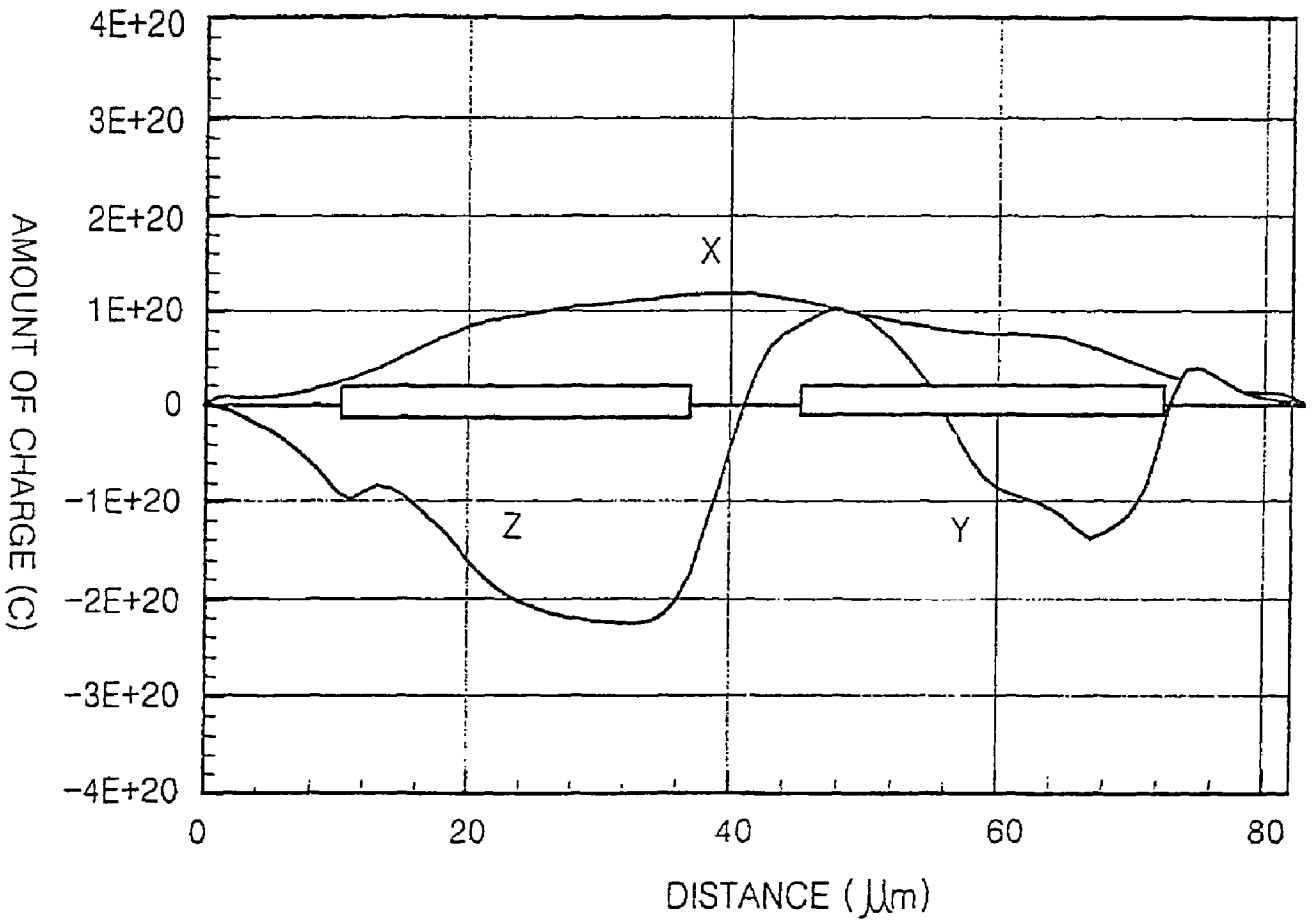
Figure 25O:
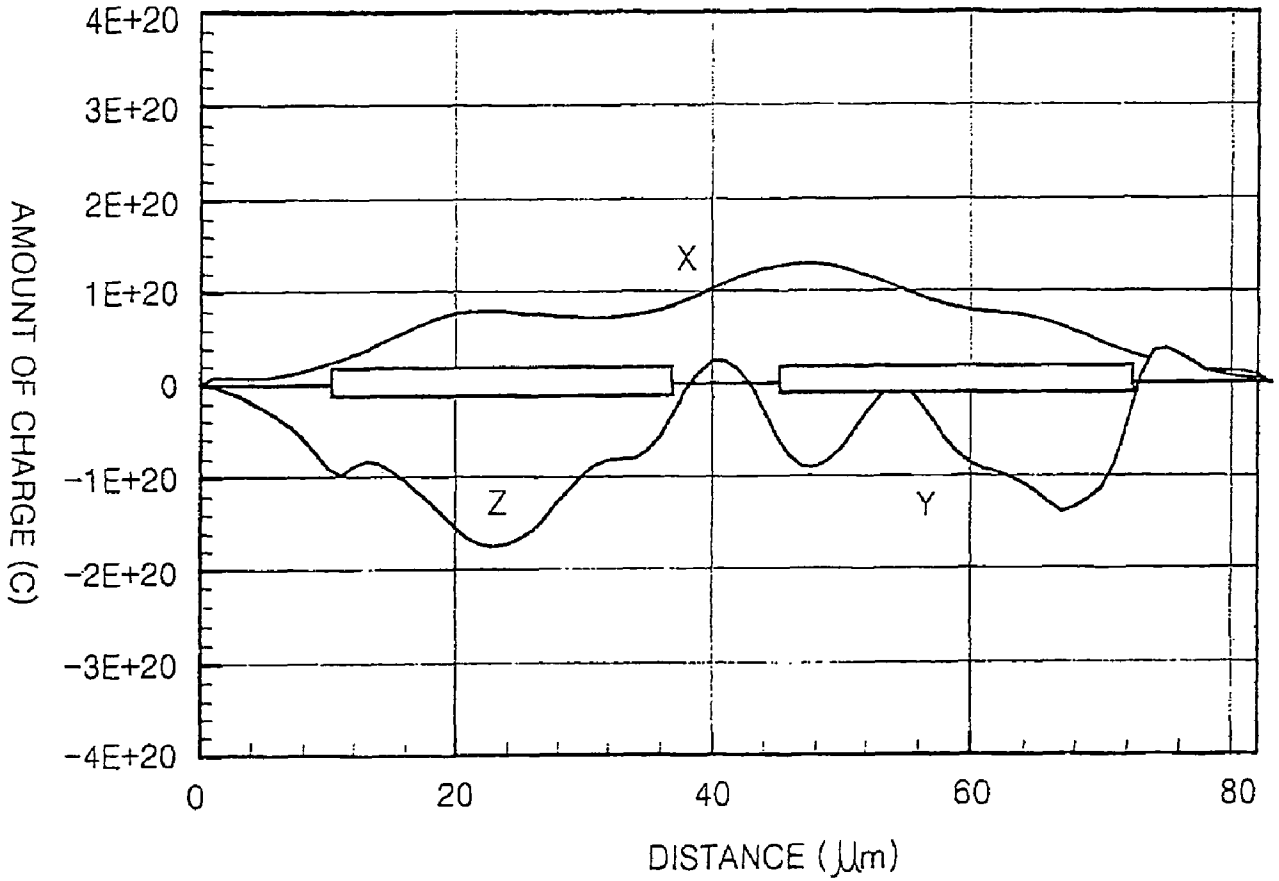
Figure 25P:
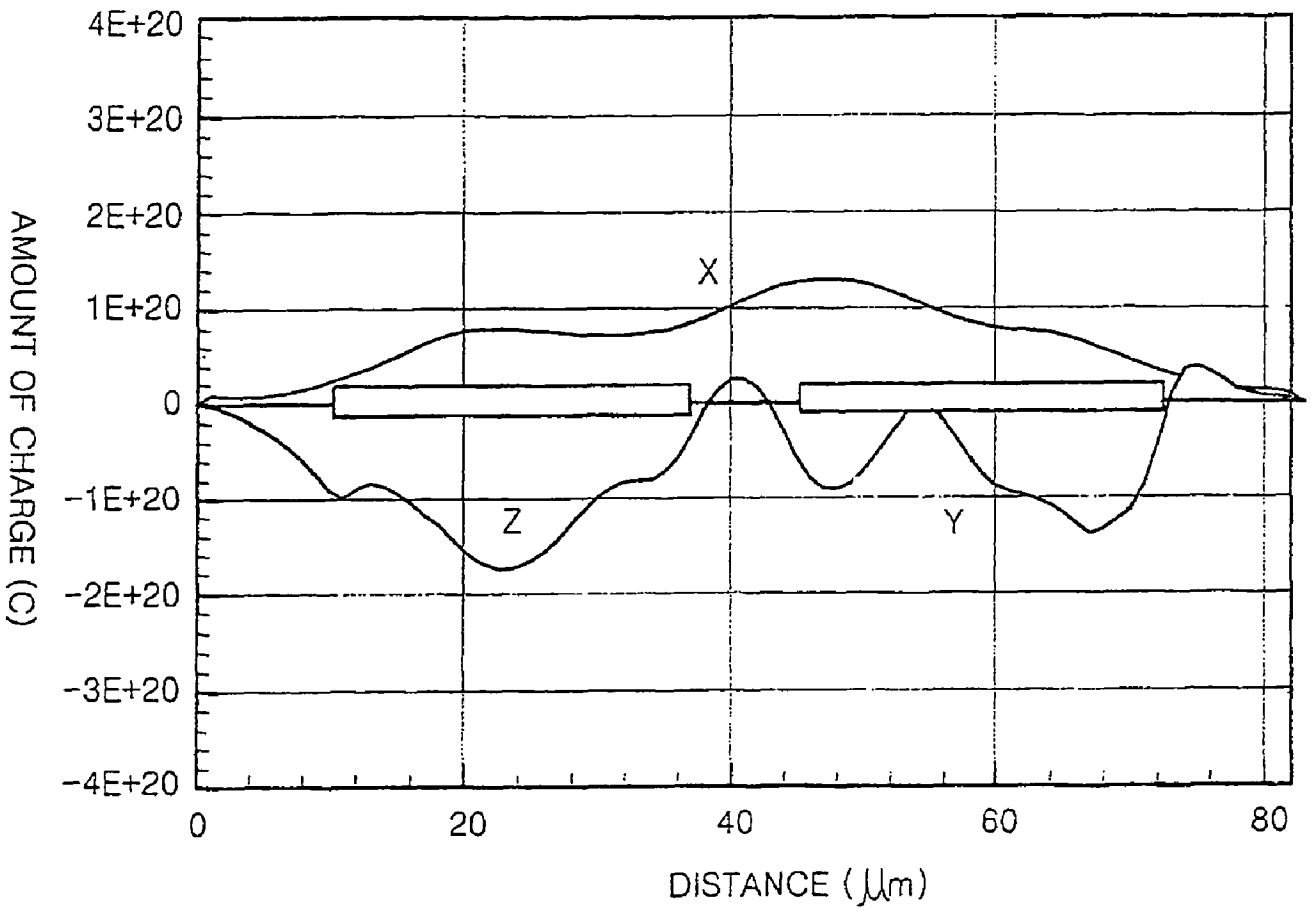

FIG. 23 is a waveform diagram explaining a driving method for a PDP according to the fourteenth embodiment of the present invention. FIG. 24 illustrates a change of wall charge distribution over time within an on-cell in the event of the application of the waveform diagram of FIG. 23. FIGS. 25A to 25P are simulation results particularly representing a change of wall charge distribution of a cell when the driving waveforms of FIG. 23 are applied to the cell. In FIGS. 25A to 25P, the axis of ordinates represents the amount of charge (C), and the horizontal axis represents distance (μm).

Referring to FIGS. 23 to 25, in the driving method of the PDP according to the present invention, the scan electrodes Y and the sustain electrodes Z are continuously supplied with the rising ramp waveform, Ramp-up, and the falling ramp waveform, Ramp-dn, to initialize the cells of the full screen.

Further, in the driving method of the PDP according to the present invention, there are allotted the address period to select the on-cells in each sub-field and the sustain period to carry out the display of the selected on-cells.

In the initialization period (reset period), all the scan electrodes Y and sustain electrodes Z are simultaneously supplied with the rising ramp waveforms, Ramp-up, that rise substantially from the sustain voltage Vs to the setup voltage Vsetup at a designated slope. At the same time, the address electrodes X are supplied with 0V or a ground voltage GND. By simultaneously applying the rising ramp waveforms to the scan electrodes Y and the sustain electrodes Z like this, dark discharges occur within the cells of the full screen, with the dark discharges generating almost no light. As a result, as shown in FIGS. 24 and 25A to 25D, the negative (−) wall charges are accumulated in each of the scan electrode Y and the sustain electrode Z, and the positive (+) wall charges are accumulated on the address electrode X. The amount of charge and the distribution characteristic of wall charges on the scan electrode Y and the sustain electrode Z, as shown in FIGS. 25A to 25D, increase symmetrically. Because the same voltage is simultaneously applied to the scan electrode Y and the sustain electrode Z, there is no potential difference between the scan electrode Y and the sustain electrode Z. The same wall charge exists in each of the scan electrode Y and the sustain electrode Z as a result of the discharge caused by the rising ramp waveform, Ramp-up, even though the previous condition of the initialization period, i.e., initial condition, is different.

Subsequently to the rising ramp waveform, Ramp-up, the falling ramp waveform, Ramp-dn, falling substantially from the sustain voltage Vs to the negative scan voltage Vscan, is simultaneously applied to the scan electrode Y and the sustain electrode Z. At this moment, the address electrode X is sustained at 0V or the ground voltage GND. The falling ramp waveform, Ramp-dn, causes the dark discharge to be generated between the scan electrode Y and the address electrode X and between the sustain electrode Z and the address electrode X. As a result of the discharge, the excessive wall charges unnecessary for the address discharge are eliminated as shown in FIGS. 24 and 25E to 25G; uniform wall charges remain within all the cells.

Generally, sub-pixels of red, green and blue have deviation in their firing voltage depending on the characteristic of phosphorus. If the falling ramp waveform is applied into the cell to cause the erase discharge, the firing condition can be made uniform regardless of the deviation of the firing voltage of the sub-pixel. Accordingly, the erase discharge by the falling ramp waveform causes the discharge condition to be uniform within all the cells to increase the driving margin.

The address period is substantially the same as in the foregoing embodiment, thus repetitive description thereof will be omitted. Within the cell selected by the address discharge, the negative wall charges are accumulated on the address electrode X opposite to the scan electrode Y as in FIG. 24. FIG. 25H represents the wall charge distribution on the scan electrode Y and the sustain electrode Z right after the address discharge.

In the sustain period, firstly, the scan electrode Y and the sustain electrode Z are sequentially supplied with the sustain pulses SUS having wide pulse width, and then the sustain electrode Z and the scan electrode X are alternately supplied with the normal sustain pulses SUS having narrow pulse width. The sustain pulses SUS having wide pulse width are sequentially applied to the scan electrode Y and the sustain electrode Z. In the on-cell selected by the address discharge, the sustain discharge, i.e., display discharge, is generated between the scan electrode Y and the sustain electrode Z whenever each sustain pulse SUS is applied, as the sustain pulse SUS is added to the wall voltage within the cell. FIGS. 25I to 25N represent changes of the wall charge distribution on the scan electrode Y and the sustain electrode Z upon the sustain discharge generated whenever each sustain pulse is applied.

In the post-erase period, the post-erase signal, Pst-ers, of rising slope are alternately applied to the scan electrode Y and the sustain electrode Z, so as to eliminate the wall charges generated by the sustain discharge. The post-erase signal, Pst-ers, eliminates the remaining charges within the cell. FIGS. 25O and 25P represent changes of the wall charge distribution on the scan electrode Y and the sustain electrode Z right after the erase discharge is generated by the post-erase signal, Pst-ers.

On the other hand, the post-erase signal, Pst-ers, can be omitted.

Figure 26:
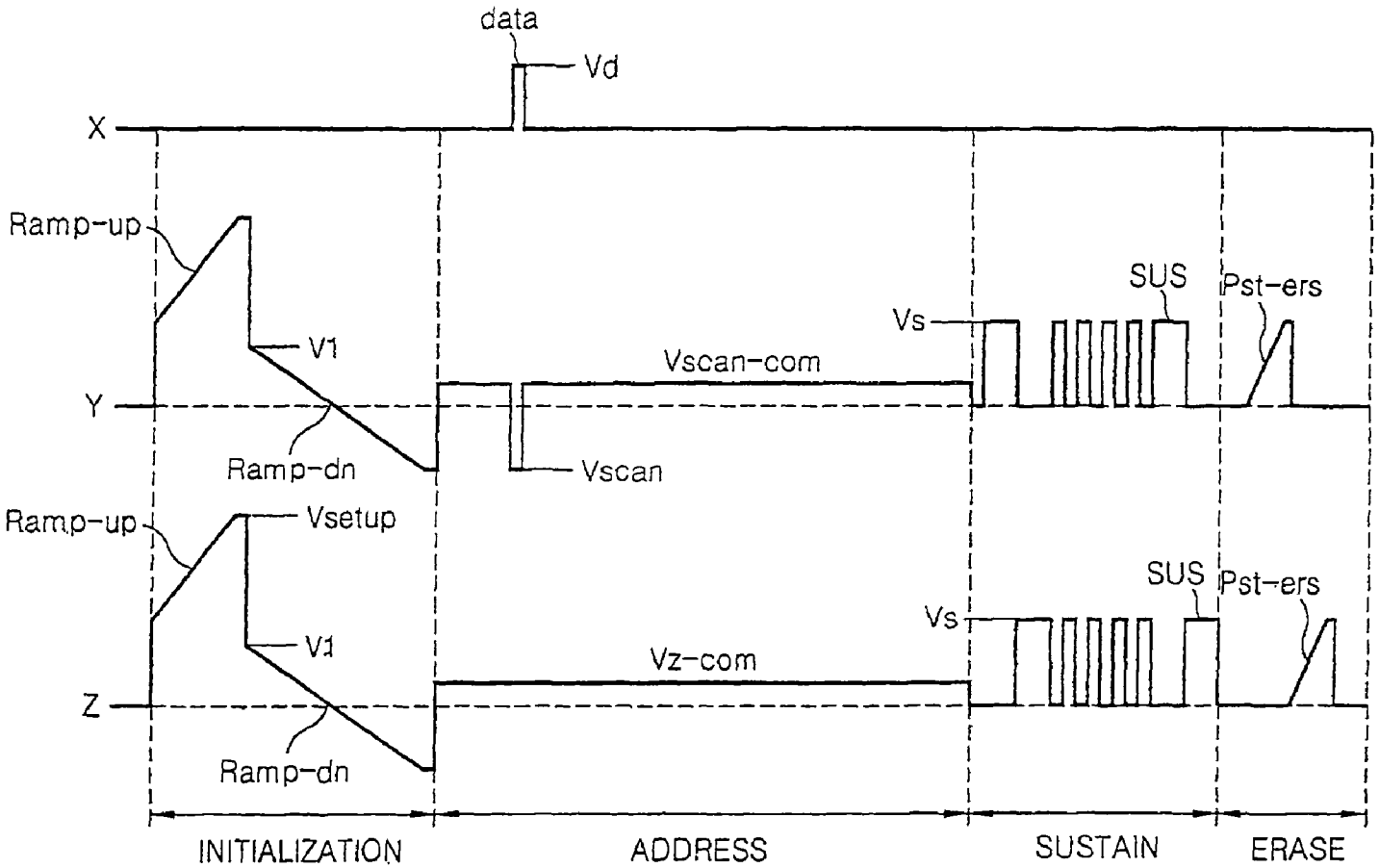
FIG. 26 is a waveform diagram explaining a driving method for a PDP according to the fifteenth embodiment of the present invention.

FIG. 26 is a waveform diagram explaining a driving waveform of a PDP according to the fifteenth embodiment of the present invention.

Referring to FIG. 26, in the driving method for the PDP according to the present invention, after applying the rising ramp waveforms, Ramp-up, to the scan electrodes Y and the sustain electrodes Z in each sub-field, the falling ramp waveforms, Ramp-dn, which drop down from the start voltage of the rising ramp waveform another voltage, are applied to the scan electrodes Y and the sustain electrodes Z to initialize the cells of the full screen.

In the initialization period (reset period), the rising ramp waveforms, Ramp-up, which rise substantially from the sustain voltage Vs to the setup voltage Vsetup at a designated slope, are simultaneously applied to the scan electrodes Y and the sustain electrodes Z. At the same time, the address electrodes X are supplied with 0V or the ground voltage GND. By simultaneously applying the rising ramp waveform, Ramp-up, to the scan electrodes Y and the sustain electrodes Z like this, a dark discharge occurs which generates almost no light within the cells of the full screen. As a result, the negative (−) wall charges are accumulated in each of the scan electrode Y and the sustain electrode Z, and the positive (+) wall charges are accumulated on the address electrode X.

Subsequently to the rising ramp waveform, Ramp-up, the falling ramp waveform, Ramp-dn, falling from a voltage V1 between substantially the sustain voltage Vs and the scan bias voltage, Vscan-com, is simultaneously applied to the scan electrode Y and the sustain electrode Z. At this moment, the address electrode X is sustained at 0V or the ground voltage GND. The falling ramp waveform, Ramp-dn, causes the dark discharge to be generated between the scan electrode Y and the address electrode X and between the sustain electrode Z and the address electrode X. As a result of the discharge, the excessive wall charges unnecessary for the address discharge are eliminated; uniform wall charges remain within all the cells.

The falling ramp waveform, Ramp-dn, has its start voltage lower than the start voltage of the rising ramp waveform, Ramp-up, unlike the related art falling ramp waveform shown in FIG. 3 or the foregoing embodiment. Because of this, the period while the falling ramp waveform, Ramp-dn, is being applied is shortened to reduce the initialization period, while the address period and the sustain period can be commensurately lengthened as much.

The address period, the sustain period and the post-erase period are substantially the same as the waveform shown in FIG. 25, thus repetitive description thereof will be omitted.

Figure 27:
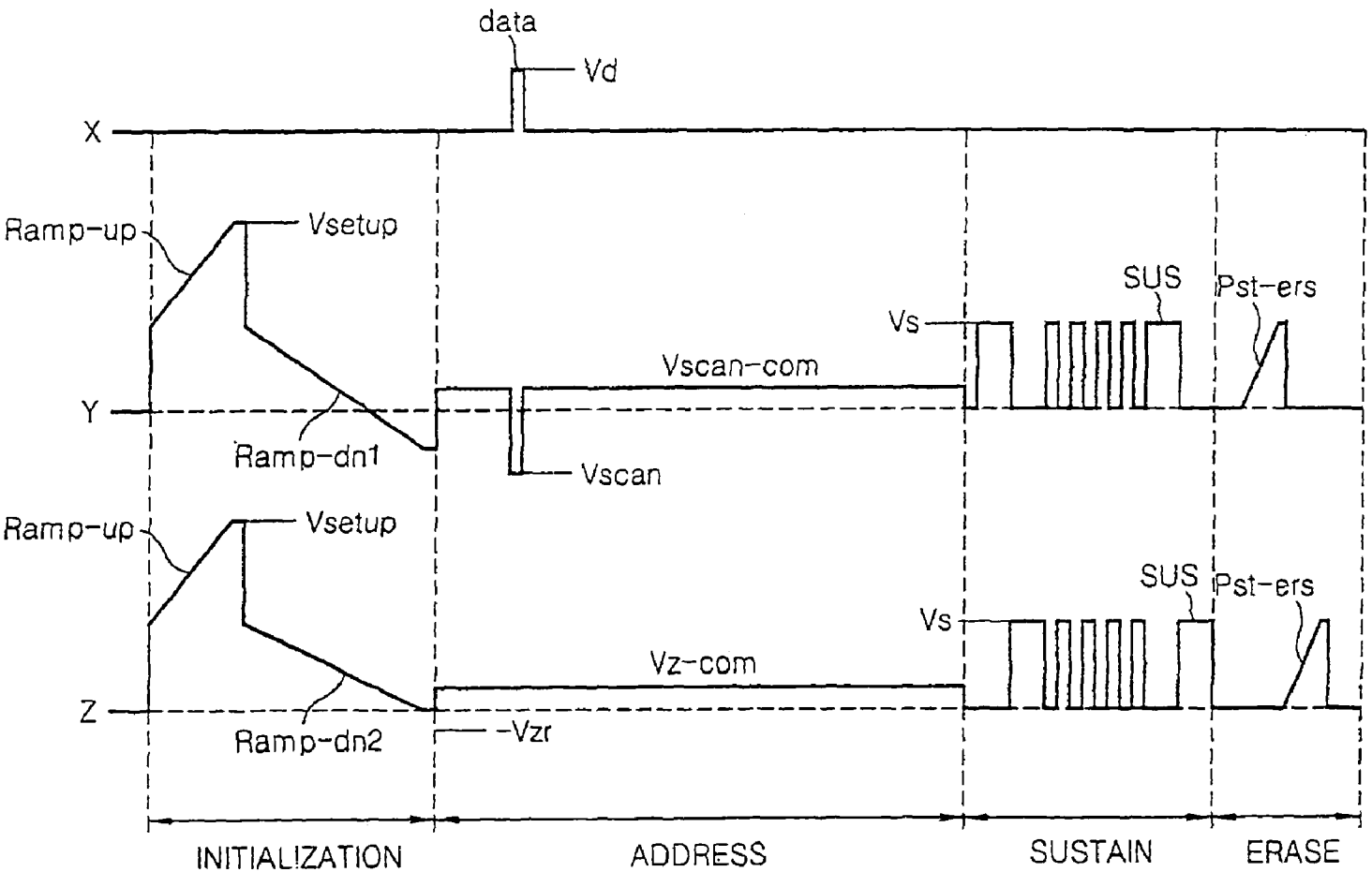
FIG. 27 is a waveform diagram representing waveforms, which are applied to a driving method for a PDP according to the sixteenth embodiment of the present invention.

FIG. 27 is a waveform diagram representing waveforms, which are applied to a driving method for a PDP according to the sixteenth embodiment of the present invention.

Referring to FIG. 27, in the driving method for the PDP according to the present invention, after applying the rising ramp waveforms, Ramp-up, to the scan electrodes Y and the sustain electrodes Z in each sub-field, the falling ramp waveforms, Ramp-dn1, Ramp-dn2, having different slopes from each other are applied to the scan electrodes Y and the sustain electrodes Z to initialize the cells of the full screen.

In the initialization period (reset period), the rising ramp waveforms, Ramp-up, which rise substantially from the sustain voltage Vs to the setup voltage Vsetup at a designated slope, are simultaneously applied to the scan electrodes Y and the sustain electrodes Z. At the same time, the address electrodes X are supplied with 0V or the ground voltage GND. The rising ramp waveform, Ramp-up, simultaneously applied to the scan electrodes Y and the sustain electrodes Z like this, causes the dark discharge, which generates almost no light, within the cells of the full screen. As a result, the negative (−) wall charges are accumulated in each of the scan electrode Y and the sustain electrode Z, and the positive (+) wall charges are accumulated on the address electrode X.

Subsequently to the rising ramp waveform, Ramp-up, a first falling ramp waveform, Ramp-dn1, falling substantially from the sustain voltage Vs is applied to the scan electrode Y and, at the same time, a second falling ramp waveform, Ramp-dn2, where a voltage falls down at its slope lower than that of the first falling ramp waveform, Ramp-dn1, is applied to the sustain electrode Z. An end voltage Vzr of the second falling ramp waveform, Ramp-dn2, is higher than that of the first falling ramp waveform, Ramp-dn1, because the slope of the second falling ramp waveform, Ramp-dn2, is lower than that of the first falling ramp waveform, Ramp-dn1. In other words, the absolute value of the end voltage of the second falling ramp waveform, Ramp-dn2, is less than that of the first falling ramp waveform, Ramp-dn1, because of the slope difference between the first falling ramp waveform, Ramp-dn1, and the second falling ramp waveform, Ramp-dn2. At this moment, the address electrode X is sustained at 0V or the ground voltage GND. The falling ramp waveforms, Ramp-dn1, Ramp-dn2, cause the dark discharge to be generated between the scan electrode Y and the address electrode X and between the sustain electrode Z and the address electrode X. As a result of the discharge, the excessive wall charges unnecessary for the address discharge are eliminated; uniform wall charges remain within all the cells.

The slope of the falling ramp waveform, Ramp-dn2, applied to the sustain electrode Z is slower than that of the falling ramp waveform, Ramp-dn1, applied to the scan electrode Y; thus the erase discharge between the sustain electrode Z and the address electrode X is generated to be in a small-scale as compared with the erase discharge between the scan electrode Y and the address electrode X. As a result, the negative wall charge remaining on the sustain electrode Z is greater than the wall charge remaining on the scan electrode Y until the sustain pulse is first applied to the scan electrode Y. Accordingly, when the sustain pulse is first applied to the scan electrode Y, the voltage difference between the scan electrode Y and the sustain electrode Z becomes larger, causing the sustain discharge to be generated more easily. Further, since the negative wall charge remaining on the sustain electrode Z is increased till the start of the sustain period, the sustain voltage Vs can be lowered more.

The address period, the sustain period and the post-erase period are substantially the same as the waveform shown in FIG. 25, thus repetitive description thereof will be omitted.

Figure 28:
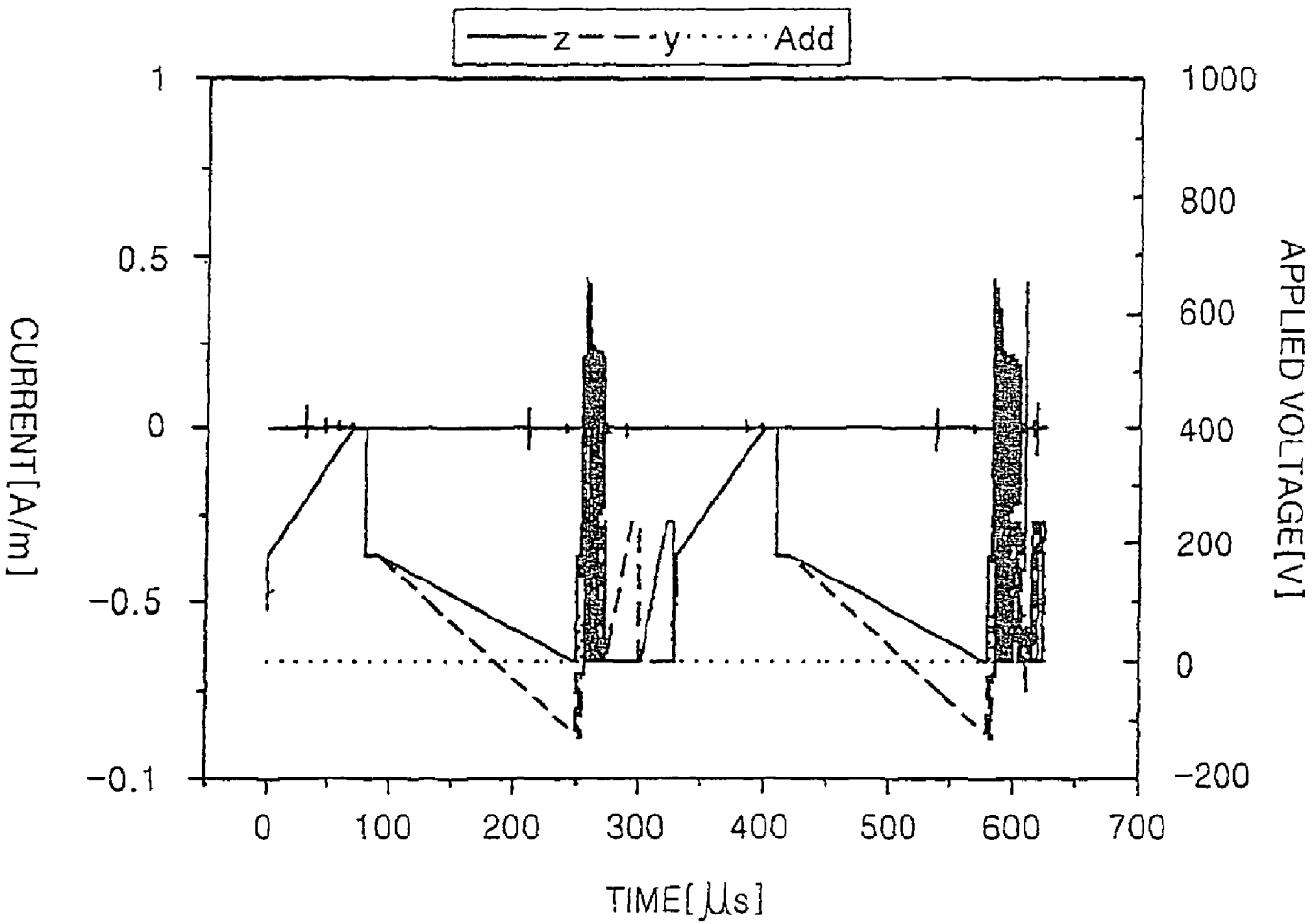
FIG. 28 illustrates a simulation result of voltage and current characteristic when applying the waveforms of FIG. 27.

FIG. 28 illustrates a simulation result of voltage and current characteristics when applying the waveforms of FIG. 27.

Figure 29:
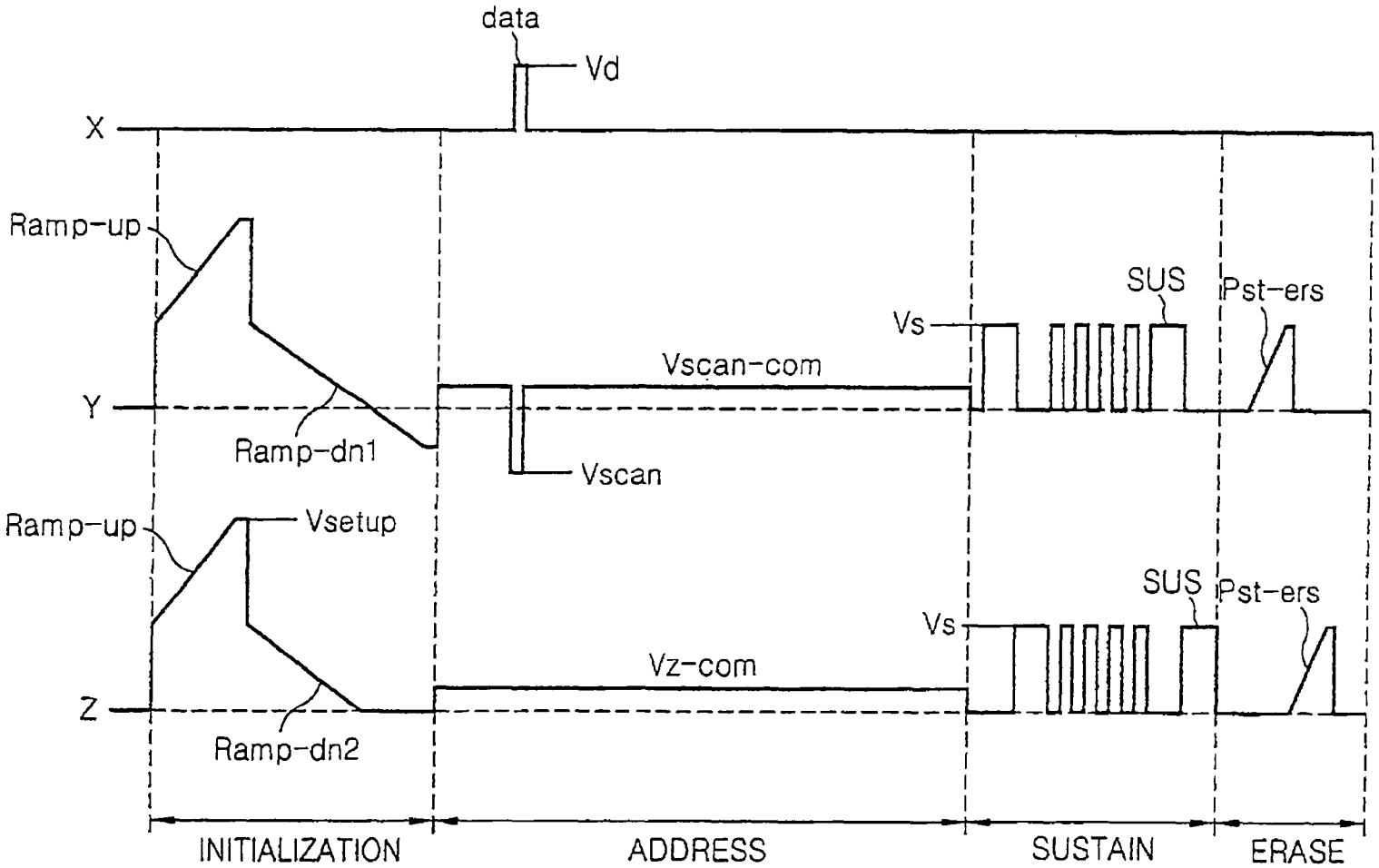
FIG. 29 is a waveform diagram representing waveforms, which are applied to a driving method for a PDP according to the seventeenth embodiment of the present invention.

FIG. 29 is a waveform diagram representing waveforms, which are applied to a driving method for a PDP according to the seventeenth embodiment of the present invention.

Referring to FIG. 29, in the driving method for the PDP according to the present invention, after applying the rising ramp waveforms, Ramp-up, to the scan electrodes Y and the sustain electrodes Z in each sub-field, the falling ramp waveforms, Ramp-dn1, Ramp-dn2, having their end voltages Vscan, Vzr different from each other are applied to the scan electrodes Y and the sustain electrodes Z to initialize the cells of the full screen.

In the initialization period (reset period), the rising ramp waveforms, Ramp-up, which rise substantially from the sustain voltage Vs to the setup voltage Vsetup at a designated slope, are simultaneously applied to the scan electrodes Y and the sustain electrodes Z. At the same time, the address electrodes X are supplied with 0V or the ground voltage GND.

The rising ramp waveform, Ramp-up, simultaneously applied to the scan electrodes Y and the sustain electrodes Z like this, causes the dark discharge, which generates almost no light, within the cells of the full screen. As a result, the negative (−) wall charges are accumulated in each of the scan electrode Y and the sustain electrode Z, and the positive (+) wall charges are accumulated on the address electrode X.

Subsequently to the rising ramp waveform, Ramp-up, a first falling ramp waveform, Ramp-dn1, falling substantially from the sustain voltage Vs is applied to the scan electrode Y and, the same time, a second falling ramp waveform, Ramp-dn2, is applied to the sustain electrode Z, wherein the second falling ramp waveform, Ramp-dn2, has its slope different from that of or the same as the first falling ramp waveform, Ramp-dn1, and has its end voltage Vzr higher than that of the first falling ramp waveform, Ramp-dn1. Because the end voltage of the second falling ramp waveform, Ramp-dn2, is higher than that of the first falling ramp waveform, Ramp-dn1, the supplying time of the second falling ramp waveform, Ramp-dn2, is shorter than that of the first falling ramp waveform, Ramp-dn1. At this moment, the address electrode X is sustained at 0V or the ground voltage GND. The falling ramp waveforms, Ramp-dn1, Ramp-dn2, cause the dark discharge to be generated between the scan electrode Y and the address electrode X and between the sustain electrode Z and the address electrode X. As a result of the discharge, the excessive wall charges unnecessary for the address discharge are eliminated; uniform wall charges remain within all the cells.

Because the end voltage Vzr of the falling ramp waveform, Ramp-dn2, applied to the sustain electrode Z is higher than that of the falling ramp waveform, Ramp-dn1, applied to the scan electrode Y, the erase discharge between the sustain electrode Z and the address electrode X is generated for a shorter period, as compared with the erase discharge between the scan electrode Y and the address electrode X. In other words, the absolute value of the end voltage of the second falling ramp waveform, Ramp-dn2, is lower than that of the first falling ramp waveform, Ramp-dn1. As a result, the amount of the negative wall charge remaining on the sustain electrode Z until the sustain pulse is first applied to the scan electrode Y is greater than the amount of the wall charge remaining on the scan electrode Y. Accordingly, the sustain discharge is generated more easily because the voltage difference between the scan electrode Y and the sustain electrode Z becomes larger as the sustain pulse is first applied to the scan electrode Y. Further, the sustain voltage Vs can be lowered by as much as the amount by which the negative wall charge remaining on the sustain electrode Z until the start of the sustain period increases.

The address period, the sustain period and the post-erase period are substantially the same as the waveform shown in FIG. 25, thus repetitive description thereof will be omitted.

Figure 30:
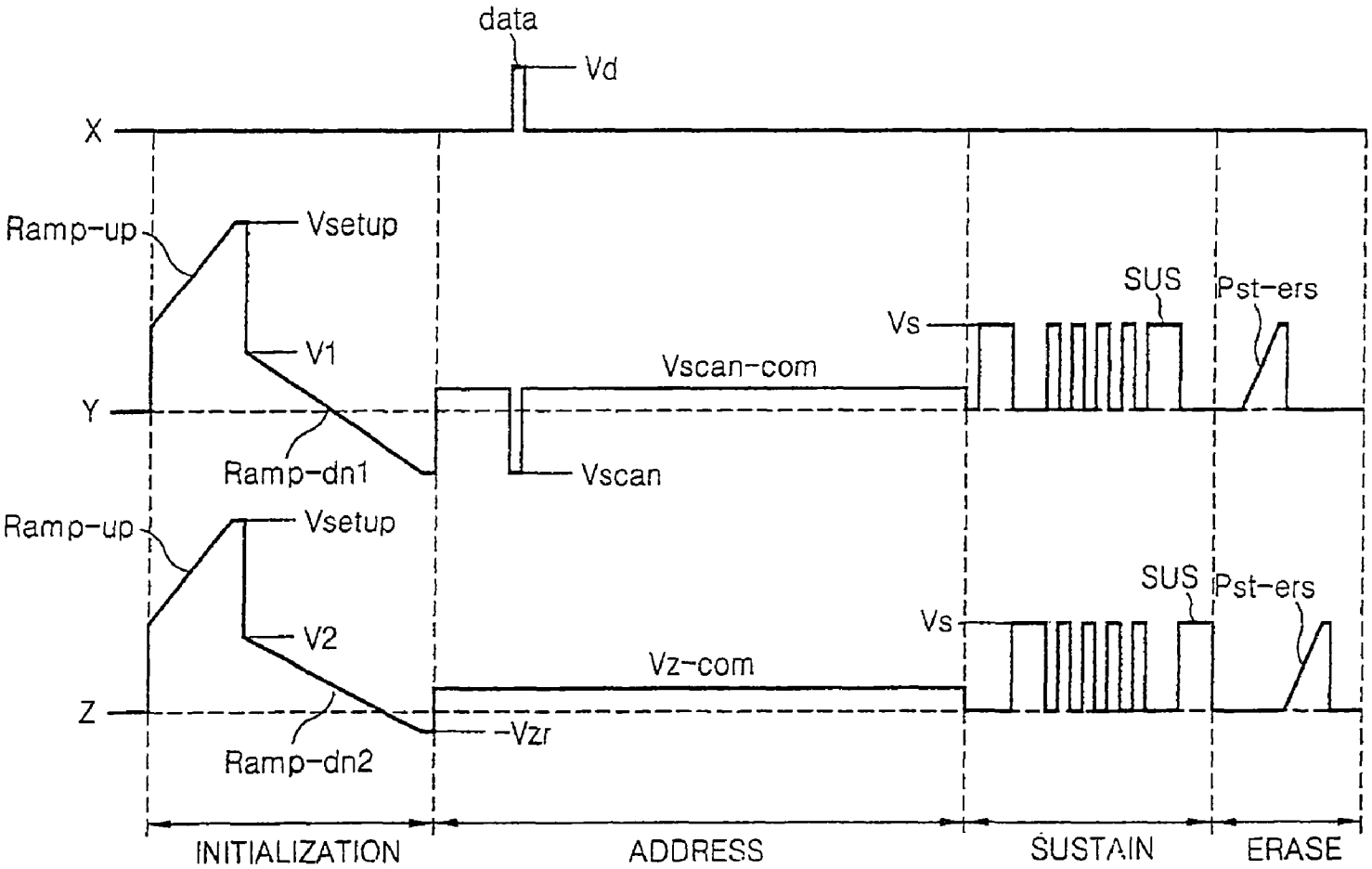
FIG. 30 is a waveform diagram representing waveforms, which are applied to a driving method for a PDP according to the eighteenth embodiment of the present invention.

FIG. 30 is a waveform diagram representing waveforms, which are applied to a driving method for a PDP according to the eighteenth embodiment of the present invention.

Referring to FIG. 30, in the driving method for the PDP according to the present invention, after applying the rising ramp waveforms, Ramp-up, to the scan electrodes Y and the sustain electrodes Z in each sub-field, the falling ramp waveforms, Ramp-dn1, Ramp-dn2, the start voltages V1, V2 of which are different from each other, are applied to the scan electrodes Y and the sustain electrodes Z to initialize the cells of the full screen.

In the initialization period (reset period), the rising ramp waveforms, Ramp-up, which rise substantially from the sustain voltage Vs to the setup voltage Vsetup at a designated slope, are simultaneously applied to the scan electrodes Y and the sustain electrodes Z. At the same time, the address electrodes X are supplied with 0V or the ground voltage GND. The rising ramp waveform, Ramp-up, simultaneously applied to the scan electrodes Y and the sustain electrodes Z like this causes the dark discharge, which generates almost no light, within the cells of the full screen. As a result, the negative (−) wall charges are accumulated in each of the scan electrode Y and the sustain electrode Z, and the positive (+) wall charges are accumulated on the address electrode X.

Subsequently to the rising ramp waveform, Ramp-up, a first falling ramp waveform, Ramp-dn1, falling from a voltage V1 between substantially the sustain voltage Vs and the scan bias voltage Vscan-com is applied to the scan electrode Y and, the same time, a second falling ramp waveform, Ramp-dn2, is applied to the sustain electrode Z, wherein the second falling ramp waveform, Ramp-dn2, has its slope and end point of time the same as the first falling ramp waveform, Ramp-dn1, and has its start voltage V2 higher than that of the first falling ramp waveform, Ramp-dn1. The start voltage of the second falling ramp waveform, Ramp-dn2, can be chosen to be nearly the sustain voltage Vs. The end voltage Vr of the second falling ramp waveform, Ramp-dn2, is higher than that of the first falling ramp waveform, Ramp-dn1, because the first and second falling ramp waveforms, Ramp-dn1, Ramp-dn2, have the same slope and different start voltages V1, V2. Because the start voltage V2 of the second falling ramp waveform, Ramp-dn2, is higher than that V1 of the first falling ramp waveform, Ramp-dn1, the voltage difference between the sustain electrode Z and the address electrode X is less than that between the scan electrode Y and the address electrode X. At this moment, the address electrode X is sustained at 0V or the ground voltage GND. The falling ramp waveforms, Ramp-dn1, Ramp-dn2, cause the dark discharge to be generated between the scan electrode Y and the address electrode X and between the sustain electrode Z and the address electrode X. As a result of the discharge, the excessive wall charges unnecessary for the address discharge are eliminated; uniform wall charges remain within all the cells.

Because the start voltage V2 of the falling ramp waveform, Ramp-dn2, applied to the sustain electrode Z is higher than that of the falling ramp waveform, Ramp-dn1, the erase discharge between the sustain electrode Z and the address electrode X is generated to be weaker than the erase discharge between the scan electrode Y and the address electrode X.

As a result, the amount of the negative wall charge remaining on the sustain electrode Z until the sustain pulse is first applied to the scan electrode Y is greater than the amount of wall charge remaining on the scan electrode Y. Accordingly, the sustain discharge is caused to be generated more easily because the voltage difference between the scan electrode Y and the sustain electrode Z becomes larger as the sustain pulse is first applied to the scan electrode Y. Further, the sustain voltage Vs can be lowered by as much as the amount by which the negative wall charge remaining on the sustain electrode Z until the start of the sustain period increases.

The address period, the sustain period and the post-erase period are substantially the same as the waveform shown in FIG. 25, thus repetitive description thereof will be omitted.

Figure 31:
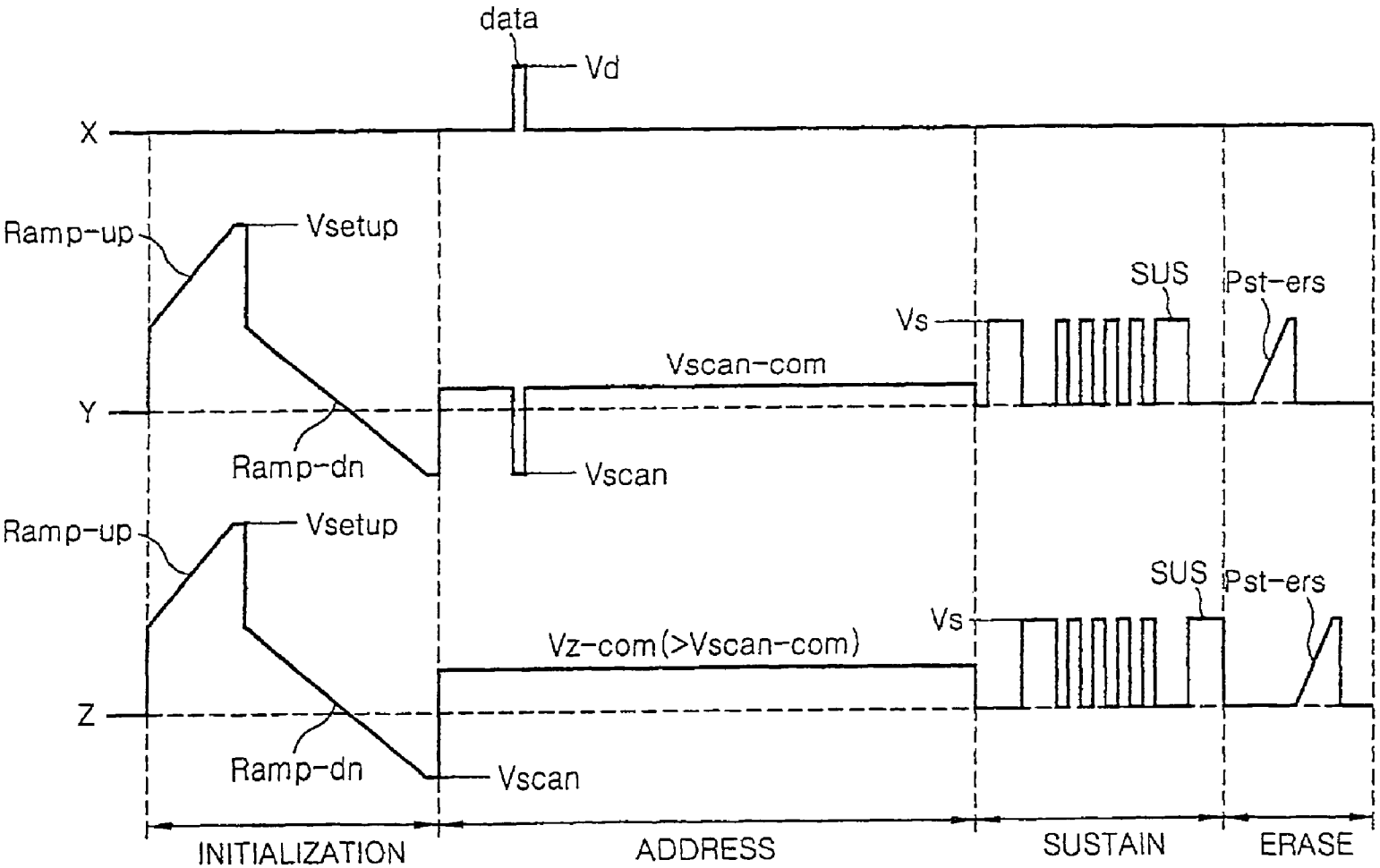
FIG. 31 is a waveform diagram explaining a driving method for a PDP according to the nineteenth embodiment of the present invention.

FIG. 31 is a waveform diagram explaining a driving waveform of a PDP according to the nineteenth embodiment of the present invention.

Referring to FIG. 31, in the driving method for the PDP according to the present invention, for the initialization period of each sub-field, the rising ramp waveform, Ramp-up, and the falling ramp waveform, Ramp-dn, are applied to the scan electrodes Y and the sustain electrodes Z to initialize the cells of the full screen. And for the address period of each sub-field, the sustain electrode Z and the scan electrode Y are supplied with the bias voltages Vscan-com, Vz-com which are different from each other.

The initialization period, the sustain period and the post-erase period are substantially the same as the waveform shown in FIG. 23, thus repetitive description thereof will be omitted.

For the address period, the scan electrode Y is supplied with the positive scan bias voltage Vscan-com, and the sustain electrode Z is supplied with the bias voltage Vz-com that is higher than the scan bias voltage Vscan-com. The negative scan pulses SCAN are sequentially applied to the scan electrodes Y and, at the same time, the address electrodes X are supplied with the positive data pulses DATA synchronized with the scan pulse SCAN, for the address period in order to select the on-cell. The voltage difference between the scan pulse SCAN and the data pulse DATA is added to the wall voltage generated during the initialization period to generate the address discharge within the on-cell to which the data pulse DATA is applied. Wall charges are formed to make it possible to cause the discharge generated within the on-cells selected by the address discharge when the sustain voltage Vs is applied. For the address period, because the bias voltage Vz-com of the sustain electrode Z is set to be higher than the bias voltage Vscan-com of the scan electrode Y, a larger amount of negative wall charge generated upon the address discharge is accumulated on the sustain electrode Z as compared with the foregoing embodiments.

The sustain discharge is generated more easily because the voltage difference between the scan electrode y and the sustain electrode Z becomes greater as the sustain pulse is first applied to the scan electrode Y because the amount of the negative wall charge on the sustain electrode Z increases. Further, the sustain voltage Vs can be lowered by as much as the amount by which the negative wall charges remaining on the sustain electrode Z until the start of the sustain period increases.

Figure 32:
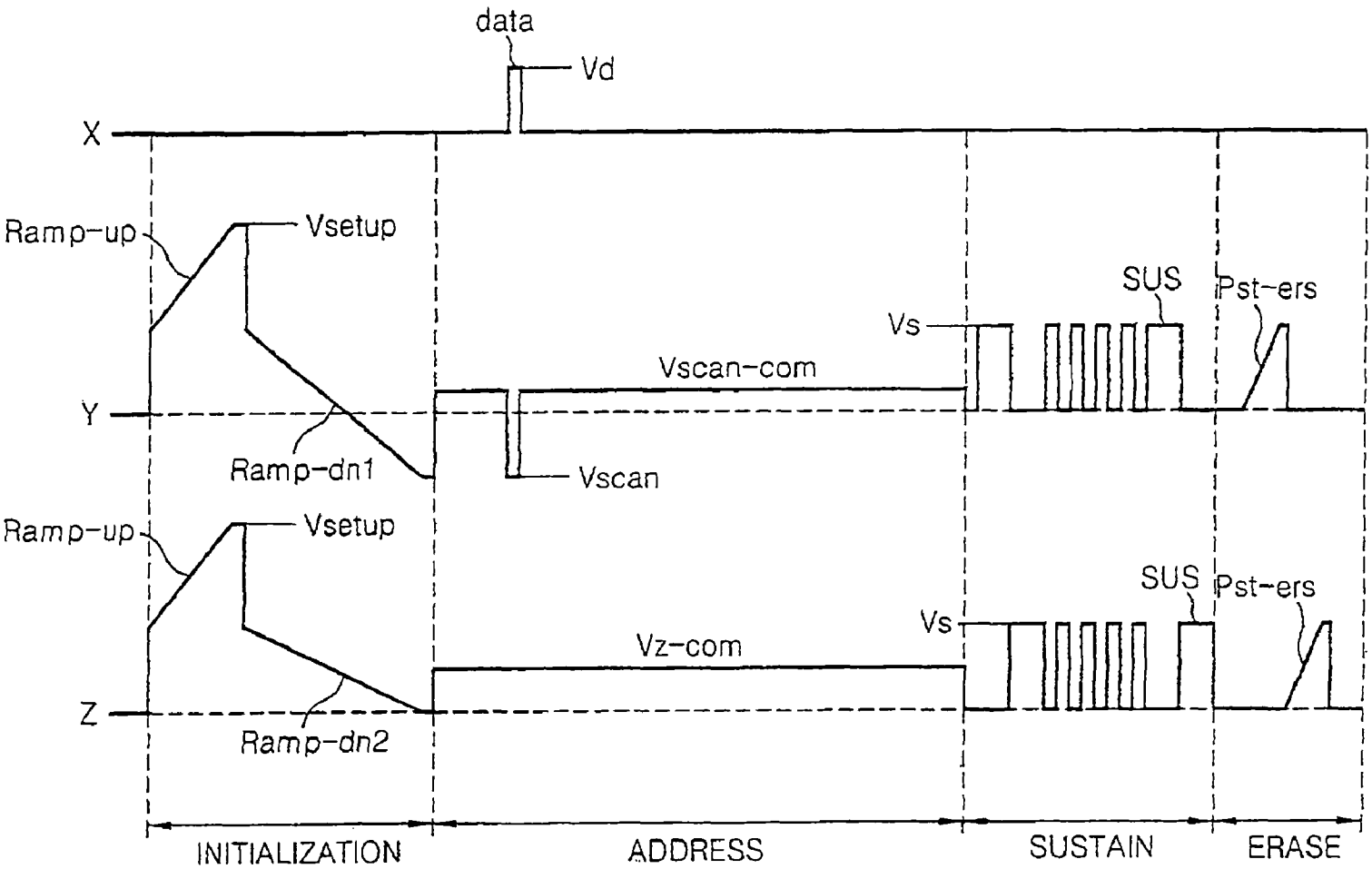
FIG. 32 is a waveform diagram representing waveforms, which are applied to a driving method for a PDP according to the twentieth embodiment of the present invention.

FIG. 32 is a waveform diagram representing waveforms, which are applied to a driving method for a PDP according to the twentieth embodiment of the present invention.

Referring to FIG. 32, in the driving method for the PDP according to the present invention, after applying the rising ramp waveforms, Ramp-up, to the scan electrodes Y and the sustain electrodes Z in each sub-field, the falling ramp waveforms, Ramp-dn1, Ramp-dn2, the slopes and end voltages Vscan, 0V, which are different from each other, are applied to the scan electrodes Y and the sustain electrodes Z to initialize the cells of the full screen.

In the initialization period (reset period), the rising ramp waveforms, Ramp-up, which rise substantially from the sustain voltage Vs to the setup voltage Vsetup at a designated slope, are simultaneously applied to the scan electrodes Y and the sustain electrodes Z. At the same time, the address electrodes X are supplied with 0V or the ground voltage GND. The rising ramp waveform, Ramp-up, simultaneously applied to the scan electrodes Y and the sustain electrodes Z like this causes the dark discharge, which generates almost no light, within the cells of the full screen. As a result, the negative (−) wall charges are accumulated in each of the scan electrode Y and the sustain electrode Z, and the positive (+) wall charges are accumulated on the address electrode X.

Subsequently to the rising ramp waveform, Ramp-up, a first falling ramp waveform, Ramp-dn1, falling substantially the sustain voltage Vs is applied to the scan electrode Y and, the same time, a second falling ramp waveform, Ramp-dn2, is applied to the sustain electrode Z, wherein the second falling ramp waveform. Ramp-dn2, falls down at a rate slower than the rate of the first falling ramp waveform, Ramp-dn1. At this moment, the address electrode X is sustained at 0V or the ground voltage GND. The falling ramp waveforms, Ramp-dn1, Ramp-dn2, cause the dark discharge to be generated between the scan electrode Y and the address electrode X and between the sustain electrode Z and the address electrode X. As a result of the discharge, the excessive wall charges unnecessary for the address discharge are eliminated; uniform wall charges remain within all the cells.

The second falling ramp waveform, Ramp-dn2, of this embodiment is similar to the falling ramp waveform, Ramp-dn2, of the foregoing FIG. 27, but its end voltage is set at 0V or the ground voltage. GND to be higher than that of the falling ramp waveform, Ramp-dn2, of FIG. 27. Accordingly, in this embodiment, the amount of negative wall charge remaining on the sustain electrode Z is greater than that of the driving waveform shown in FIG. 27 before the sustain discharge starts.

Figure 33:
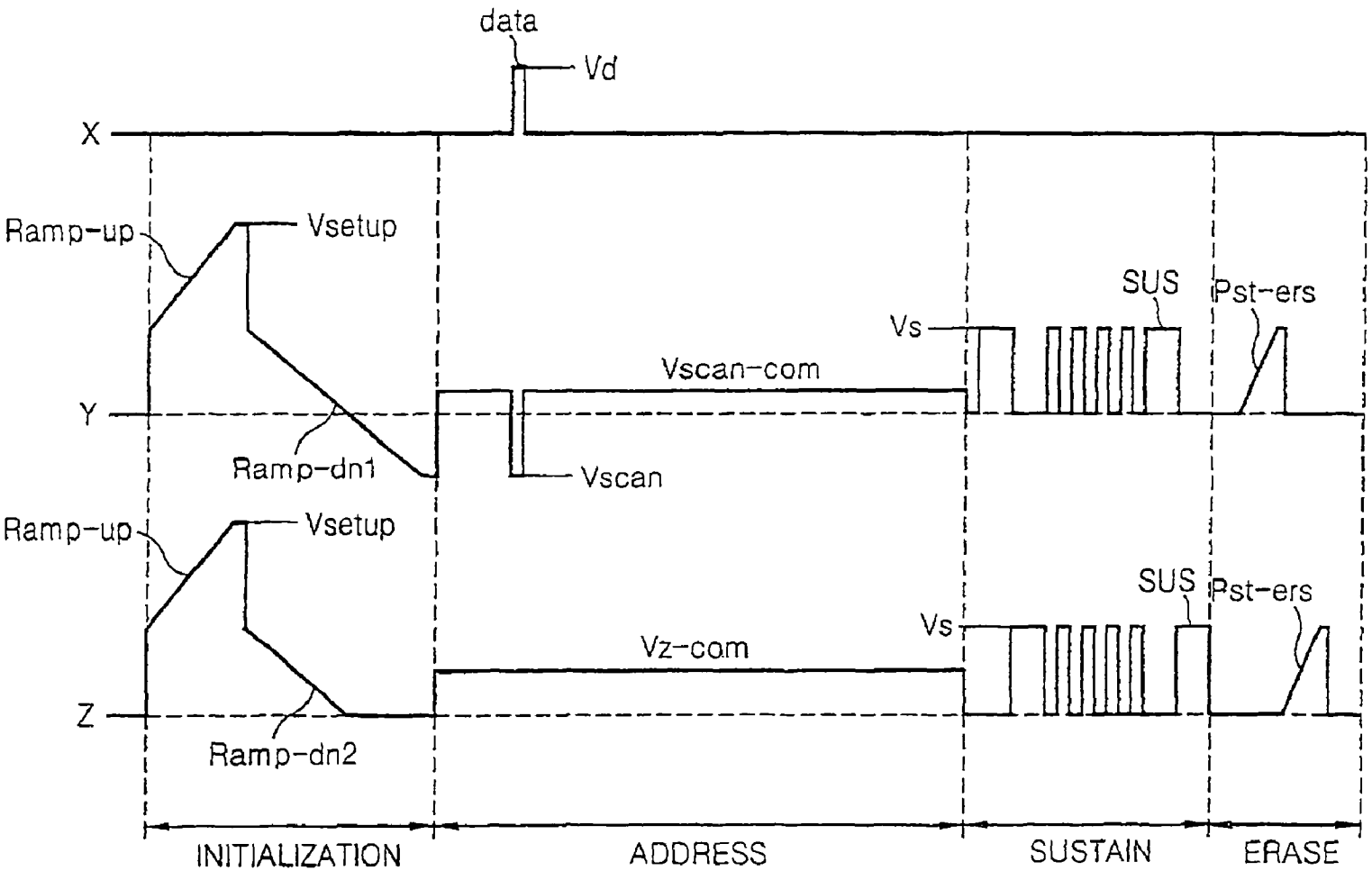
FIG. 33 is a waveform diagram representing waveforms, which are applied to a driving method for a PDP according to the twenty-first embodiment of the present invention.

FIG. 33 is a waveform diagram representing waveforms, which are applied to a driving method for a PDP according to the twenty-first embodiment of the present invention.

Referring to FIG. 33, in the driving method for the PDP according to the present invention, after applying the rising ramp waveforms, Ramp-up, to the scan electrodes Y and the sustain electrodes Z in each sub-field, the falling ramp waveforms, Ramp-dn1, Ramp-dn2, having their end voltages Vscan, 0V different from each other are applied to the scan electrodes Y and the sustain electrodes Z to initialize the cells of the full screen.

In the initialization period (reset period), the rising ramp waveforms, Ramp-up, which rise substantially from the sustain voltage Vs to the setup voltage Vsetup at a designated slope, are simultaneously applied to the scan electrodes Y and the sustain electrodes Z. At the same time, the address electrodes X are supplied with 0V or the ground voltage GND. The rising ramp waveform, Ramp-up, simultaneously applied to the scan electrodes Y and the sustain electrodes Z like this, causes the dark discharge, which generates almost no light, within the cells of the full screen. As a result, the negative (−) wall charges are accumulated in each of the scan electrode Y and the sustain electrode Z, and the positive (+) wall charges are accumulated on the address electrode X.

Subsequently to the rising ramp waveform, Ramp-up, a first falling ramp waveform, Ramp-dn1, falling substantially from the sustain voltage Vs is applied to the scan electrode Y and, the same time, a second falling ramp waveform, Ramp-dn2, is applied to the sustain electrode Z, wherein the second falling ramp waveform, Ramp-dn2, has its slope different from that of or the same as the first falling ramp waveform, Ramp-dn1, and has its voltage level fall to 0V or the ground voltage GND. The start voltage of the second falling ramp waveform, Ramp-dn2, can be chosen to be nearly the sustain voltage Vs in the same way as the first falling ramp waveform, Ramp-dn1, or can be different therefrom. Because the end voltage of the second falling ramp waveform, Ramp-dn2, is higher than that of the first falling ramp waveform, Ramp-dn1, the supplying time of the second falling ramp waveform, Ramp-dn2 is shorter than that of the first falling ramp waveform, Ramp-dn1. At this moment, the address electrode X is sustained at 0V or the ground voltage GND. The falling ramp waveforms, Ramp-dn1, Ramp-dn2, cause the dark discharge to be generated between the scan electrode Y and the address electrode X and between the sustain electrode Z and the address electrode X. As a result of the discharge, the excessive wall charges unnecessary for the address discharge are eliminated; uniform wall charges remain within all the cells.

The second falling ramp waveform, Ramp-dn2, of this embodiment is similar to the falling ramp waveform, Ramp-dn2, of the foregoing FIG. 29, but its end voltage is set at 0V or the ground voltage GND to be higher than that of the falling ramp waveform, Ramp-dn2, of FIG. 29. Accordingly, in this embodiment, the amount of negative wall charge remaining on the sustain electrode Z is greater than that of the driving waveform shown in FIG. 29 before the sustain discharge starts.

Figure 34:
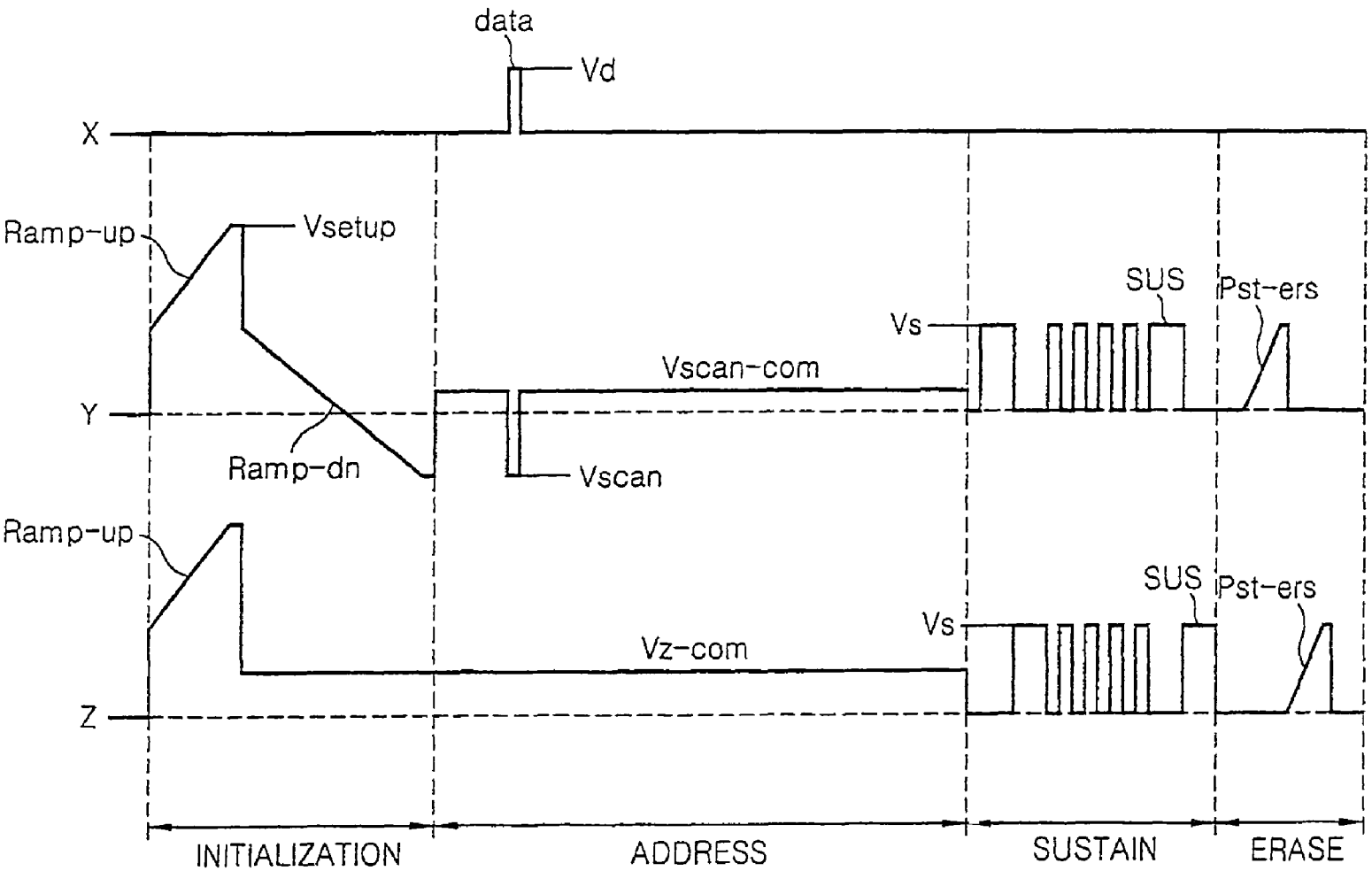
FIG. 34 is a waveform diagram representing waveforms, which are applied to a driving method for a PDP according to the twenty-second embodiment of the present invention.

FIG. 34 is a waveform diagram representing waveforms, which are applied to a driving method for a PDP according to the twenty-second embodiment of the present invention.

Referring to FIG. 34, in the driving method for the PDP according to the present invention, after applying the rising ramp waveforms, Ramp-up, to the scan electrodes Y and the sustain electrodes Z in each sub-field, the falling ramp waveforms, Ramp-dn, are applied only to the scan electrodes Y to initialize the cells of the full screen.

In the initialization period (reset period), the rising ramp waveforms, Ramp-up, which rise substantially from the sustain voltage Vs to the setup voltage Vsetup at a designated slope, are simultaneously applied to the scan electrodes Y and the sustain electrodes Z. At the same time, the address electrodes X are supplied with 0V or the ground voltage GND. The rising ramp waveform, Ramp-up, simultaneously applied to the scan electrodes Y and the sustain electrodes Z like this, causes the dark discharge, which generates almost no light, within the cells of the full screen. As a result, the negative (−) wall charges are accumulated in each of the scan electrode Y and the sustain electrode Z, and the positive (+) wall charges are accumulated on the address electrode X.

Subsequently to the rising ramp waveform, Ramp-up, the falling ramp waveform, Ramp-dn, falling substantially from the sustain voltage Vs is applied to the scan electrode Y and, at the same time, the sustain electrode Z is supplied with the bias voltage Vz-com that is the same as or higher than the scan bias voltage Vscan-com.

At this moment, the address electrode X is sustained at 0V or the ground voltage GND. The bias voltage Vz-com applied to the sustain electrode Z is sustained until the address period. The falling ramp waveform, Ramp-dn, applied to the scan electrode Y causes the dark discharge to be generated between the scan electrode Y and the address electrode X. As a result of the discharge, the excessive wall charges unnecessary for the address discharge are eliminated. On the other hand, most of the wall charges on the sustain electrode Y generated upon the setup discharge by the rising ramp waveform, Ramp-up, are sustained intact until the sustain discharge starts.

During the initialization period, while the erase discharge is generated only between the scan electrode Y and the address electrode X, there occurs no erase discharge between the sustain electrode Z and the address electrode X. Because of this, the amount of the negative wall charge remaining on the sustain electrode Z becomes sufficient until the sustain discharge starts, thus the sustain discharge between the scan electrode Y and the sustain electrode Z is generated more easily.

Figure 35:
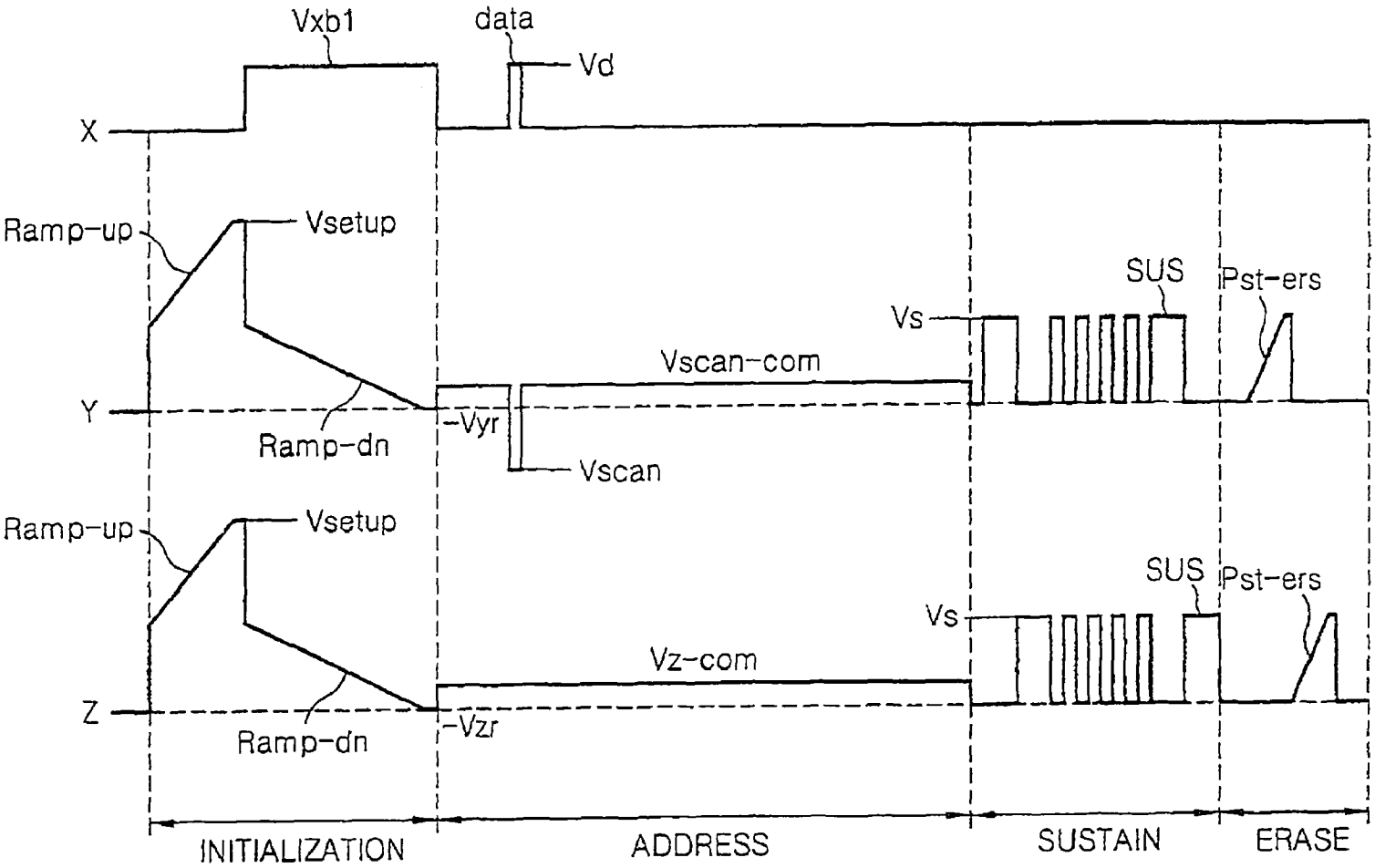
FIG. 35 is a waveform diagram explaining a driving method for a PDP according to the twenty-third embodiment of the present invention.

FIG. 35 is a waveform diagram explaining a driving waveform of a PDP according to the twenty-third embodiment of the present invention.

Referring to FIG. 35, in the driving method for the PDP according to the present invention, after applying the rising ramp waveforms, Ramp-up, to the scan electrodes Y and the sustain electrodes Z in each sub-field, the falling ramp waveforms, Ramp-dn, are applied to the scan electrodes Y and the sustain electrodes Z and, at the same time, the positive DC bias voltages Vxb1 are applied to the address electrodes X to initialize the cells of the full screen.

In the initialization period (reset period), the rising ramp waveforms, Ramp-up, which rise substantially from the sustain voltage Vs to the setup voltage Vsetup at a designated slope, are simultaneously applied to all the scan electrodes Y and the sustain electrodes Z. At the same time, the address electrodes X are supplied with 0V or the ground voltage GND. The rising ramp waveform, Ramp-up, simultaneously applied to the scan electrodes Y and the sustain electrodes Z like this, causes the dark discharge, which generates almost no light, within the cells of the full screen. As a result, the negative (−) wall charges are accumulated in each of the scan electrode Y and the sustain electrode Z, and the positive (+) wall charges are accumulated on the address electrode X.

Subsequently to the rising ramp waveform, Ramp-up, the falling ramp waveform, Ramp-dn, falling substantially from the sustain voltage Vs is applied to the scan electrode Y and the sustain electrode Z and, at the same time, the address electrode X is supplied with the data voltage Vd and the positive DC bias voltage Vxb1 that is the same as or different from the data voltage Vd. The falling ramp waveform, Ramp-dn, applied to the scan electrode Y and the sustain electrode Z causes the dark discharge to be generated between the scan electrode Y and the address electrode X and between the sustain electrode Z and the address electrode X. As a result of the discharge the excessive wall charges unnecessary for the address discharge are eliminated from each of the electrodes X, Y and Z.

The voltage difference between the scan electrode Y and the address electrode X, and the voltage difference between the sustain electrode Z and the address electrode X become bigger upon the erase discharge because the address electrode X is supplied with the positive DC bias voltage Vxb1 while the falling ramp waveform, Ramp-dn, is applied to the scan electrode Y and the sustain electrode Z. Because of this, the end voltages −Vyr, −Vzr of the falling ramp waveform, Ramp-dn, can be heightened. In other words, the absolute value of the end voltage of the falling ramp waveform, Ramp-dn, can be lowered more.

On the other hand, to enable the sustain discharge to be generated more easily, the falling ramp waveform, Ramp-dn, applied to the sustain electrode Z may have a different slope, start voltage and end voltage as compared with the falling ramp waveform, Ramp-dn, applied to the scan electrode Y.

Figure 36:
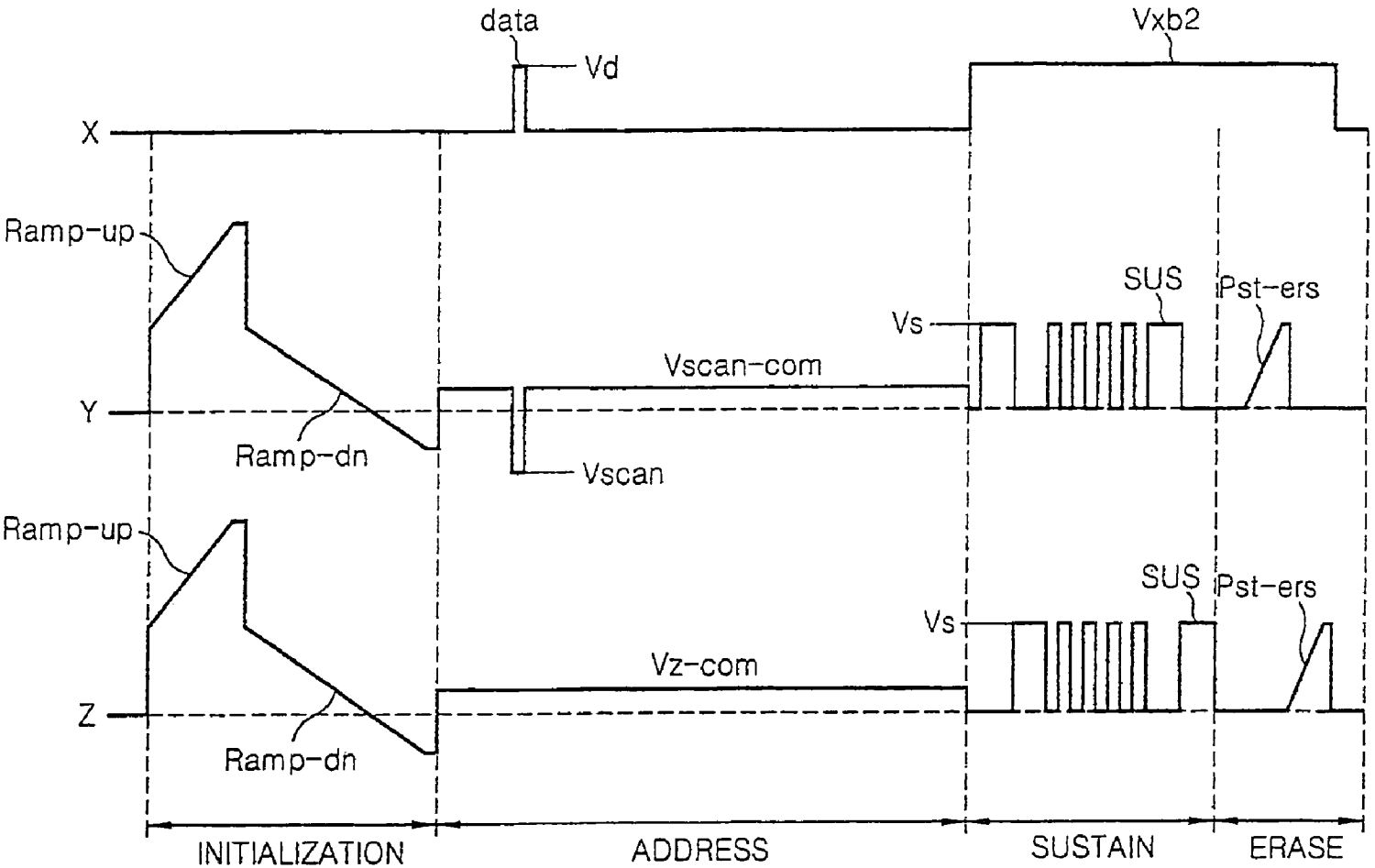
FIG. 36 is a waveform diagram representing waveforms, which are applied to a driving method for a PDP according to the twenty-fourth embodiment of the present invention.

FIG. 36 is a waveform diagram representing waveforms, which are applied to a driving method for a PDP according to the twenty-fourth embodiment of the present invention.

Referring to FIG. 36, in the driving method for the PDP according to the present invention, after applying the rising ramp waveforms, Ramp-up, to the scan electrodes Y and the sustain electrodes Z in each sub-field, the falling ramp waveforms, Ramp-dn, which fall from a different voltage from the start voltage of the rising ramp waveform, are applied to the scan electrodes Y and the sustain electrodes Z to initialize the cells of the full screen. And, for the sustain period and the post-erase period, the positive DC bias voltage. Vxb2 is applied to the address electrodes X.

In the initialization period (reset period), the rising ramp waveforms, Ramp-up, which rise substantially from the sustain voltage Vs to the setup voltage Vsetup at a designated slope, are simultaneously applied to the scan electrodes Y and the sustain electrodes Z. At the same time, the address electrodes X are supplied with 0V or the ground voltage GND. The rising ramp waveform, Ramp-up, simultaneously applied to the scan electrodes Y and the sustain electrodes Z like this, causes the dark discharge, which generates almost no light, within the cells of the full screen. As a result, the negative (−) wall charges are accumulated in each of the scan electrode Y and the sustain electrode Z, and the positive (+) wall charges are accumulated on the address electrode X.

Subsequently to the rising ramp waveform, Ramp-up, the falling ramp waveform, Ramp-dn, falling substantially from the sustain voltage Vs is simultaneously applied to the scan electrode Y and the sustain electrode Z. At this moment, the address electrode X is sustained at 0V or the ground voltage GND. The falling ramp waveform, Ramp-dn, causes the dark discharge to be generated between the scan electrode Y and the address electrode X and between the sustain electrode Z and the address electrode X. As a result of the discharge, the excessive wall charges unnecessary for the address discharge are eliminated; uniform wall charges remain within all the cells.

The address period is substantially the same as in the foregoing embodiment, thus repetitive description thereof will be omitted. Within the cell selected by the address discharge, the negative wall charges are accumulated on the address electrode X opposite to the scan electrode Y.

In the sustain period, firstly, the scan electrode Y and the sustain electrode Z are sequentially supplied with the sustain pulses SUS having wide pulse width, and then the sustain electrode Z and the scan electrode Y are alternately supplied with the normal sustain pulses SUS having narrow pulse width. The sustain pulses SUS having wide pulse width are sequentially applied to the scan electrode Y and the sustain electrode Z. The address electrode X is supplied with the positive DC bias voltage Vxb2 for such a sustain period. The DC bias voltage Vxb2 reduces the voltage difference of the address electrode X with respect to the scan electrode Y and the sustain electrode Z supplied with the sustain pulse SUS, so as to generate the sustain discharge mostly between the scan electrode Y and the sustain electrode Z. In the on-cell selected by the address discharge, the sustain discharge is generated between the scan electrode Y and the sustain electrode Z whenever each sustain pulse SUS is applied, as the sustain pulse SUS is added to the wall voltage within the cell.

In the post-erase period, the post-erase signals, Pst-ers, of rising slope for eliminating the wall charges generated by the sustain discharge are alternately applied to the scan electrode Y and the sustain electrode Z. During the erase period, the voltage in the address electrode X is sustained to be the positive DC bias voltage Vxb2. The post-erase signals, Pst-ers, cause the erase discharge generated between the electrodes X, Y and Z.

On the other hand, when the rising ramp waveform, Ramp-up, is applied to the scan electrode Y and the sustain electrode Z to generate the setup discharge, if a lot of positive wall charges are accumulated on the address electrode X, the voltage difference between the address electrode X and the scan electrode Y, and the voltage difference between the address electrode X and the sustain electrode Z, are commensurately decreased. Because of this, when the rising ramp waveform, Ramp-up, is generated, if a lot of positive wall charges are accumulated on the address electrode X, it is hard to generate the setup discharge. This embodiment shows that during the post-erase period, the voltage in the address electrode X is increased to make the voltage difference between the address electrode X and the scan electrode Y, and the voltage difference between the address electrode X and the sustain electrode Z larger than when the voltage in the address electrode X is 0V or the ground voltage GND. As a result, the post-erase discharge is generated in a large scale relatively to eliminate the increased wall charges on the address electrode X, especially positive wall charges, before the initialization period; thus the initialization can be carried out more stably.

On the other hand, in order to cause the sustain discharge to be generated more easily, the falling ramp waveform, Ramp-dn, applied to the sustain electrode Z may have a different slope, start voltage and end voltage from that of the falling ramp waveform, Ramp-dn, applied to the scan electrode Y.

Figure 37:
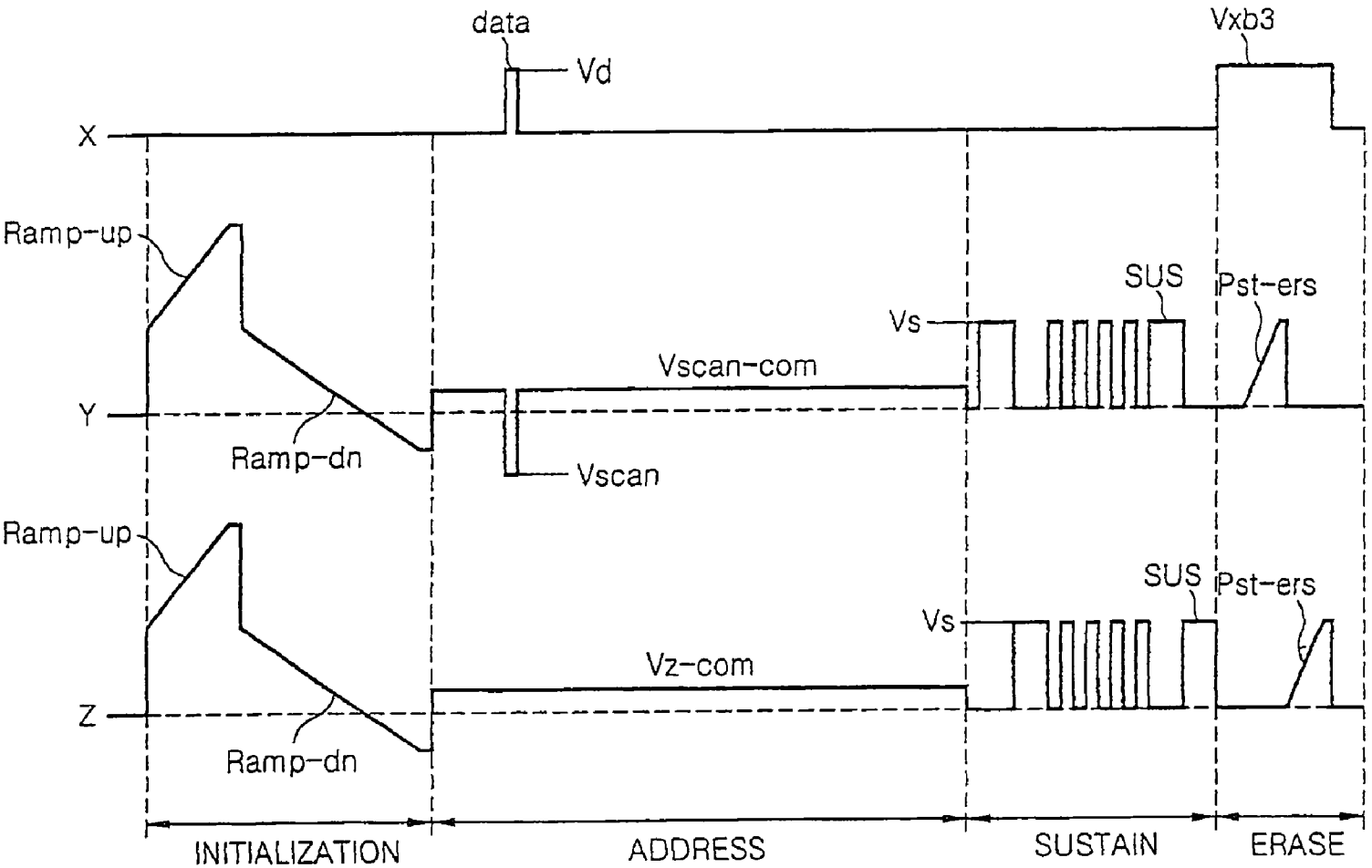
FIG. 37 is a waveform diagram explaining a driving method for a PDP according to the twenty-fifth embodiment of the present invention.

FIG. 37 is a waveform diagram explaining a driving waveform of a PDP according to the twenty-fifth embodiment of the present invention.

Referring to FIG. 37, in the driving method for the PDP according to the present invention, after applying the rising ramp waveforms, Ramp-up, to the scan electrodes Y and the sustain electrodes Z in each sub-field, the falling ramp waveforms, Ramp-dn, which fall from a voltage different than the start voltage of the rising ramp waveform, are applied to the scan electrodes Y and the sustain electrodes Z to initialize the cells of the full screen. During the post-erase period, the positive DC bias voltages Vxb3 are applied to the address electrodes X.

The initialization period, address period, and the post-erase period are substantially the same as the waveform shown in FIG. 36, thus repetitive description thereof will be omitted.

In this embodiment, the address electrode X is sustained at 0V or the ground voltage GND for the sustain period.

This embodiment increases the voltage in the address electrode X during the post-erase period in the same way as the foregoing twenty-fourth embodiment, thereby stabilizing the setup discharge of the initialization period.

The driving waveforms disclosed in the embodiments of the present invention can be applied to all sub-fields in one frame period or can be limitedly applied to part of the sub-fields. Further, the driving waveforms disclosed in the embodiments of the present invention can be applied to the sub-fields of a selective erase scheme where off-cells are selected during the address period, or to the sub-field of a selective write scheme where on-cells are selected during the address period.

On the other hand, the post-erase signals, Pst-ers, as in the foregoing embodiments, can be sequentially applied to the scan electrode Y and the sustain electrode Z, but even though they are applied only to the scan electrode Y, the erase discharge in the post period and the setup discharge in the initialization period can be stably caused. Further, the foregoing embodiments are explained focusing on examples where, in order to further stabilize the sustain discharge, the slope, start voltage and end voltage of the falling ramp waveform applied to the sustain electrode Z are set to be different than those applied to the scan electrode Y. However, in order to get similar effects to this, the slope, start voltage and upper limit voltage of the rising ramp waveform applied to the sustain electrode Z can also be set to be different than those applied to the scan electrode Y.

Figure 38:
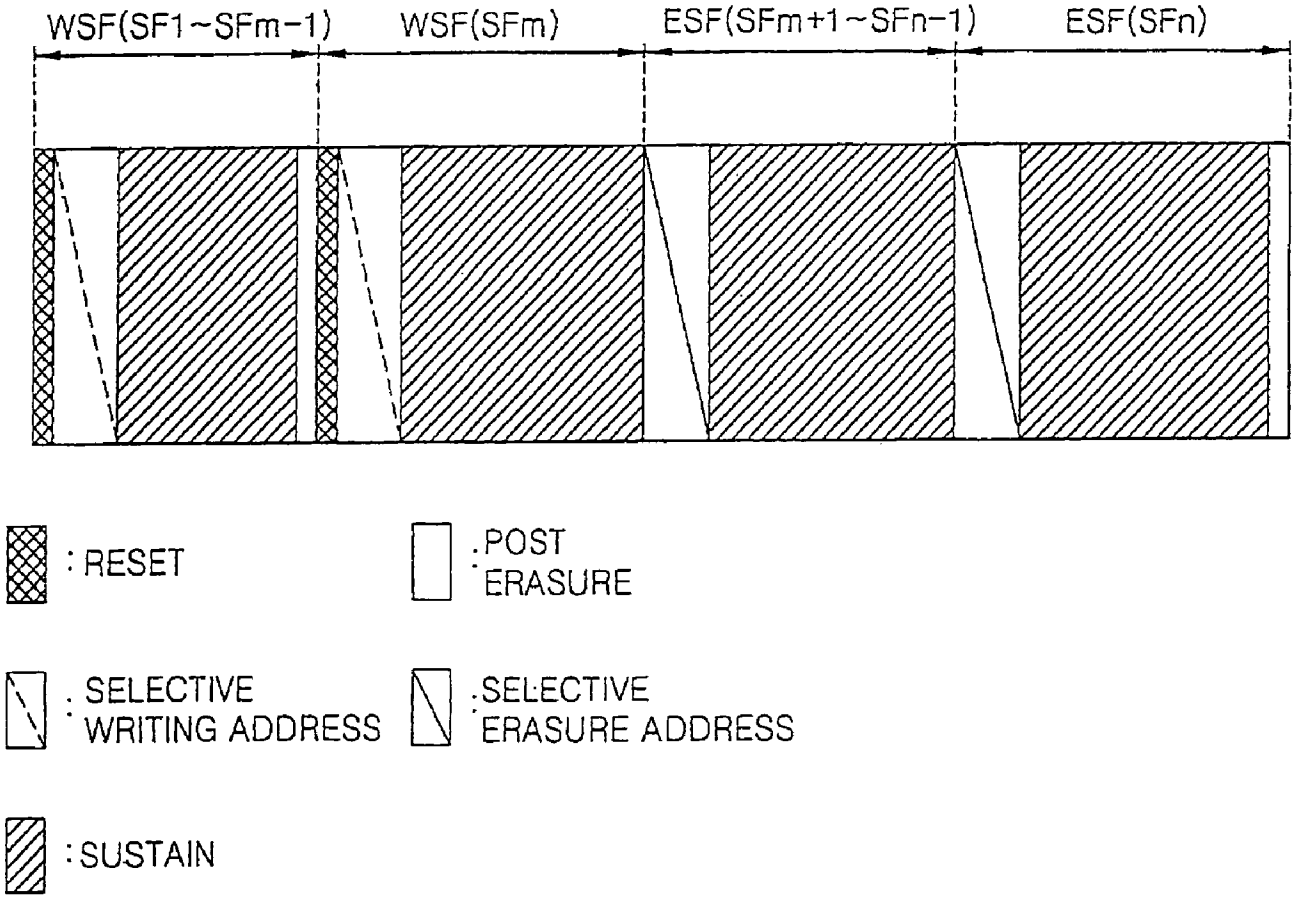
FIG. 38 is a diagram representing a frame configured by a SWSE method.

The applicant of this invention has suggested a Selective Writing and Selective Erasure SWSE method through the U.S. patent application Ser. No. 09/803,993. In the SWSE method, as shown in FIG. 38, selective writing sub-fields and selective erasing sub-fields are arranged together during one frame period to increase contrast characteristics and brightness, and to enable a high-speed drive.

The selective writing sub-field WSF includes a number m (provided m is a positive integer greater than 0) of sub-fields SF1 to SFm. Each of the sub-fields SF1 to SFm−1 except for the $m^{th}$ sub-field SFm is divided (into a reset period uniformly to form a designated amount of wall charge at cells of a full screen, a selective writing address period (hereafter, writing address period) to select on-cells in use of a writing discharge, a sustain period to generate a sustain discharge for the selected on-cell, and a post-erasure period to erase the wall charge in the cell after the sustain discharge.

The $m^{th}$ sub-field SFm, the last sub-field of the selective writing sub-field WSF, is divided into a reset period, a writing address period and a sustain period. The reset period, the writing address period and the post-erasure period of the selective writing sub-field WSF are the same in each of the sub-fields SF1 to SFm, whereas, in the sustain period, a pre-determined brightness weight can be set to be equal or different for each sub-field. Herein, the reset period arranged in the selective writing sub-field WSF can be omitted.

On the other hand, it is possible to dispose a separate erasure period before the first sub-field SF1 of the selective writing sub-field WSF in order to erase all the wall charge accumulated within the cell during the previous frame, wherein an erasure signal is applied to at least one among scan electrode lines Y and sustain electrode lines Z during the separate erasure period.

The selective erasing sub-field ESF includes a number (n−m) (provided n is a positive integer greater than m) of sub-fields SFm+1 to SFn−1. Each of the $(m+1)^{th}$ to $(n-1)^{th}$ sub-fields SFm+1 to SFn−1 is divided into a selective erasing address period (hereafter, erasing address period) to select an Off-cell in use of an erasure discharge, and a sustain period to generate a sustain discharge for the on-cells. The $n^{th}$ sub-field SFn, the last sub-field of the selective erasing sub-field ESF, further includes a post-erasure period arranged at the end thereof to be connected to the sustain period except for the erasing address period and the sustain period. In the sub-fields SFm+1 to SFn of the selective erasing sub-field ESF, the erasing address period is equally set and the sustain period can be set either equally or differently in accordance with brightness weight.

The $n^{th}$ sub-field SFn, the last sub-field of the selective erasing sub-field ESF has a post-erasure period disposed at the end In the same way as the first to $(m-1)^{th}$ sub-fields SF1 to SFm−1 of the selective writing sub-field WSF, and the $m^{th}$ sub-field SFm, the last sub-field of the selective writing sub-field WSF does not have the post-erasure period In the same way as the $(m+1)^{th}$ to $(n-1)^{th}$ sub-fields SFm+1 to SFn−1 of the selective erasing sub-field WSF.

In such a SWSE method, the first to fifth sub-fields SF1 to SF5 arranged at the front of the frame has the brightness of cells determined by Binary Coding to express gray scales.

Figure 39:
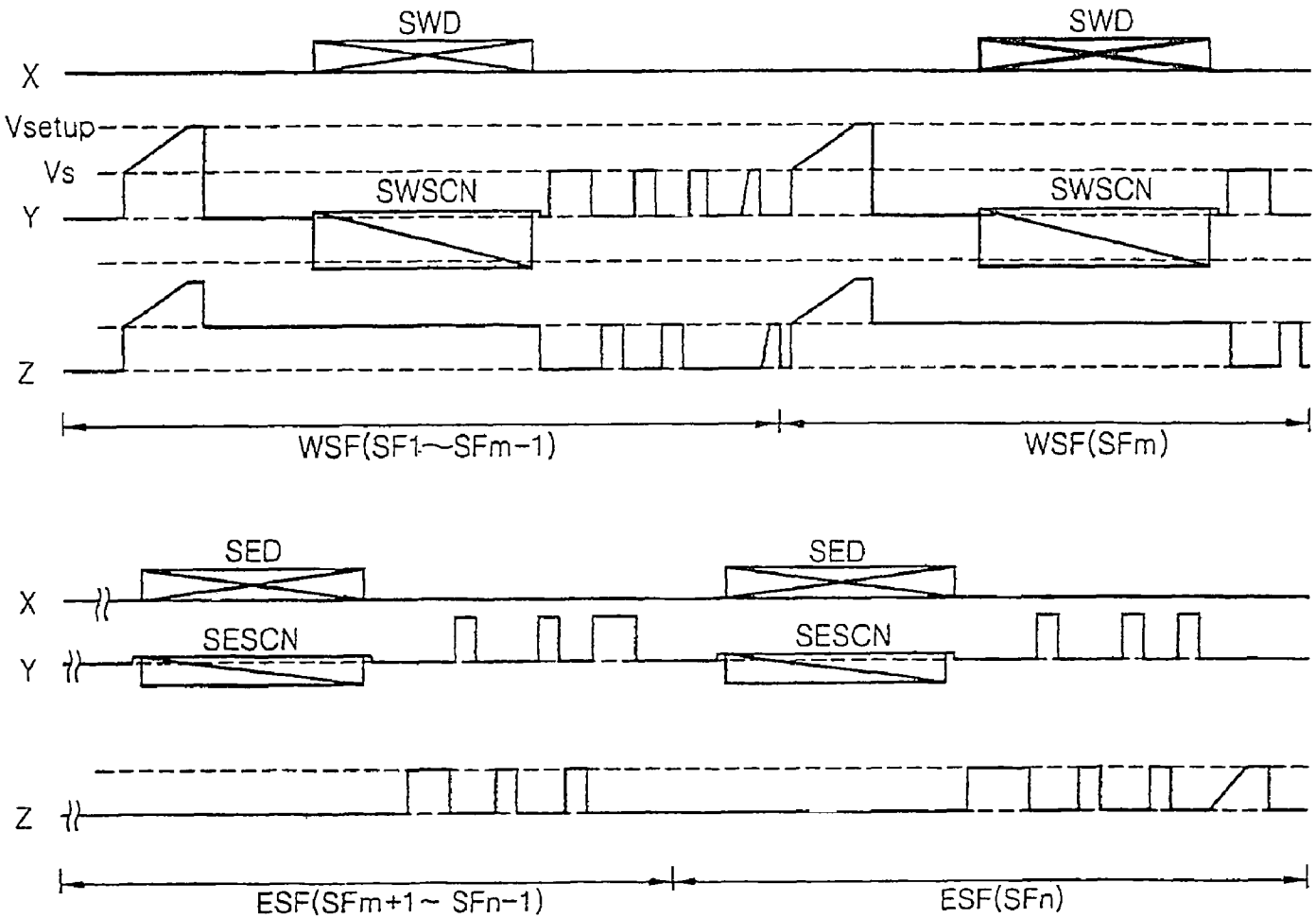
FIGS. 39 and 40 are waveform diagrams representing an example that the SWSE method is applied to drive waveforms of the PDP according to the embodiments of the present invention.

The drive waveforms disclosed in the foregoing embodiments of the present invention can be arranged in the selective writing sub-field of the SWSE method. FIG. 39 illustrates that the drive waveforms shown in FIGS. 5, 6 and 11 to 22 are applied to the selective writing sub-field WSF of the SWSE method.

Figure 40:
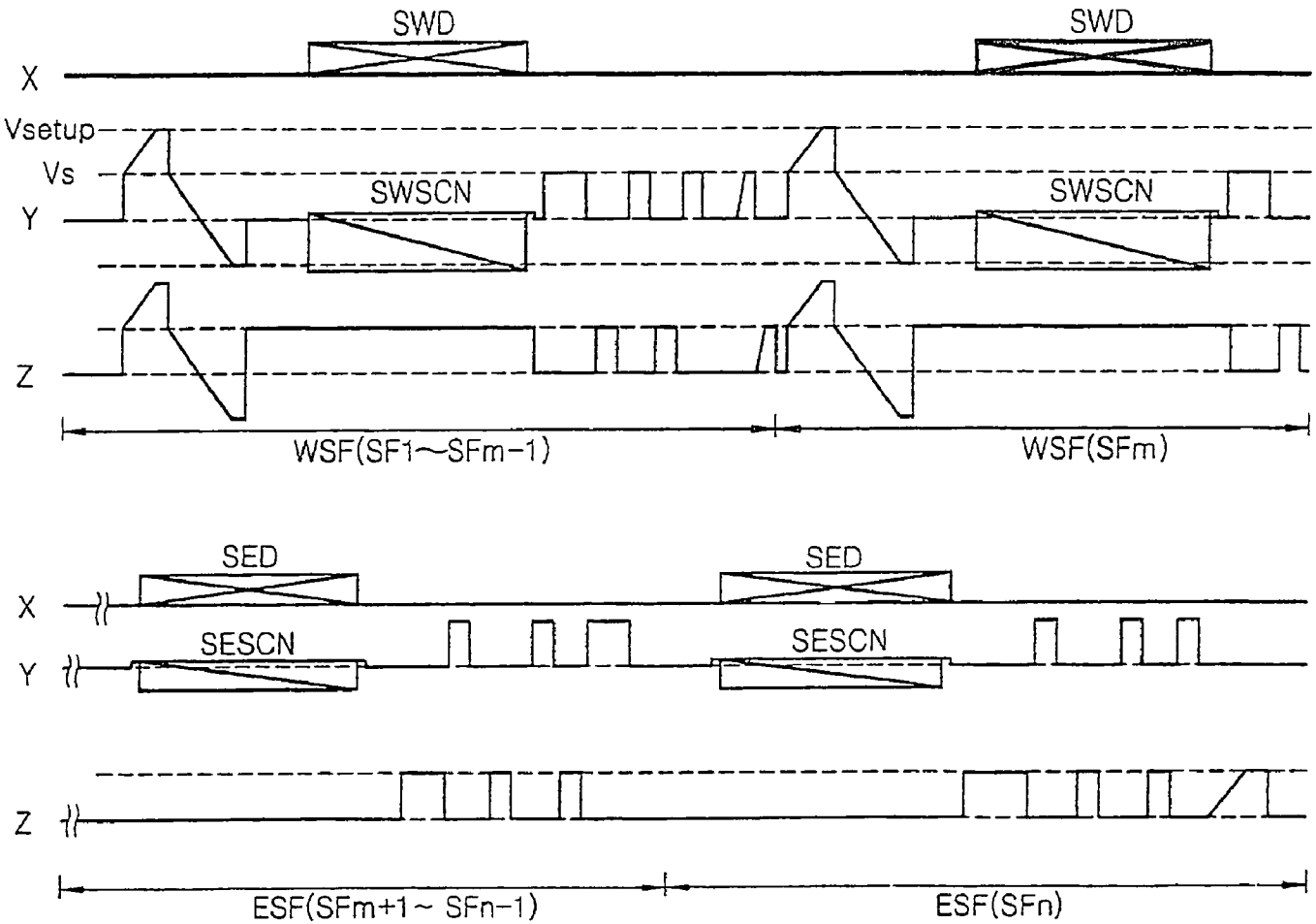

FIG. 40 illustrates that the drive waveforms shown in FIGS. 23, 26, 27 and 29 to 37 are applied to the selective writing sub-field WSF of the SWSE method.

Referring to FIGS. 39 and 40, only the rising ramp waveform or the rising ramp waveform and falling ramp waveform are simultaneously applied to the scan electrodes Y and the sustain electrodes during the initialization period of the selective writing sub-field WSF. The post signal is not applied to the last sub-field SFm of the selective writing sub-field WSF. In FIGS. 39 and 40, the reference numeral 'SWD' is a write data to select the on-cell in the selective writing sub-field WSF, and the reference numeral 'SWSCN' is a write scan pulse to select a horizontal line where the write data is written in the selective writing sub-field WSF. And, the reference numeral 'SED' is an erasure data to select the off-cell in the selective erasing sub-field ESF, and the reference numeral 'SESCN' is an erasure scan pulse to select a horizontal line where the erasure data is written in the selective erasing sub-field WSF.

As described above, the method and apparatus for driving the PDP according to the present invention accumulates a sufficient amount of wall charges on the scan electrode Y and the sustain electrode Z, so as to make it possible to be driven on a low voltage, and sustains the voltage difference between the scan electrode Y and the sustain electrode Z at 0V before the address discharge starts; so as to prevent undesired discharge occurring under a high temperature environment. Further, the method and apparatus for driving the PDP according to the present invention can increase efficiency when applied to a Hi-Xe PDP, and can be applied to the Hi-Xe PDP effectively because the address operation and the sustain operation can be stabilized. Furthermore, the method and apparatus for driving the PDP according to the present invention can have the pre-erase period set between the address period and the sustain period and the pre-erase signals simultaneously applied to the scan electrode Y and the sustain electrode Z within the pre-erase period, so as to eliminate the wall charges remaining within the off cells after the initialization period, thereby making it possible to operate the off-cells stably. Moreover, the method and apparatus for driving the PDP according to the present invention applies the rising ramp waveform and the falling ramp waveform to the scan electrode and the sustain electrode to enable them to be driven stably with wide driving margin nearly without being affected by the firing voltage that varies by cells of red, green and blue. Further, in the method and apparatus for driving the PDP according to the present invention, the initialization waveform applied to the sustain electrode is set to be different from the initialization waveform applied to the scan electrode, causing a lot of wall charges to be retained on the sustain electrode till the sustain discharge starts, thereby making the sustain discharge more stable.

Although the present invention has been explained by the embodiments shown in the drawings described above, it should be understood by the ordinary skilled person in the art that the invention is not limited to the embodiments shown, but rather that various changes or modifications thereof are possible without departing from the spirit of the invention. Accordingly, the scope of the invention shall be determined only by the appended claims and their equivalents.

What is claimed is:

1. A method for driving a plasma display panel having an upper plate on which a scan electrode and a sustain electrode are formed, and a lower plate on which an address electrode is formed, comprising:

applying a first initialization signal to the scan electrode and a second initialization signal to the sustain electrode during an initialization period;

applying a scan signal to the scan electrode, and data signal to the address electrode during an address period; and applying sustain signals to the scan electrode and the sustain electrode during a sustain period, wherein the initialization period includes a first portion and a second portion, during the first portion of the initialization period the voltages of the first and second initialization signals gradually increase and during the second portion of the initialization period the voltage of the first initialization signal gradually decreases from a first voltage to a second voltage and the voltage of the second initialization signal decreases from a third voltage to a fourth voltage, and wherein the second voltage is smaller than the fourth voltage.

2. The method according to claim 1, wherein at least one of the first and the third voltages is substantially the same level as a sustain voltage that the sustain signal maintains during the sustain period.

3. The method according to claim 1, wherein the voltage of the first initialization signal gradually increases from a fifth voltage to a sixth voltage during the first portion of the initialization period, and at least one of the first and the third voltages is smaller than the fifth voltage.

4. The method according to claim 1, wherein the scan signal falls from a scan bias voltage to a scan voltage during the address period, and at least one of the first and the third voltages is greater than the scan bias voltage.

5. The method according to claim 1, wherein the first voltage is smaller than the third voltage.

6. The method according to claim 1, wherein at least one of the second and the fourth voltages is substantially the same voltage level as the voltage of the scan signal applied during the scan period.

7. The method according to claim 1, wherein at least one of the second and the fourth voltages is greater than the voltage of the scan signal applied during the scan period.

8. The method according to claim 1, wherein at least one of the second and the fourth voltages is smaller than a scan bias voltage applied to the scan electrode during the scan period.

9. The method according to claim 1, wherein the fourth voltage is substantially the same level as a ground voltage.

10. The method according to claim 1, wherein a slope of the second initialization signal is different from a slope of the first initialization signal in the second portion of the initialization period.

11. The method according to claim 1, wherein a slope of the second initialization signal gradually decreases at a rate less than a slope of the first initialization signal during the second portion of the initialization period.

12. The method according to claim 1, wherein a sustain bias voltage is applied to the sustain electrode and a scan bias voltage is applied to the scan electrode during the address period, and the sustain bias voltage is greater than a scan bias voltage.

13. The method according to claim 1, wherein a positive bias voltage is applied to the address electrode during second portion of the initialization period.

14. The method according to claim 13, wherein the positive bias voltage is substantially the same level as the voltage of the data signal applied during the address period.

15. The method according to claim 13, further comprising:

applying post-erase signals to the scan electrode and the sustain electrode during a post-erase period following the sustain period, wherein the positive bias voltage is applied to the address electrode during at least one of the post-erase period and the sustain period.

16. The method according to claim 15, wherein the positive bias voltage is substantially the same level as the voltage level of the data signal.

17. The method according to claim 1 wherein during at least one of the first and second portions of the initialization period, wall charges remaining within discharge cells are eliminated.

18. The method according to claim 1, wherein during the sustain period, the sustain signals comprise waveforms of different widths and at least one a first sustain signal waveform and last sustain signal waveform in each sustain period is greater than the widths of the other sustain signal waveforms in the sustain period.

19. The method according to claim 1, further comprising one frame period having a plurality of sub-fields and at least one subfield comprises the initialization period, the scan period, and the sustain period, wherein the frame period comprises at least one selective writing sub-field and selective erasing sub-field.

* * * * *